US011267278B2

(12) United States Patent
Kozaki

(10) Patent No.: US 11,267,278 B2
(45) Date of Patent: Mar. 8, 2022

(54) PROJECTABLE AND RETRACTABLE WRITING TOOL AND MULTI-TIP WRITING TOOL

(71) Applicant: KABUSHIKI KAISHA PILOT CORPORATION, Tokyo (JP)

(72) Inventor: Yoshihito Kozaki, Tokyo (JP)

(73) Assignee: Kabushiki Kaisha Pilot Corporation, Tokyo (JP)

( * ) Notice: Subject to any disclaimer, the term of this patent is extended or adjusted under 35 U.S.C. 154(b) by 3 days.

(21) Appl. No.: 16/955,242

(22) PCT Filed: Dec. 18, 2018

(86) PCT No.: PCT/JP2018/046507
§ 371 (c)(1),
(2) Date: Jun. 18, 2020

(87) PCT Pub. No.: WO2019/124346
PCT Pub. Date: Jun. 27, 2019

(65) Prior Publication Data

US 2020/0331285 A1 Oct. 22, 2020

(30) Foreign Application Priority Data

Dec. 20, 2017 (JP) ..... JP2017-244446
Dec. 20, 2017 (JP) ..... JP2017-244447
Dec. 20, 2017 (JP) ..... JP2017-244448

(51) Int. Cl.
*B43K 7/12* (2006.01)
*B43K 24/08* (2006.01)
*B43K 24/12* (2006.01)

(52) U.S. Cl.
CPC ..... *B43K 7/12* (2013.01); *B43K 24/08* (2013.01); *B43K 24/12* (2013.01)

(58) Field of Classification Search
CPC ..... B43K 7/005; B43K 7/12; B43K 24/00; B43K 24/02; B43K 24/023; B43K 24/026;
(Continued)

(56) References Cited

U.S. PATENT DOCUMENTS 3,051,132 A * 8/1962 Johmann ..... B43K 24/084 401/103
3,525,573 A * 8/1970 Fend ..... B43K 7/12 401/108
(Continued)

FOREIGN PATENT DOCUMENTS

CN 104968508 A 10/2015
EP 2952358 A1 12/2015
(Continued)

OTHER PUBLICATIONS

International Search Report dated Feb. 19, 2019 in related application No. PCT/JP2018/046507.
(Continued)

*Primary Examiner* — David P Angwin
*Assistant Examiner* — Bradley S Oliver
(74) *Attorney, Agent, or Firm* — Renner, Kenner, Greive, Bobak, Taylor & Weber

(57) ABSTRACT

The present invention includes a shaft cylinder having an opening at a front end thereof, a tip holder movable in an axial direction of the shaft cylinder, a tip projectable and retractable in conjunction with a movement of the tip holder, an annular member fitted on the tip holder and axially movable, and an elastic member connecting the tip holder and the annular member so that they are movable relatively to each other. A contact surface tapered toward the front end is formed on an outer periphery of the annular member. A cutout reduces an inner diameter of the annular when a load
(Continued)

is received by the contact surface. A guide surface is formed on the part of the inside surface of the shaft cylinder. The contact surface receives the load from the guide surface in conjunction with the movement of the tip holder toward the front end side.

21 Claims, 39 Drawing Sheets

(58) Field of Classification Search
CPC ..... B43K 24/03; B43K 24/04; B43K 24/06; B43K 24/08; B43K 24/082; B43K 24/084; B43K 24/086; B43K 24/088; B43K 24/10; B43K 24/12; B43K 24/14; B43K 24/143; B43K 24/146; B43K 24/16; B43K 24/163; B43K 24/166; B43K 24/18; B43K 24/183; B43K 24/186
See application file for complete search history.

(56) References Cited

U.S. PATENT DOCUMENTS

| | | | | | |
|---|---|---|---|---|---|
| 3,594,091 | A * | 7/1971 | Bleuer | ..... | B43K 7/02 401/107 |
| 4,533,272 | A * | 8/1985 | Sakai | ..... | B43K 7/12 401/107 |
| 4,859,103 | A * | 8/1989 | Wittek | ..... | B43K 7/12 401/108 |
| 4,969,764 | A | 11/1990 | Gregory | | |
| 6,231,257 | B1 * | 5/2001 | Stevens | ..... | B43K 5/17 401/107 |
| 9,597,920 | B2 * | 3/2017 | Oomoto | ..... | B43K 21/00 |
| 2015/0336419 | A1 | 11/2015 | Oomoto | | |

FOREIGN PATENT DOCUMENTS

| | | | | | |
|---|---|---|---|---|---|
| JP | H513790 | U | 2/1993 | ..... | B43K 24/02 |
| JP | H585683 | U | 11/1993 | ..... | B43K 24/18 |
| JP | H593884 | U | 12/1993 | ..... | B43K 24/02 |
| JP | 2010064302 | A | 3/2010 | ..... | B43K 23/08 |
| JP | 2013063541 | A | 4/2013 | ..... | B43K 24/08 |
| JP | 2013220602 | A | 10/2013 | ..... | B43K 24/18 |
| KR | 83-2943 | Y1 | 12/1983 | | |

OTHER PUBLICATIONS

Communication from EPO with extended European Search Report for EP App. No. 18892756.0 dated Oct. 8, 2021 and Email from the EPO examiner dated Oct. 14, 2021 correcting a typographical error in identifying U.S. Pat. No. 4,969,764.

* cited by examiner

PROJECTABLE AND RETRACTABLE WRITING TOOL AND MULTI-TIP WRITING TOOL

CROSS-REFERENCE TO RELATED APPLICATION

This is a § 371 application of International Patent Application No. PCT/JP2018/046507 filed Dec. 18, 2018, which claims the benefit of Japanese Patent Application Nos. 2017-244446 filed Dec. 20, 2017; 2017-244447 filed Dec. 20, 2017; and 2017-244448 filed Dec. 20, 2017.

TECHNICAL FIELD

The present invention pertains to a projectable and retractable writing tool which is projectable and retractable through an opening of a shaft cylinder in conjunction with a movement of a tip holder. In addition, the present invention pertains to a multi-tip (multi-core) writing tool. In particular, the present invention pertains to a multi-tip writing tool which is capable of containing a plurality of writing tips in a shaft cylinder.

BACKGROUND ART

JP-U-H05-85683 (Patent Document 1) discloses an anti-sway device for a leading edge of a writing tool. In the structure of the anti-sway device, a concave groove is provided at a suitable position of the leading edge of the writing tool, and an elastic O-ring, whose outer diameter is almost the same as an inner diameter of a leading edge of a shaft cylinder, is fitted into the concave groove. According to this anti-sway device, in a pencil type or knock type of writing tool, rattling sound, which may be caused by a contact between the leading edge of the writing tool and a leading-edge hole of the leading edge of the shaft cylinder at the time of writing, can be prevented.

JP-U-H05-93884 (Patent Document 2) also discloses an anti-sway device for a leading edge of a writing tool. In the structure of the anti-sway device, an engagement step is provided at a leading edge of a shaft cylinder, and an elastic ring, whose inner diameter is slightly smaller than an outer diameter of the leading edge of the writing tool, is engaged with the engagement step. According to this anti-sway device, since the elastic ring locks the leading edge of the writing tool, rattling at the time of writing can be prevented even if there is a gap between a leading-edge inner diameter of the shaft cylinder and the leading edge of the writing tool.

JP-A-2013-220602 (Patent Document 3) discloses a multi-tip writing tool in which each writing element is slidable in a front and rear direction with respect to a shaft cylinder and a writing tip of each writing element is projectable through an opening of the shaft cylinder. An annular member is arranged around an outer periphery of a leading edge portion of each writing element, and an inside surface of the shaft cylinder in the vicinity of the opening is provided with a substantially spherical surface with which the annular member can come into contact. The annular member is fixed to the corresponding writing element via a spring, and thus is biased forward. When the writing element is projected, the annular member closely contacts with the inside surface of the shaft cylinder because of an elastic force of the spring. Thus, rattling at the time of writing can be prevented.

PRIOR ART DOCUMENT

Patent Document List

Patent Document 1 recited in the present specification is JP-U-H05-85683.

Patent Document 2 recited in the present specification is JP-U-H05-93884.

Patent Document 3 recited in the present specification is JP-A-2013-220602.

SUMMARY OF INVENTION

Technical Problem

According to the technique disclosed in JP-U-H05-85683 (Patent Document 1) and JP-U-H05-93884 (Patent Document 2), the O-ring or ring is so radially deformable that the effect of preventing the rattling may be not sufficient. In addition, the writing tip may stick to the O-ring or ring, which may deteriorate a smooth retracting movement of the writing tip that has been projected.

On the other hand, according to the technique disclosed in JP-A-2013-220602 (Patent Document 3), in order to enhance the effect of preventing the rattling at the time of writing, it is necessary to properly manage a dimensional relationship between an inside surface of the annular member and an outer periphery surface of the writing tip. For example, if a gap size between the outer periphery surface of the writing tip and the inside surface of the annular member is larger than a gap size between the outer periphery surface of the writing tip and an inside surface of a leading edge portion of the shaft cylinder, the effect of preventing the rattling at the time of writing cannot be obtained. Thus, high dimensional precision is required, which may be a problem in productivity.

The present invention has been made based on the above findings. The object of the present invention is to provide a projectable and retractable writing tool and a multi-tip writing tool which can prevent rattling of a tip at the time of writing and thus can achieve a stable writing feeling without requiring a high-precision dimension management for parts.

Solution to Problem

The first invention is a projectable and retractable writing tool comprising: a shaft cylinder having an opening at a front end thereof, a tip holder contained in an inside of the shaft cylinder and movable in an axial direction of the shaft cylinder, a tip fixed to a front end of the tip holder to be projectable and retractable through the opening of the shaft cylinder in conjunction with a movement of the tip holder, an annular member loosely fitted onto an outer periphery of the tip holder or the tip to be movable in an axial direction of the tip holder or the tip with respect to the tip holder or the tip, and an elastic member connecting the tip holder and the annular member such that the tip holder and the annular member are movable relatively to each other, wherein a contact surface is formed on at least a part of an outer periphery of the annular member, the contact surface being configured to come into contact with a part of an inside surface of the shaft cylinder in conjunction with a movement of the tip holder toward a front end side thereof, a cutout is formed at a part of the annular member such that an inner diameter of the annular member is reduced when a load is received by the contact surface, a guide surface is formed on the part of the inside surface of the shaft cylinder, the guide surface being configured to come into contact with the contact surface in conjunction with the movement of the tip holder toward the front end side, and the contact surface is configured to receive the load from the guide surface in conjunction with the movement of the tip holder toward the front end side.

According to the first invention, the contact surface of the annular member receives the load from the guide surface of the shaft cylinder in conjunction with the movement of the tip holder toward the front end side, which reduces the inner diameter of the annular member due to existence of the cutout of the annular member. In this manner, the shaft cylinder and the annular member cooperate with each other such that the tip or the tip holder can be grasped in a rattling-free (play-free) manner. In addition, since the tip holder and the annular member are connected via the elastic member such that the tip holder and the annular member are movable relatively to each other, it can be assured that the tip or the tip holder can be effectively grasped in a rattling-free (play-free) manner even if no high-precision dimension management is applied to a degree of reduction of the inner diameter of the annular member or the like.

Preferably, the cutout is a plurality of cutout elements arranged at regular intervals in a circumferential direction of the annular member, and each of the plurality of cutout elements is a slit extending in an axial direction of the annular member. In this case, the inner diameter of the annular member can be reduced in a circumferentially well-balanced manner.

Preferably, the contact surface has a tapered shape toward the front end side, and the guide surface also has a tapered shape toward the front end side. Preferably, the contact surface has a frustoconical surface, for example. In this case, preferably, the guiding surface is a concave frustoconical surface. Alternatively, preferably, the contact surface has a convex curved surface which is rotationally symmetric about an axis. In this case, preferably, the guiding surface is a concave curved surface or a concave frustoconical surface which is also rotationally symmetric about an axis but has a curvature gentler than that of the convex curved surface.

In addition, preferably, the elastic member is a coil spring. Alternatively, preferably, the elastic member is a tubular resin spring member having a lot of splits each of which extends in a direction perpendicular to the axial direction. In the latter case, the annular member and the tubular resin spring member may be integrally molded of the same resin material.

In addition, preferably, the elastic member and the tip holder may be connected via an annular collar. In this case, preferably, the elastic member and the annular collar are fixed to each other, and the annular collar and the shaft cylinder are fixed to each other via a second elastic member. According to this feature, the tip holder and the annular collar need not to be fixed, and thus existing refills for replacement including conventional tip holders may be used. In addition, in this configuration, an amount of displacement of the second elastic member in conjunction with the movement of the tip holder is larger than an amount of displacement of the elastic member in conjunction with the movement of the tip holder.

In addition, the first invention is also applicable to only a shaft cylinder for a projectable and retractable writing tool. That is to say, the present invention is a shaft cylinder for a projectable and retractable writing tool, the shaft cylinder being capable of containing a tip holder such that the tip holder is movable in an axial direction, a tip being fixed to a front end of the tip holder, the shaft cylinder having an opening at a front end thereof, through which the tip is projectable and retractable in conjunction with a movement of the tip holder, the shaft cylinder comprising; an annular member loosely fitted onto an outer periphery of the tip holder or the tip in a state wherein the shaft cylinder contains the tip holder, to be movable in an axial direction of the tip holder or the tip with respect to the tip holder or the tip while being loosely fitted, an annular collar connected to the annular member via an elastic member, the annular collar being capable of coming into contact with the tip holder in conjunction with a movement of the tip holder toward a front end side thereof, and a second elastic member configured to support the annular collar on an inside surface of the shaft cylinder, wherein a contact surface is formed on at least a part of an outer periphery of the annular member, the contact surface being tapered toward a front end thereof, a cutout being formed at a part of the annular member such that an inner diameter of the annular member is reduced when a load is received by the contact surface, a guide surface being formed on a part of an inside surface of the shaft cylinder, the guide surface being tapered toward a front end thereof, and the contact surface being configured to receive the load from the guide surface in conjunction with a movement of the tip holder toward a front end side thereof.

The second invention is a multi-tip writing tool comprising: a shaft cylinder having an opening at a front end thereof, a plurality of tip holders contained in an inside of the shaft cylinder and movable in an axial direction of the shaft cylinder, a tip fixed to a front end of each of the plurality of tip holders to be projectable and retractable through the opening of the shaft cylinder in conjunction with a movement of the corresponding tip holder, an annular member loosely fitted onto an outer periphery of each tip or each tip holder fixed to each tip to be movable in an axial direction of the tip with respect to the tip, and an elastic member connecting the tip holder and the annular member such that the tip holder and the annular member are movable relatively to each other, wherein a contact surface is formed on at least a part of an outer periphery of the annular member, the contact surface being configured to come into contact with a part of an inside surface of the shaft cylinder in conjunction with a movement of the tip holder connected to the annular member toward a front end side thereof, a cutout is formed at a part of the annular member such that an inner diameter of the annular member is reduced when a load is received by the contact surface, a guide surface is formed on the part of the inside surface of the shaft cylinder, the guide surface being configured to come into contact with the contact surface in conjunction with the movement of the tip holder toward the front end side, and the contact surface is configured to receive the load from the guide surface in conjunction with the movement of the tip holder connected to the annular member having the contact surface toward the front end side.

According to the second invention, the contact surface of the annular member receives the load from the guide surface of the shaft cylinder in conjunction with the movement of the tip holder toward the front end side, which reduces the inner diameter of the annular member due to existence of the cutout of the annular member. In this manner, the shaft cylinder and the annular member cooperate with each other such that the tip or the tip holder can be grasped in a rattling-free (play-free) manner. In addition, since the tip holder and the annular member are connected via the elastic member such that the tip holder and the annular member are movable relatively to each other, it can be assured that the tip or the tip holder can be effectively grasped in a rattling-free (play-free) manner even if no high-precision dimension management is applied to a degree of reduction of the inner diameter of the annular member or the like.

Preferably, the cutout is a plurality of cutout elements arranged at regular intervals in a circumferential direction of the annular member, and each of the plurality of cutout elements is a slit extending in an axial direction of the annular member. In this case, the inner diameter of the annular member can be reduced in a circumferentially well-balanced manner.

Preferably, the contact surface has a tapered shape toward the front end side, and the guide surface also has a tapered shape toward the front end side. Preferably, the contact surface has a frustoconical surface, for example. In this case, preferably, the guiding surface is a concave frustoconical surface. Alternatively, preferably, the contact surface has a convex curved surface which is rotationally symmetric about an axis. In this case, preferably, the guiding surface is a concave curved surface or a concave frustoconical surface which is also rotationally symmetric about an axis but has a curvature gentler than that of the convex curved surface.

In addition, preferably, the elastic member is a tubular resin spring member having a lot of splits each of which extends in a direction perpendicular to the axial direction. In this case, further preferably, the annular member and the tubular resin spring member are integrally molded of the same resin material.

In addition, preferably, one of the plurality of tip holders holds a friction member as a tip. The friction member means an eraser or a frictional heat generating rubber for a thermochromic writing tool (a rubber for erasing). In this case, it is possible to prevent rattling of the friction member when erasing a written trace, and thus to obtain a more stable erasing feeling.

In addition, preferably, an operation element having an operation part is provided on a rear end side of each tip holder, a plurality of window holes, each of which extends in a front and rear direction, are distributed and provided at a side wall of the shaft cylinder in radial directions, the operational part of each operational element is projected radially outward from a corresponding window hole, a locking wall is provided in the shaft cylinder, the locking wall being capable of locking a part of an operation element when the operation part of the operation element is operated to slide forward, a plurality of coil springs configured to respectively bias the plurality of tip holders rearward is provided in the shaft cylinder, front end sides of the plurality of coil springs are supported by a spring supporter fixed to the shaft cylinder, and the spring supporter is provided with a plurality of inside holes through which the plurality of tip holders can be inserted respectively.

The third invention is a multi-tip writing tool comprising: a shaft cylinder having an opening at a front end thereof, a plurality of tip holders contained in an inside of the shaft cylinder and movable in an axial direction of the shaft cylinder, a tip fixed to a front end of each of the plurality of tip holders to be projectable and retractable through the opening of the shaft cylinder in conjunction with a movement of the corresponding tip holder, an annular member capable of being loosely fitted on an outer periphery of one tip holder among the plurality of tip holders or one tip fixed to the one tip holder in conjunction with a movement of the one tip holder toward a front end side thereof to be movable in an axial direction of the one tip holder or the one tip with respect to the one tip holder or the one tip while being loosely fitted, an annular collar connected to the annular member via an elastic member, the annular collar being capable of coming into contact with the one tip holder in conjunction with the movement of the one tip holder toward the front end side, and a second elastic member configured to support the annular collar on an inside surface of the shaft cylinder, wherein a contact surface is formed on at least a part of an outer periphery of the annular member, the contact surface being configured to come into contact with a part of an inside surface of the shaft cylinder when the annular member is moved toward the front end side via the annular collar and the elastic member in conjunction with the movement of the one tip holder toward the front end side, a cutout is formed at a part of the annular member such that an inner diameter of the annular member is reduced when a load is received by the contact surface, a guide surface is formed on the part of the inside surface of the shaft cylinder, the guide surface being configured to come into contact with the contact surface in conjunction with the movement of the one tip holder toward the front end side, and the contact surface is configured to receive the load from the guide surface when the annular member is moved toward the front end side via the annular collar and the elastic member in conjunction with the movement of the one tip holder toward the front end side.

According to the third invention, the contact surface of the annular member receives the load from the guide surface of the shaft cylinder when the annular member is moved toward the front end side via the annular collar and the elastic member in conjunction with the movement of the one tip holder toward the front end side, which reduces the inner diameter of the annular member due to existence of the cutout of the annular member. In this manner, the shaft cylinder and the annular member cooperate with each other such that the tip or the tip holder can be grasped in a rattling-free (play-free) manner. In addition, since the annular collar abutted by the tip holder and the annular member are connected via the elastic member, it can be assured that the tip or the tip holder can be effectively grasped in a rattling-free (play-free) manner even if no high-precision dimension management is applied to a degree of reduction of the inner diameter of the annular member or the like.

Preferably, the cutout is a plurality of cutout elements arranged at regular intervals in a circumferential direction of the annular member, and each of the plurality of cutout elements is a slit extending in an axial direction of the annular member. In this case, the inner diameter of the annular member can be reduced in a circumferentially well-balanced manner.

Preferably, the contact surface has a tapered shape toward the front end side, and the guide surface also has a tapered shape toward the front end side. Preferably, the contact surface has a frustoconical surface, for example. In this case, preferably, the guiding surface is a concave frustoconical surface. Alternatively, preferably, the contact surface has a convex curved surface which is rotationally symmetric about an axis. In this case, preferably, the guiding surface is a concave curved surface or a concave frustoconical surface which is also rotationally symmetric about an axis but has a curvature gentler than that of the convex curved surface.

In addition, preferably, the elastic member is a tubular resin spring member having a lot of splits each of which extends in a direction perpendicular to the axial direction. In this case, further preferably, the annular member, the tubular resin spring member and the annular collar are integrally molded of the same resin material.

In addition, preferably, one of the plurality of tip holders holds a friction member as a tip. The friction member means an eraser or a frictional heat generating rubber for a thermochromic writing tool (a rubber for erasing). In this case, it is possible to prevent rattling of the friction member when erasing a written trace, and thus to obtain a more stable erasing feeling.

In addition, the third invention is also applicable to only a shaft cylinder for a multi-tip writing tool. That is to say, the present invention is a shaft cylinder for a multi-tip writing tool, the shaft cylinder being capable of containing a plurality of tip holders such that each tip holder is movable in an axial direction, a tip being fixed to a front end of each tip holder, the shaft cylinder having an opening at a front end thereof, through which a tip fixed to one tip holder among the plurality of tip holders is projectable and retractable in conjunction with a movement of the one tip holder, the shaft cylinder comprising, an annular member capable of being loosely fitted on an outer periphery of one tip holder among the plurality of tip holders or one tip fixed to the one tip holder in conjunction with a movement of the one tip holder toward a front end side thereof to be movable in an axial direction of the one tip holder or the one tip with respect to the one tip holder or the one tip while being loosely fitted, an annular collar connected to the annular member via an elastic member, the annular collar being capable of coming into contact with the one tip holder in conjunction with the movement of the one tip holder toward the front end side, and a second elastic member configured to support the annular collar on an inside surface of the shaft cylinder, wherein a contact surface is formed on at least a part of an outer periphery of the annular member, the contact surface being configured to come into contact with a part of an inside surface of the shaft cylinder when the annular member is moved toward the front end side via the annular collar and the elastic member in conjunction with the movement of the one tip holder toward the front end side, a cutout is formed at a part of the annular member such that an inner diameter of the annular member is reduced when a load is received by the contact surface, a guide surface is formed on the part of the inside surface of the shaft cylinder, the guide surface being configured to come into contact with the contact surface in conjunction with the movement of the one tip holder toward the front end side, and the contact surface is configured to receive the load from the guide surface when the annular member is moved toward the front end side via the annular collar and the elastic member in conjunction with the movement of the one tip holder toward the front end side.

Advantageous Effects of Invention

According to the first invention, the contact surface of the annular member receives the load from the guide surface of the shaft cylinder in conjunction with the movement of the tip holder toward the front end side, which reduces the inner diameter of the annular member due to existence of the cutout of the annular member. In this manner, the shaft cylinder and the annular member cooperate with each other such that the tip or the tip holder can be grasped in a rattling-free (play-free) manner. In addition, since the tip holder and the annular member are connected via the elastic member such that the tip holder and the annular member are movable relatively to each other, it can be assured that the tip or the tip holder can be effectively grasped in a rattling-free (play-free) manner even if no high-precision dimension management is applied to a degree of reduction of the inner diameter of the annular member or the like.

According to the second invention, the contact surface of the annular member receives the load from the guide surface of the shaft cylinder in conjunction with the movement of the tip holder toward the front end side, which reduces the inner diameter of the annular member due to existence of the cutout of the annular member. In this manner, the shaft cylinder and the annular member cooperate with each other such that the tip or the tip holder can be grasped in a rattling-free (play-free) manner. In addition, since the tip holder and the annular member are connected via the elastic member such that the tip holder and the annular member are movable relatively to each other, it can be assured that the tip or the tip holder can be effectively grasped in a rattling-free (play-free) manner even if no high-precision dimension management is applied to a degree of reduction of the inner diameter of the annular member or the like.

According to the third invention, the contact surface of the annular member receives the load from the guide surface of the shaft cylinder when the annular member is moved toward the front end side via the annular collar and the elastic member in conjunction with the movement of the one tip holder toward the front end side, which reduces the inner diameter of the annular member due to existence of the cutout of the annular member. In this manner, the shaft cylinder and the annular member cooperate with each other such that the tip or the tip holder can be grasped in a rattling-free (play-free) manner. In addition, since the annular collar abutted by the tip holder and the annular member are connected via the elastic member, it can be assured that the tip or the tip holder can be effectively grasped in a rattling-free (play-free) manner even if no high-precision dimension management is applied to a degree of reduction of the inner diameter of the annular member or the like.

BRIEF DESCRIPTION OF DRAWINGS

FIG. 5 is a schematic view showing the projectable and retractable writing tool shown in FIG. 1, under a state wherein the tip holder has been removed for replacement or the like;

FIG. 10 is a schematic view showing the projectable and retractable writing tool shown in FIG. 6, under a state wherein the tip holder has been removed for replacement or the like;

FIG. 15 is a schematic view showing the projectable and retractable writing tool shown in FIG. 11, under a state wherein the tip holder has been removed for replacement or the like;

FIG. 20 is a schematic view showing the projectable and retractable writing tool shown in FIG. 16, under a state wherein the tip holder has been removed for replacement or the like;

DESCRIPTION OF EMBODIMENTS

With reference to the attached drawings, we explain four embodiments for the first invention, an embodiment for the second invention and an embodiment for the third invention.

First Embodiment of First Invention

Figure 1:
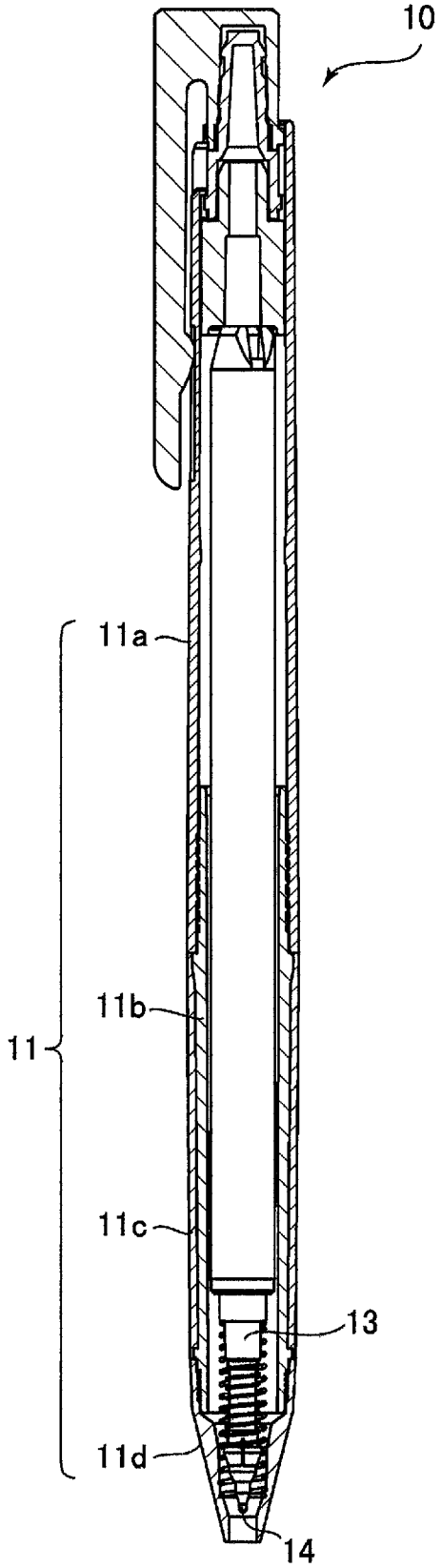
FIG. 1 is a schematic longitudinal section view showing a projectable and retractable writing tool according to a first embodiment of a first invention, under a state wherein a tip (writing element) is not projected.
Figure 2A:
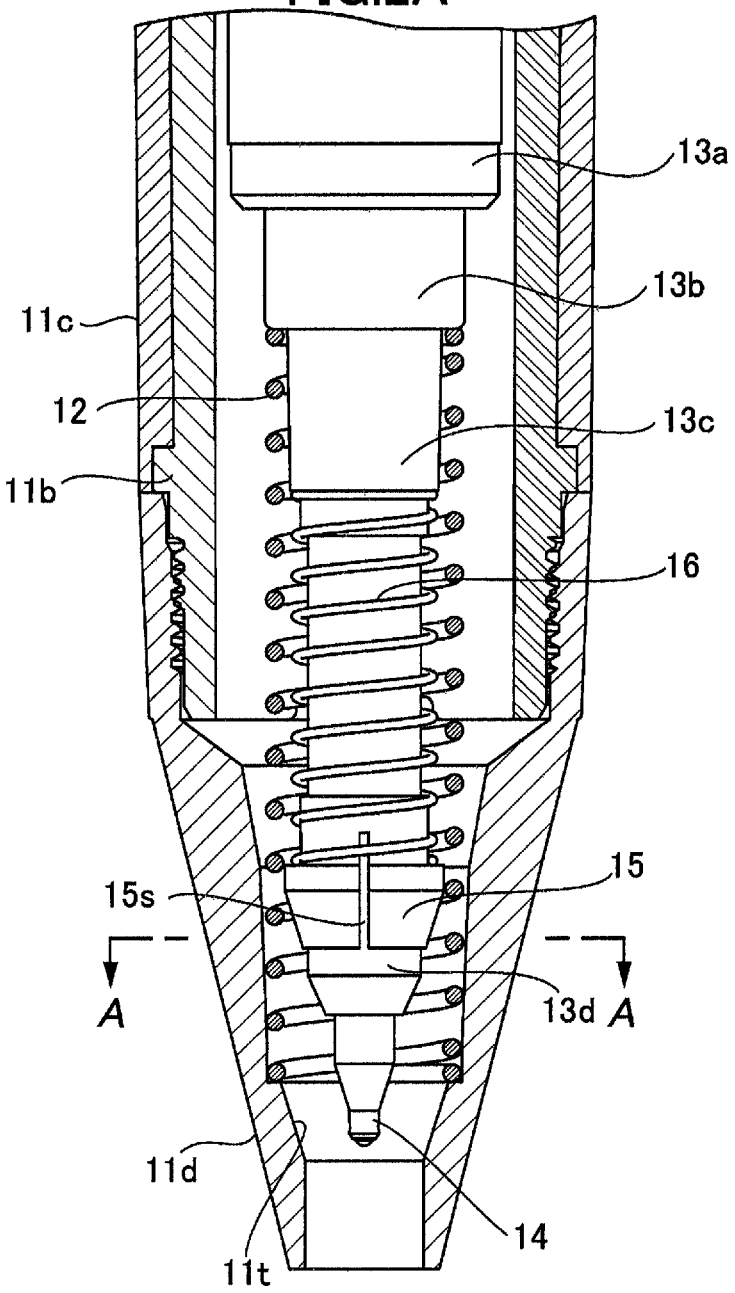
FIG. 2A is an enlarged longitudinal section view of a leading edge portion of the projectable and retractable writing tool shown in FIG. 1.
Figure 2B:
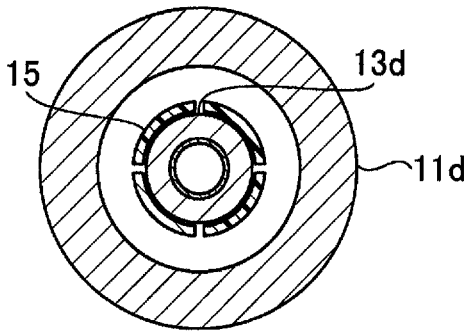
FIG. 2B is a section view taken along line A-A of FIG. 2A.
Figure 3A:
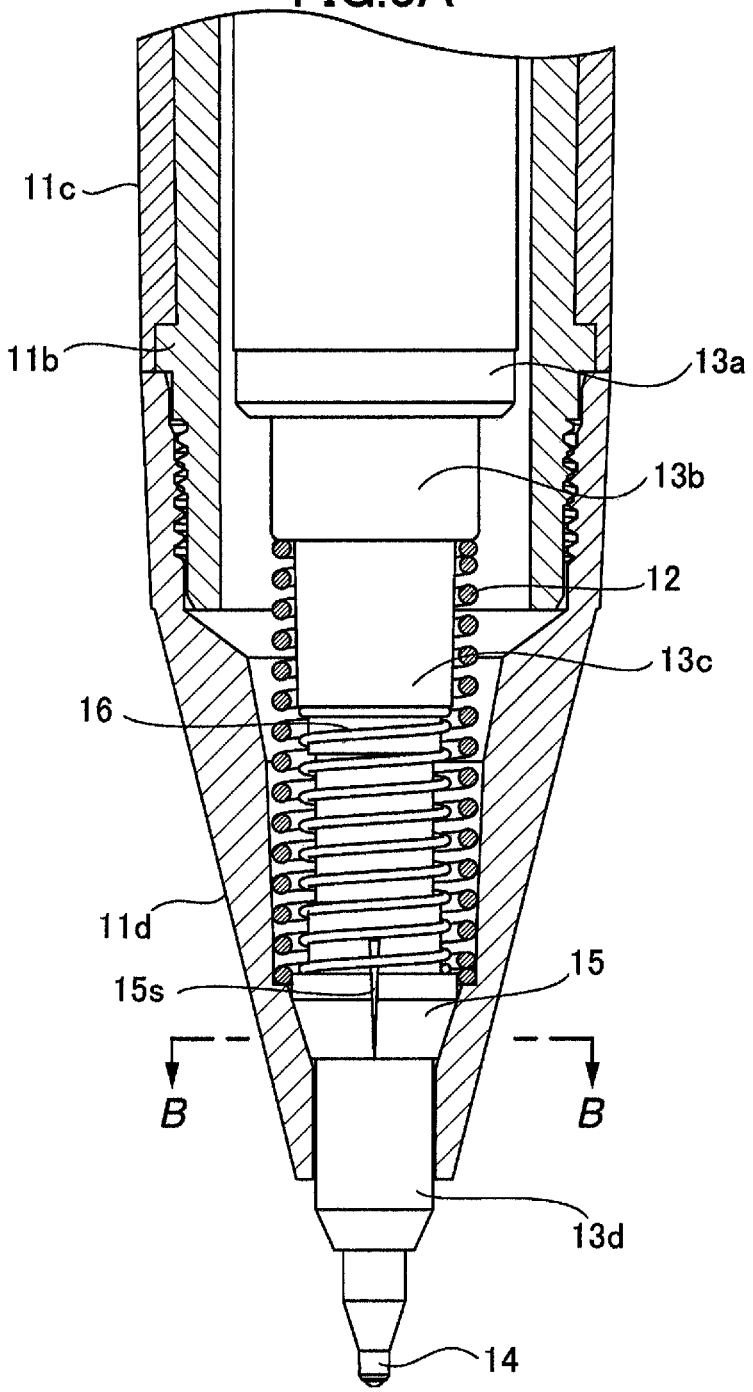
FIG. 3A is an enlarged longitudinal section view of the leading edge portion of the projectable and retractable writing tool shown in FIG. 1, under a state wherein the tip (writing element) is projected.
Figure 3B:
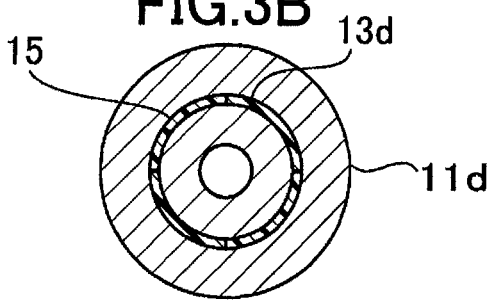
FIG. 3B is a section view taken along line B-B of FIG. 2A.

FIG. 1 is a schematic longitudinal section view showing a projectable and retractable writing tool 10 according to a first embodiment of the first invention under a state wherein a tip 14 (writing element) is not projected. FIG. 2A is an enlarged longitudinal section view of a leading edge portion of the projectable and retractable writing tool 10 according to the present embodiment, and FIG. 2B is a section view taken along line A-A of FIG. 2A. FIG. 3A is an enlarged longitudinal section view of the leading edge portion of the projectable and retractable writing tool 10 according to the present embodiment, under a state wherein the tip 14 (writing element) is projected, and FIG. 3B is a section view taken along line B-B of FIG. 2A.

Figure 4A:
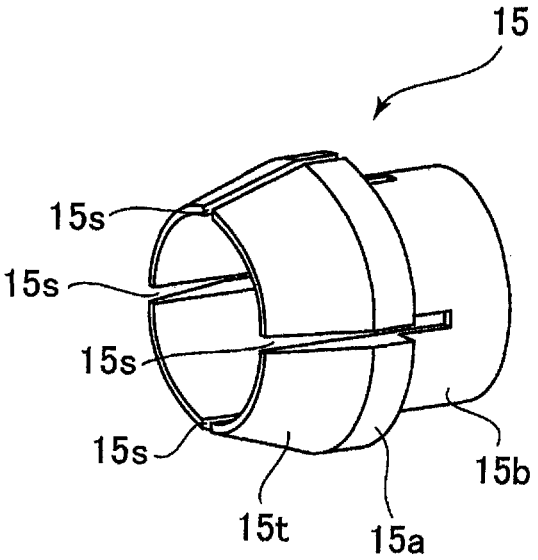
FIG. 4A is a perspective view of an annular member of the projectable and retractable writing tool shown in FIG. 1.
Figure 4B:
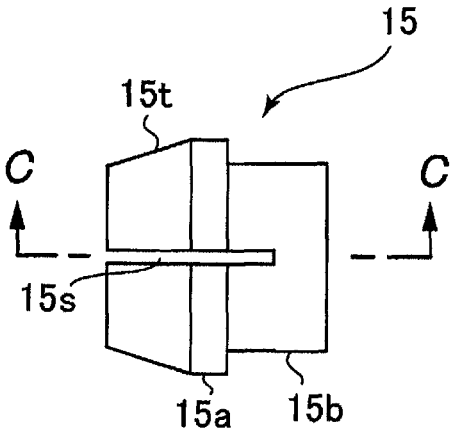
FIG. 4B is a side view of the annular member shown in FIG. 4A.
Figure 4C:
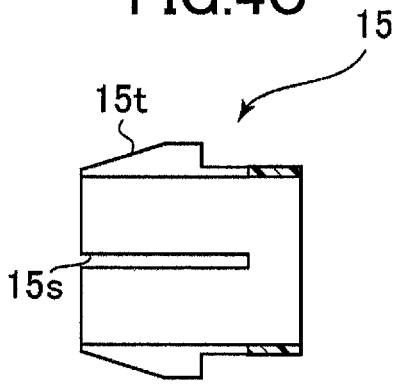
FIG. 4C is a section view taken along line C-C of FIG. 4B.
Figure 4D:
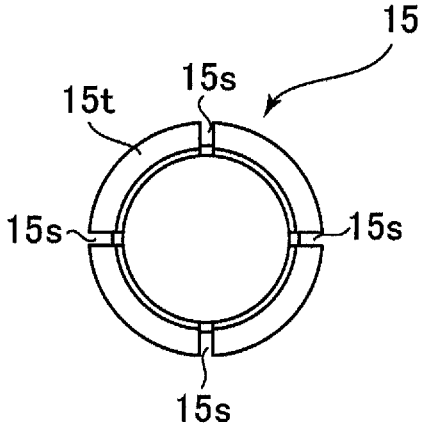
FIG. 4D is a front view (a view seen from the leading edge side) of the annular member shown in FIG. 4A.
Figure 4E:
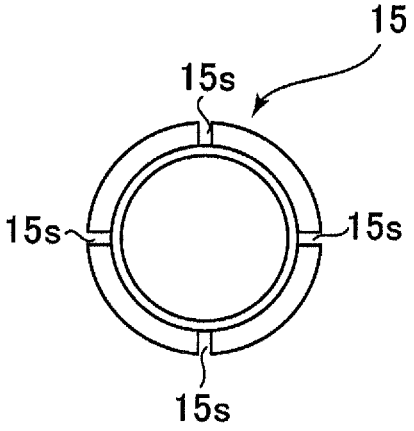
FIG. 4E is a rear view of the annular member shown in FIG. 4A.

In addition, FIG. 4A is a perspective view of an annular member 15 of the projectable and retractable writing tool 10 according to the present embodiment, FIG. 4B is a side view of the annular member 15, FIG. 4C is a section view taken along line C-C of FIG. 4B, FIG. 4D is a front view (a view seen from the leading edge side) of the annular member 15, and FIG. 4E is a rear view of the annular member 15.

Figure 5:
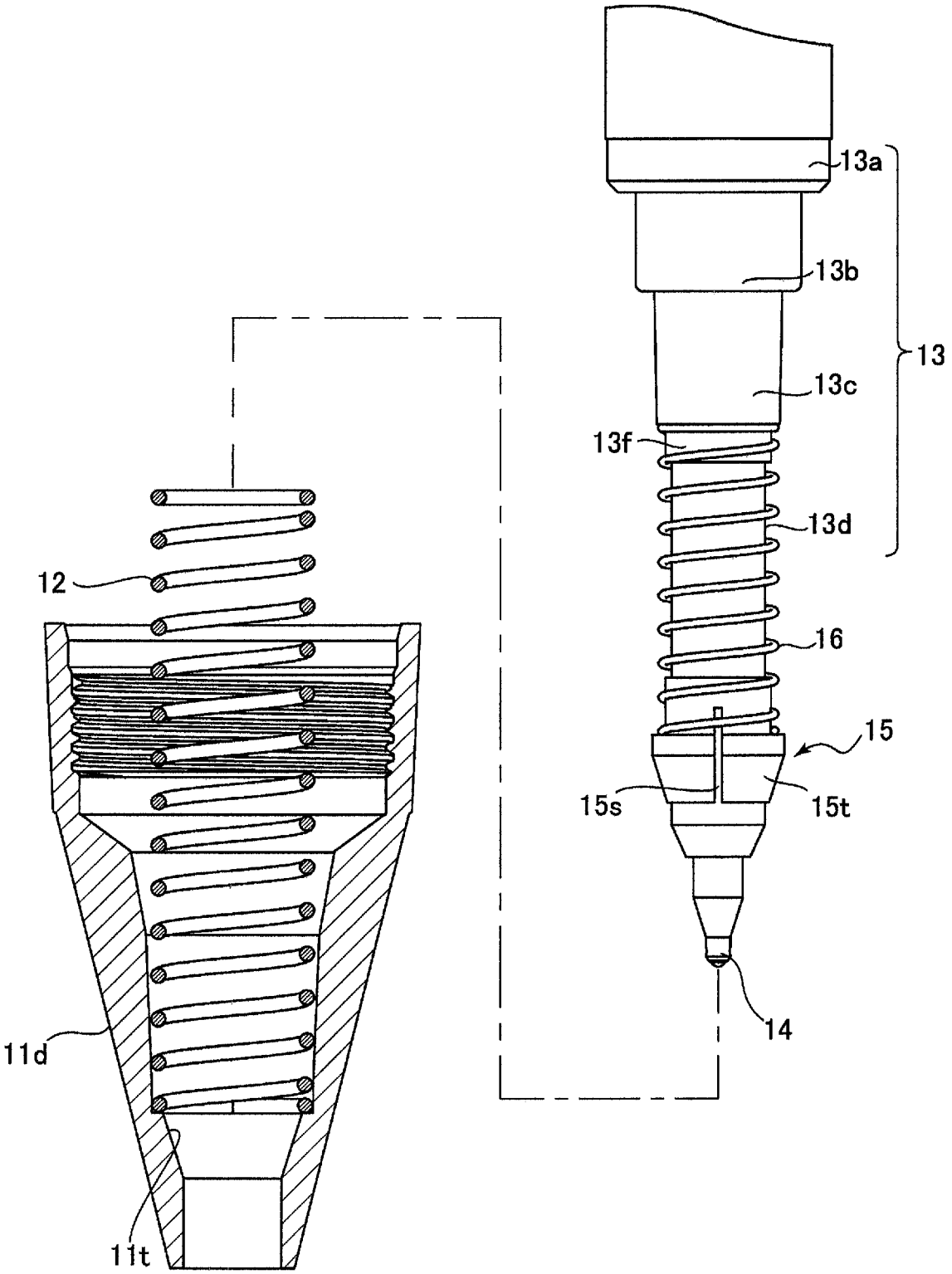

In addition, FIG. 5 is a schematic view showing the projectable and retractable writing tool 10 according to the present invention, under a state wherein the tip holder 13 has been removed for replacement or the like.

The projectable and retractable writing tool 10 according to the first embodiment shown in FIGS. 1 to 5 includes a shaft cylinder 11, which has an opening at a front end thereof and has a cylindrical shape. As shown in FIGS. 1 to 3, according to the present embodiment, the shaft cylinder 11 has a rear portion 11*a*, an inner cylindrical portion 11*b*, a front portion 11*c* and a mouthpiece portion 11*d*. The rear portion 11*a* and the inner cylindrical portion 11*b* are threadedly removably fixed to each other. The inner cylindrical portion 11*b* and the front portion 11*c* are integrally formed by two-color molding. Of course, the rear portion 11*a* and the inner cylindrical portion 11*b* may be fixed to each other by fitting connection or may be formed integrally. The inner cylindrical portion 11*b* and the front portion 11*c* may also be fixed by fitting connection. On the other hand, the mouthpiece portion 11*d* is threadedly detachably fixed to the inner cylindrical portion 11*b*. The material of the mouthpiece portion 11*d* is not limited to metal, but may be resin.

A tip holder 13, which is movable in an axial direction of the shaft cylinder 11, is contained in an inside of the shaft cylinder 11. A tip 14 as a writing element is fixed to a front end of the tip holder 13. The tip 14 is projectable and retractable through the opening of the shaft cylinder 11 in conjunction with a movement of the tip holder 13, as shown in FIGS. 2 and 3.

As shown in FIG. 5, the tip holder 13 includes: a proximal portion 13*a*, a first collar portion 13*b*, a second collar portion 13*c*, a spring fixation assisting portion 13*f* and a distal portion 13*d*, in this order from a proximal side thereof toward a distal side thereof. In the present embodiment, each of the proximal portion 13*a*, the first collar portion 13*b*, the second collar portion 13*c*, the spring fixation assisting portion 13*f* and the distal portion 13*d* has a cylindrical shape. The relationship between their cross-sectional diameters is as follows: the proximal portion 13*a*>the first collar portion 13*b*>the second collar portion 13*c*>the spring fixation assisting portion 13*f*>the distal portion 13*d*.

In the present embodiment, in particular as shown in FIG. 2B, an annular member 15 made of resin (for example, polyacetal) or metal (for example, brass) is loosely fitted on an outer periphery of the distal portion 13*d* of the tip holder 13. The annular member 15 is fixed to a second collar portion 13*c* of the tip holder 13 via a coil spring 16 (an example of an elastic member), which surrounds the outer periphery of the distal portion 13*d* of the tip holder 13 in a loosely fitted state (with a slight gap). In this manner, as shown in FIGS. 2A and 3A, the annular member 15 is movable in an axial direction of the tip holder 13 with respect to the distal portion 13*d* of the tip holder 13, in conjunction with expansion and contraction of the coil spring 16.

The tip holder 13 of the present embodiment is provided with the spring fixation assisting portion 13*f* in order to assist in fixing the coil spring 16 to the second collar portion 13*c*.

In addition, in particular as shown in FIGS. 4A to 4E, a frustoconical contact surface 15*t* is formed on a front region of an outer periphery of the annular member 15, as a contact surface having a tapered shape toward the front end side. A large outer diameter cylindrical portion 15*a* is provided continuously on a rear side of the contact surface 15*t*. A small outer diameter cylindrical portion 15*b* is provided on a further rear side thereof via a step (diameter difference).

The annular member 15 of the present embodiment is provided with four slits (cutout elements) 15*s* as a cutout. As shown in FIGS. 4A to 4E, the four slits 15*s* are arranged at regular intervals (by every 90 degrees) in a circumferential direction of the annular member 15. Each of the four slits 15*s* extends from a front end of the annular member 15 to a substantially center of the small outer diameter cylindrical portion 15*b* in an axial direction of the annular member 15. Thus, when a load is received by the contact surface 15*t*, an inner diameter of the annular member 15 is configured to be reduced flexibly, and when the load is released, the inner diameter of the annular member 15 is configured to be elastically returned to an original dimension thereof.

In addition, as shown in FIGS. 2A and 3A, a concave frustoconical guide surface 11*t* is formed on a part of an inside surface of the mouthpiece portion 11*d* of the shaft cylinder 11, as a guide surface having a tapered shape toward the front end side. Thus, in conjunction with a movement of the tip holder 13 toward a front end side thereof (FIG. 2A→FIG. 3A), the contact surface 15*t* is configured to receive the load from the guide surface 11*t*.

Furthermore, the projectable and retractable writing tool 10 according to the present embodiment is provided with a second coil spring 12 (second elastic member) in order to automatically retract the tip holder 13 when a retracting operation for the tip 14 (for example, a pushing operation of a push button provided on a rear end portion of the writing tool in order to release a locking mechanism that can maintain a projected state of the tip 14) is carried out. The second coil spring 12 is fitted into between a shoulder portion provided on the inside surface of the mouthpiece portion 11*d* and the first collar 13*b* of the tip holder 13 such that the second coil spring 12 surrounds an outer periphery of the coil spring 16.

The second coil spring 12 may be fixed to the inside surface of the mouthpiece portion 11*d* or may be free (in a state wherein neither member is fixed thereto). Alternatively, the second coil spring 12 may be fixed to the first collar 13*b* of the tip holder 13.

The projectable and retractable writing tool 10 as described above operates as follows.

When not in use, the tip 14 (writing element) of the projectable and retractable writing tool 10 is retracted as shown in FIG. 2A. A length of the coil spring 16 in an axial direction thereof is 8.2 mm and a length of the second coil spring 12 in an axial direction thereof is 16.4 mm. When a projecting operation for the tip 14 (for example, a pushing operation of a push button provided on the rear end portion of the writing tool) is carried out, the tip 14 (writing element) of the projectable and retractable writing tool 10 is projected as shown in FIG. 3A, Usually, a position of the tip holder 13 is locked in this projected state. The projected state of the tip 14 is maintained until a retracting operation for the tip 14 is carried out thereafter. The length of the coil spring 16 in the axial direction thereof is 5.6 mm (shortened by 2.6 mm) and the length of the second coil spring 12 in the axial direction thereof is 9.4 mm (shortened by 7.0 mm).

During a transition from the retracted state shown in FIG. 2A to the projected state shown in FIG. 3A, in conjunction with the movement of the tip holder 13 toward the front end side, the contact surface 15*t* of the annular member 15 receives a load from the guide surface 11*t* of the mouthpiece portion 11*d*. At this time, the inner diameter of the annular member 15 is reduced due to existence of the four slits 15*s* of the annular member 15 (FIG. 2B→FIG. 3B). As a result, as shown in FIG. 3B, the mouthpiece portion 11*d* and the annular member 15 cooperate with each other such that the distal portion 13*d* of the tip holder 13 can be grasped in a rattling-free (play-free) manner.

In addition, since the tip holder 13 and the annular member 15 are connected via the coil spring 16 such that the tip holder 13 and the annular member 15 are movable relatively to each other, it can be assured that the distal portion 13*d* of the tip holder 13 can be effectively grasped in a rattling-free (play-free) manner even if no high-precision dimension management is applied to a degree of reduction of the inner diameter of the annular member 15 or the like.

Thereafter, when a retracting operation for the tip 14 (for example, a subsequent pushing operation of the push button provided on the rear end portion of the writing tool) is carried out, a locking mechanism not shown is released, so that the tip 14 (writing element) of the projectable and retractable writing tool 10 is returned to a retracted state shown in FIG. 2A by means of an action of the second coil spring 12.

During a transition from the projected state shown in FIG. 3A to the retracted state shown in FIG. 2A, in conjunction with a movement of the tip holder 13 toward a rear end side, the load received by the contact surface 15*t* of the annular member 15 from the guide surface 11*t* of the mouthpiece portion 11*d* disappears. Thereby, the inner diameter of the annular member 15 that has been reduced is returned to an original dimension thereof (FIG. 3B→FIG. 2B).

As described above, according to the projectable and retractable writing tool 10 of the present embodiment, when the contact surface 15*t* of the annular member 15 receives the load from the guide surface 11*t* of the mouthpiece portion 11*d* in conjunction with the movement of the tip holder 13 toward the front end side, the inner diameter of the annular member 15 is reduced due to the existence of the slits 15*s* of the annular member 15. In this manner, the base portion 11*d* and the annular member 15 cooperate with each other such that the distal portion 13*d* of the tip holder 13 can be grasped in a rattling-free (play-free) manner. In addition, since the tip holder 13 and the annular member 15 are connected via the elastic member 16 such that the tip holder 13 and the annular member 15 are movable relatively to each other, it can be assured that the distal portion 13*d* of the tip holder 13 can be effectively grasped in a rattling-free (play-free) manner even if no high-precision dimension management is applied to a degree of reduction of the inner diameter of the annular member 15 or the like.

In addition, according to the projectable and retractable writing tool 10 of the present embodiment, since the four slits 15*s* as a cutout are arranged at regular intervals in a circumferential direction of the annular member 15 and each slit 15*s* extends in the axial direction of the annular member 15, the inner diameter of the annular member 15 can be reduced in a circumferentially well-balanced manner.

In addition, the contact surface 15*t* and the guide surface 11*t* have the frustoconical shape and the concave frustoconical shape which correspond to each other. Thus, the contact surface 15*t* of the annular member 15 can receive the load in a circumferentially well-balanced manner, so that the inner diameter of the annular member 15 can be reduced in a circumferentially well-balanced manner. Like this, it is preferable that the contact surface 15*t* and the guide surface 11*t* have tapered shapes toward the front end side. A tapered contact surface 15*t* may be formed by providing a rounded portion at an outer periphery of the front end of the cylindrical annular member 15. In addition, a tapered contact surface 15*t* may have a convex curved surface which is rotationally symmetric about an axis, and a tapered guide surface 11*t* may have a concave curved surface or a concave frustoconical surface which is also rotationally symmetric about the axis but has a curvature gentler than that of the convex curved surface.

In addition, in the projectable and retractable writing tool 10 of the present embodiment, the annular member 15 is movable in the axial direction in a region of the distal portion 13*d* of the tip holder 13, and the annular member 15 is configured to grasp the region of the distal portion 13*d* of the tip holder 13 when the inner diameter of the annular member 15 is reduced. However, the present invention is not limited thereto. For example, the annular member 15 may be movable in the axial direction in a region of the tip 14, and the annular member 15 may be configured to grasp the region of the tip 14 when the inner diameter of the annular member 15 is reduced.

In addition, it is possible to adjust elasticity (easiness of reduction of the inner diameter) of the annular member 15 by suitably changing the number of the slits 15*s*, the sizes of the slits 15*s* and/or the shapes of the slits 15*s*. In addition, it is also possible to adjust elasticity (easiness of reduction of the inner diameter) of the annular member 15 by changing a material and/or a thickness of the annular member 15.

Second Embodiment of First Invention

Figure 6:
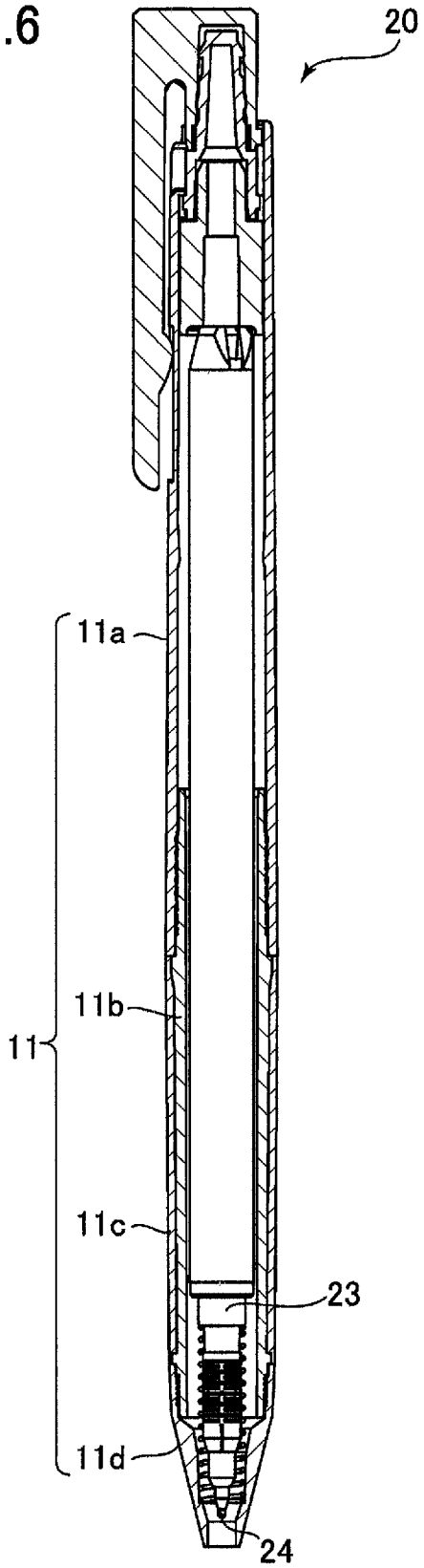
FIG. 6 is a schematic longitudinal section view showing a projectable and retractable writing tool according to a second embodiment of the first invention, under a state wherein a tip (writing element) is not projected.
Figure 7:
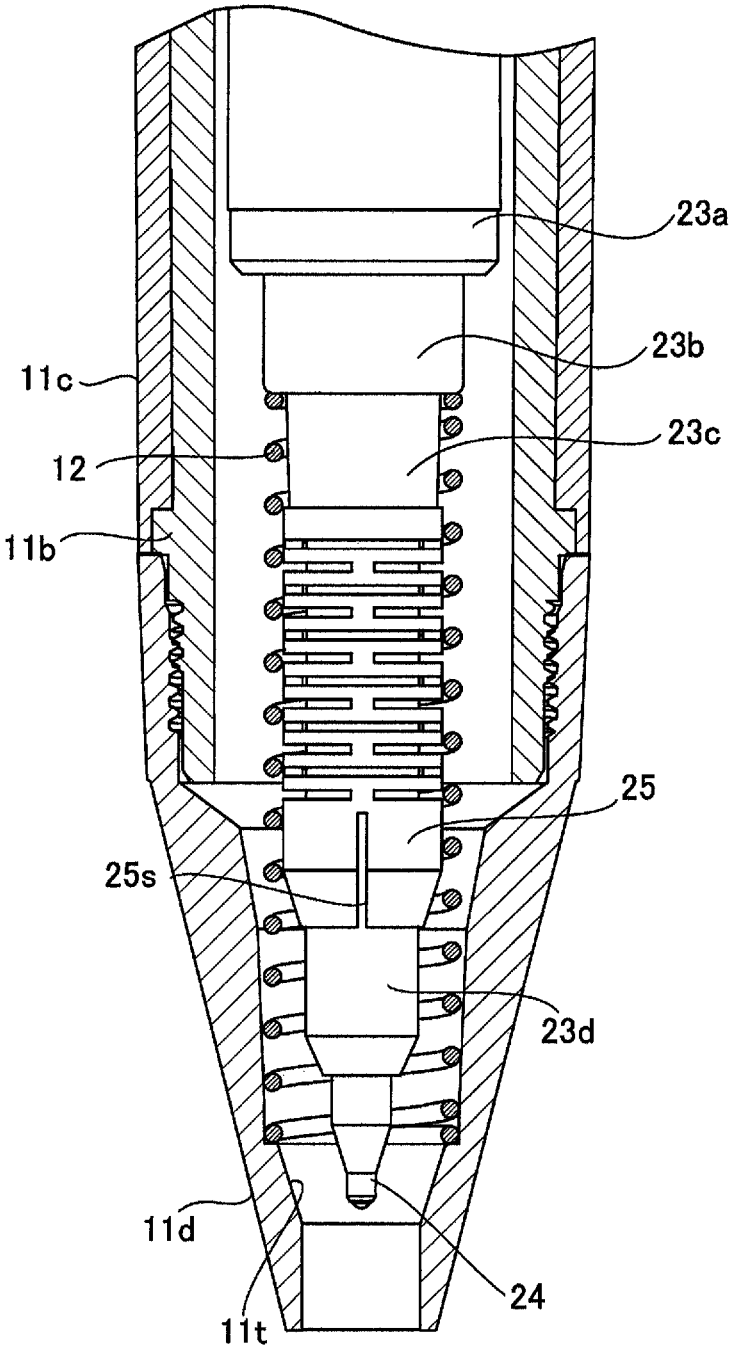
FIG. 7 is an enlarged longitudinal section view of a leading edge portion of the projectable and retractable writing tool shown in FIG. 6.
Figure 8:
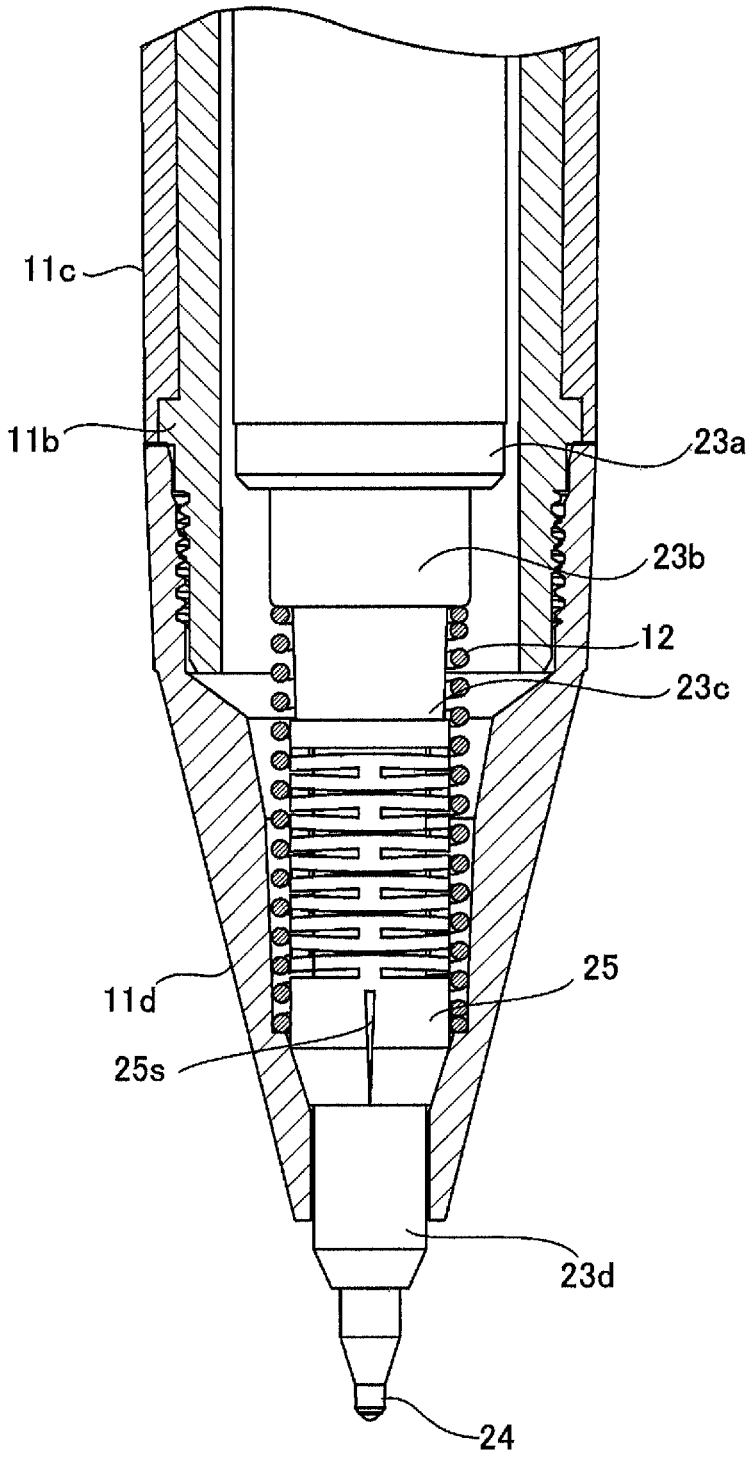
FIG. 8 is an enlarged longitudinal section view of the leading edge portion of the projectable and retractable writing tool shown in FIG. 6, under a state wherein the tip (writing element) is projected.

FIG. 6 is a schematic longitudinal section view showing a projectable and retractable writing tool 20 according to a second embodiment of the first invention under a state wherein a tip 24 (writing element) is not projected. FIG. 7 is an enlarged longitudinal section view of a leading edge portion of the projectable and retractable writing tool 20 according to the present embodiment. FIG. 8 is an enlarged longitudinal section view of the leading edge portion of the projectable and retractable writing tool 20 according to the present embodiment, under a state wherein the tip 24 (writing element) is projected.

Figure 9A:
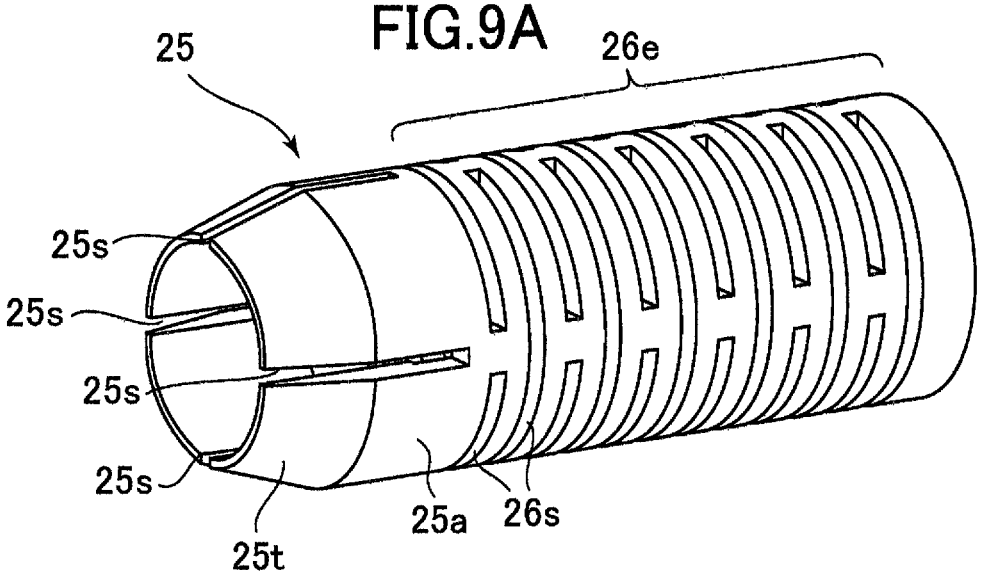
FIG. 9A is a perspective view of an annular member of the projectable and retractable writing tool shown in FIG. 6.
Figure 9B:
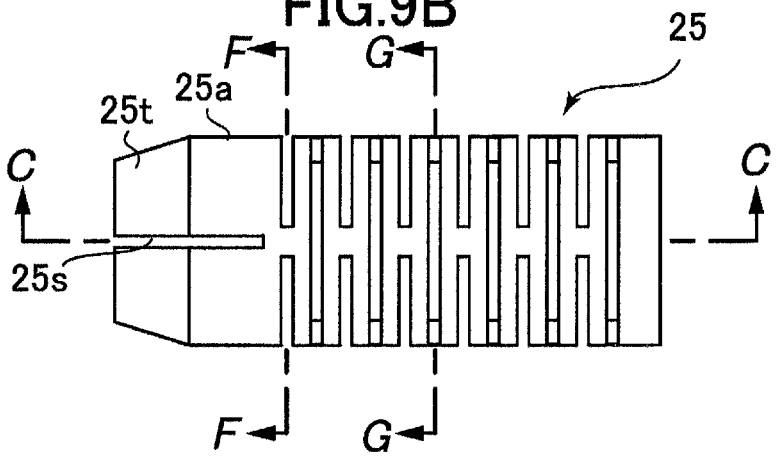
FIG. 9B is a side view of the annular member shown in FIG. 9A.
Figure 9C:
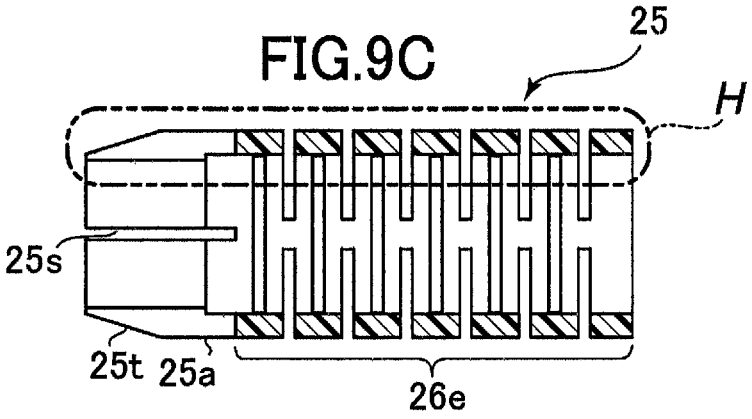
FIG. 9C is a section view taken along line C-C of FIG. 9B.
Figure 9D:
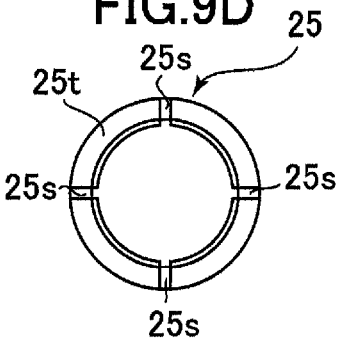
FIG. 9D is a front view (a view seen from the leading edge side) of the annular member shown in FIG. 9A.
Figure 9E:
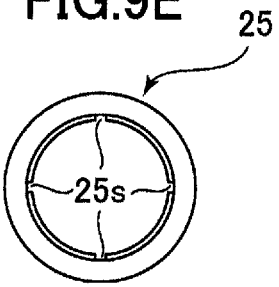
FIG. 9E is a rear view of the annular member shown in FIG. 9A.
Figure 9F:
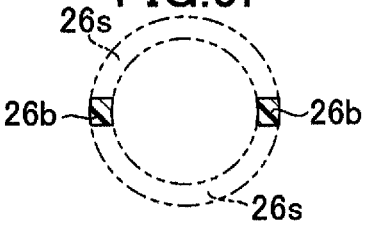
FIG. 9F is a section view taken along line F-F of FIG. 9B.
Figure 9G:
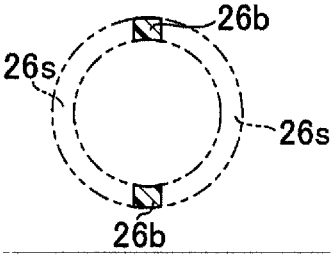
FIG. 9G is a section view taken along line G-G of FIG. 96.
Figure 9H:
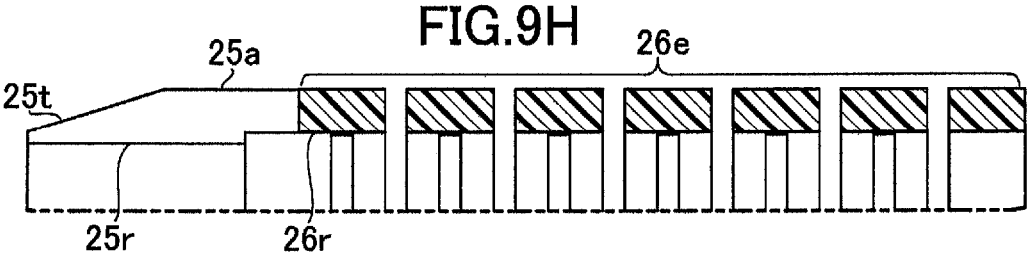
FIG. 9H is an enlarged view of an H portion of FIG. 9C.

In addition, FIG. 9A is a perspective view of an annular member 25 of the projectable and retractable writing tool 20 according to the present embodiment, FIG. 9B is a side view of the annular member 25, FIG. 9C is a section view taken along line C-C of FIG. 9B, FIG. 9D is a front view (a view seen from the leading edge side) of the annular member 25, and FIG. 9E is a rear view of the annular member 25. In addition, FIG. 9F is a section view taken along line F-F of FIG. 9B, FIG. 9G is a section view taken along line G-G of FIG. 9B, and FIG. 9H is an enlarged view of an H portion of FIG. 9C.

Figure 10:
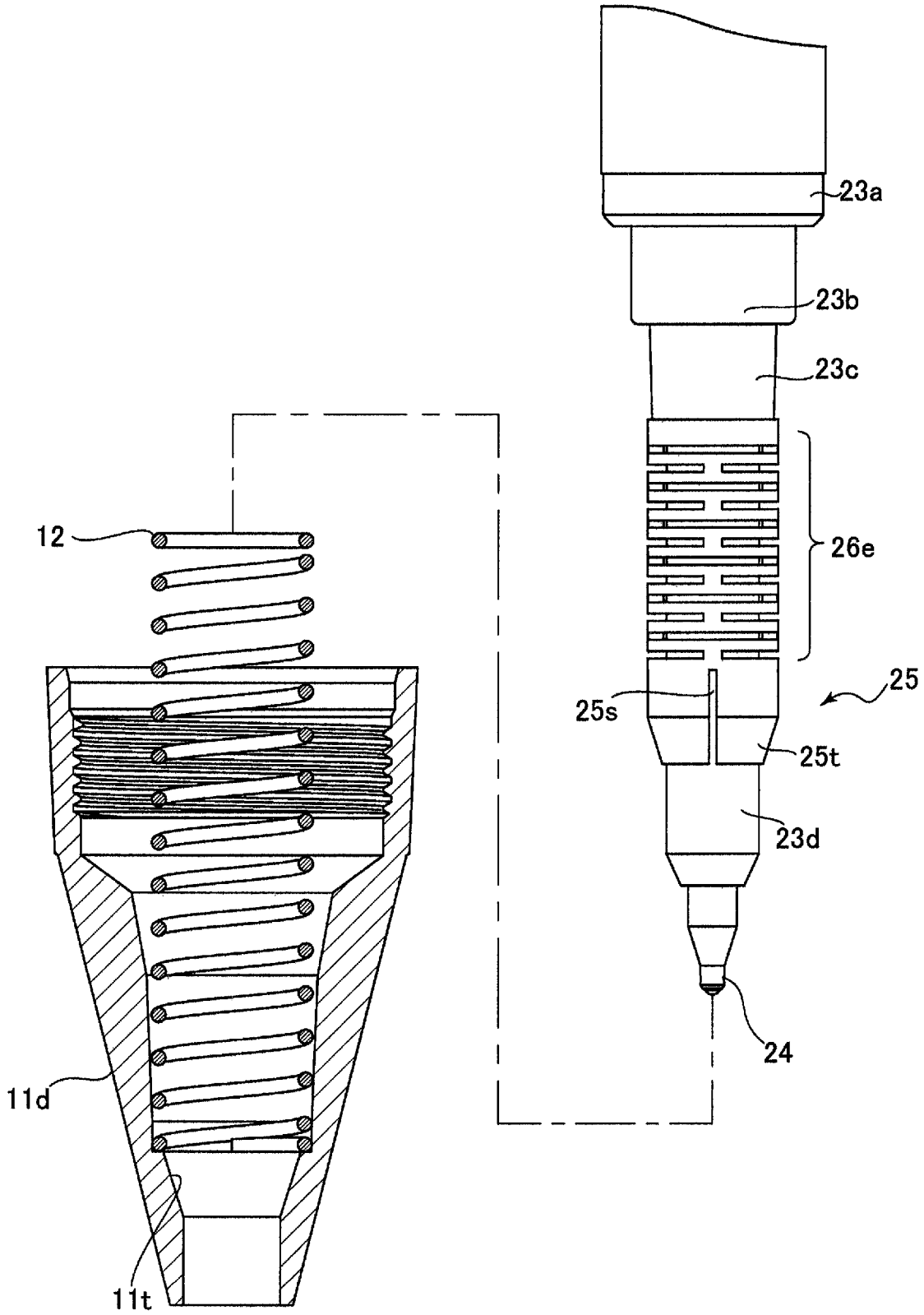

In addition, FIG. 10 is a schematic view showing the projectable and retractable writing tool 20 according to the present invention, under a state wherein the tip holder 23 has been removed for replacement or the like.

As well as the first embodiment, the projectable and retractable writing tool 20 according to the second embodiment shown in FIGS. 6 to 10 includes a shaft cylinder 11, which has an opening at a front end thereof and has a cylindrical shape. As shown in FIGS. 6 to 8, according to the present embodiment as well, the shaft cylinder 11 has a rear portion 11*a*, an inner cylindrical portion 11*b*, a front portion 11*c* and a mouthpiece portion 11*d*. The rear portion 11*a* and the inner cylindrical portion 11*b* are threadedly removably fixed to each other. The inner cylindrical portion 11*b* and the front portion 11*c* are integrally formed by two-color molding. Of course, the rear portion 11*a* and the inner cylindrical portion 11*b* may be fixed to each other by fitting connection or may be formed integrally. The inner cylindrical portion 11*b* and the front portion 11*c* may also be fixed by fitting connection. On the other hand, the mouthpiece portion 11*d* is threadedly detachably fixed to the inner cylindrical portion 11*b*. The material of the mouthpiece portion 11*d* is not limited to metal, but may be resin.

A tip holder 23, which is movable in an axial direction of the shaft cylinder 11, is contained in an inside of the shaft cylinder 11. A tip 24 as a writing element is fixed to a front end of the tip holder 23. The tip 24 is projectable and retractable through the opening of the shaft cylinder 11 in conjunction with a movement of the tip holder 23, as shown in FIGS. 7 and 8.

As shown in FIG. 10, the tip holder 23 includes: a proximal portion 23*a*, a first collar portion 23*b*, a second collar portion 23*c* and a distal portion 23*d*, in this order from a proximal side thereof toward a distal side thereof. In the present embodiment, each of the proximal portion 23*a*, the first collar portion 23*b*, the second collar portion 23*c* and the distal portion 23*d* has a cylindrical shape. The relationship between their cross-sectional diameters is as follows: the proximal portion 23*a*>the first collar portion 23*b*>the second collar portion 23*c*>the distal portion 23*d*.

In the present embodiment, in particular as shown in FIG. 7, an annular member 25 made of resin (for example, polyacetal) is loosely fitted on an outer periphery of the distal portion 23*d* of the tip holder 23. The annular member 25 of the present embodiment is integrally molded with a tubular resin spring part 26*e* on a proximal end side thereof. A large number of slits 26*s*, each of which extends in a direction perpendicular to an axial direction, are formed in the resin spring part 26*e*, so that the resin spring part 26*e* can extend and contract in the axial direction.

As shown in FIGS. 9A to 9H, in the resin spring part 26*e* of the present embodiment, six pairs of substantially semicircular slits 26*s* facing up and down (see FIG. 9F) and six pairs of substantially semicircular slits 26*s* facing left and right (see FIG. 9G) are formed alternately in the axial direction. The remaining portion between the pairs of slits 26*s* is called a rib 26*b*. In the present embodiment, the width (the length in the axial direction) of each slit 26*s* is uniform, the axial gap between the slits 26*s* adjacent in the axial direction is also uniform, and the former is slightly smaller than the latter. Of course, these dimensional relationship may be suitably adjusted to achieve a desired degree of elasticity, as described below.

A further proximal end side of the resin spring part 26*e* is fixed to a second collar portion 23*c* of the tip holder 23. In this manner, as shown in FIGS. 7 and 8, the annular member 25 is movable in an axial direction of the tip holder 23 with respect to the distal portion 23*d* of the tip holder 23, in conjunction with expansion and contraction of the resin spring part 26*e*.

In addition, in particular as shown in FIGS. 9A to 9E, a frustoconical contact surface 25*t* is formed on a front region of an outer periphery of the annular member 25, as a contact surface having a tapered shape toward the front end side. A cylindrical portion 25*a* is provided continuously on a rear side of the contact surface 25*t*. The tubular resin spring part 26*e*, whose diameter is the same as that of the cylindrical portion 25*a*, is provided on a further rear side thereof. In addition, in particular as shown in FIG. 9H, an inner diameter 26*r* of the resin spring part 26*e* is larger than an inner diameter 25*r* of a portion corresponding to the contact surface 25*t*.

The annular member 25 of the present embodiment is provided with four slits (cutout elements) 25*s* as a cutout. As shown in FIGS. 9A to 9E, the four slits 25*s* are arranged at regular intervals (by every 90 degrees) in a circumferential direction of the annular member 25. Each of the four slits 25*s* extends from a front end of the annular member 25 to a vicinity of a rear end of the cylindrical portion 25*a* in an axial direction of the annular member 25. Thus, when a load is received by the contact surface 25*t*, an inner diameter of the annular member 25 is configured to be reduced flexibly, and when the load is released, the inner diameter of the annular member 25 is configured to be elastically returned to an original dimension thereof.

In addition, as shown in FIGS. 7 and 8, a concave frustoconical guide surface 11*t* is formed on a part of an inside surface of the mouthpiece portion 11*d* of the shaft cylinder 11, as a guide surface having a tapered shape toward the front end side. Thus, in conjunction with a movement of the tip holder 23 toward a front end side thereof (FIG. 7→FIG. 8), the contact surface 25*t* is configured to receive the load from the guide surface 11*t*.

Furthermore, the projectable and retractable writing tool 20 according to the present embodiment is also provided with a second coil spring 12 (second elastic member) in order to automatically retract the tip holder 23 when a retracting operation for the tip 24 (for example, a pushing operation of a push button provided on a rear end portion of the writing tool in order to release a locking mechanism that can maintain a projected state of the tip 24) is carried out. The second coil spring 12 is fitted into between a shoulder portion provided on the inside surface of the mouthpiece portion 11*d* and the first collar portion 23*b* of the tip holder 23 such that the second coil spring 12 surrounds an outer periphery of the annular member 25.

The second coil spring 12 may be fixed to the inside surface of the mouthpiece portion 11*d* or may be free (in a state wherein neither member is fixed thereto). Alternatively, the second coil spring 12 may be fixed to the first collar portion 23*b* of the tip holder 23.

The projectable and retractable writing tool 20 as described above operates as follows.

When not in use, the tip 24 (writing element) of the projectable and retractable writing tool 20 is retracted as shown in FIG. 7. A length of the annular member 25 including the resin spring part 26*e* in an axial direction thereof is 9.2 mm and a length of the second coil spring 12 in an axial direction thereof is 16.4 mm. When a projecting operation for the tip 24 (for example, a pushing operation of a push button provided on the rear end portion of the writing tool) is carried out, the tip 24 (writing element) of the projectable and retractable writing tool 20 is projected as shown in FIG. 8. Usually, a position of the tip holder 23 is locked in this projected state. The projected state of the tip 24 is maintained until a retracting operation for the tip 24 is carried out thereafter. The length of the annular member 25 including the resin spring part 26*e* in the axial direction thereof is 8.5 mm (shortened by 0.7 mm) and the length of the second coil spring 12 in the axial direction thereof is 9.4 mm (shortened by 7.0 mm).

During a transition from the retracted state shown in FIG. 7 to the projected state shown in FIG. 8, in conjunction with the movement of the tip holder 23 toward the front end side, the contact surface 25*t* of the annular member 25 receives a load from the guide surface 11*t* of the mouthpiece portion 11*d*. At this time, the inner diameter of the annular member 25 is reduced due to existence of the four slits 25*s* of the annular member 25 (see FIG. 3B). As a result, as shown in FIG. 8, the mouthpiece portion 11*d* and the annular member 25 cooperate with each other such that the distal portion 23*d* of the tip holder 23 can be grasped in a rattling-free (play-free) manner.

In addition, since the tip holder 23 and the contact surface 25*t* of the annular member 25 are movable relatively to each other by means of expansion and contraction of the resin spring part 26*e*, it can be assured that the distal portion 23*d* of the tip holder 23 can be effectively grasped in a rattling-free (play-free) manner even if no high-precision dimension management is applied to a degree of reduction of the inner diameter of the annular member 25 or the like.

Thereafter, when a retracting operation for the tip 24 (for example, a subsequent pushing operation of the push button provided on the rear end portion of the writing tool) is carried out, a locking mechanism not shown is released, so that the tip 24 (writing element) of the projectable and retractable writing tool 20 is returned to a retracted state shown in FIG. 7 by means of an action of the second coil spring 12.

During a transition from the projected state shown in FIG. 8 to the retracted state shown in FIG. 7, in conjunction with a movement of the tip holder 23 toward a rear end side, the load received by the contact surface 25*t* of the annular member 25 from the guide surface 11*t* of the mouthpiece portion 11*d* disappears. Thereby, the inner diameter of the annular member 25 that has been reduced is returned to an original dimension thereof (FIG. 8→FIG. 7).

As described above, according to the projectable and retractable writing tool 20 of the present embodiment, when the contact surface 25*t* of the annular member 25 receives the load from the guide surface 11*t* of the mouthpiece portion 11*d* in conjunction with the movement of the tip holder 23 toward the front end side, the inner diameter of the annular member 25 is reduced due to the existence of the slits 25*s* of the annular member 25. In this manner, the base portion 11*d* and the annular member 25 cooperate with each other such that the distal portion 23*d* of the tip holder 23 can be grasped in a rattling-free (play-free) manner. In addition, since the tip holder 23 and the contact surface 25*t* of the annular member 25 are connected via the resin spring part 26*e* such that the tip holder 23 and the contact surface 25*t* are movable relatively to each other, it can be assured that the distal portion 23*d* of the tip holder 23 can be effectively grasped in a rattling-free (play-free) manner even if no high-precision dimension management is applied to a degree of reduction of the inner diameter of the annular member 25 or the like.

In addition, since the inner diameter 26*r* of the resin spring part 26*e* is larger than the inner diameter 25*r* of the portion corresponding to the contact surface 25*t*, even if the resin spring part 26*e* swells toward an inner diameter side, the resin spring parte 26 does not come into contact with the tip holder 23.

In addition, according to the projectable and retractable writing tool 20 of the present embodiment, since the four slits 25*s* as a cutout are arranged at regular intervals in a circumferential direction of the annular member 25 and each slit 25*s* extends in the axial direction of the annular member 25, the inner diameter of the annular member 25 can be reduced in a circumferentially well-balanced manner.

In addition, the contact surface 25*t* and the guide surface 11*t* have the frustoconical shape and the concave frustoconical shape which correspond to each other. Thus, the contact surface 25*t* of the annular member 25 can receive the load in a circumferentially well-balanced manner, so that the inner diameter of the annular member 25 can be reduced in a circumferentially well-balanced manner. Like this, it is preferable that the contact surface 25*t* and the guide surface 11*t* have tapered shapes toward the front end side. A tapered contact surface 25*t* may be formed by providing a rounded portion at an outer periphery of the front end of the cylindrical annular member 25. In addition, a tapered contact surface 25*t* may have a convex curved surface which is rotationally symmetric about an axis, and a tapered guide surface 11*t* may have a concave curved surface or a concave frustoconical surface which is also rotationally symmetric about the axis but has a curvature gentler than that of the convex curved surface.

In addition, in the projectable and retractable writing tool 20 of the present embodiment, the annular member 25 is movable in the axial direction in a region of the distal portion 23*d* of the tip holder 23, and the annular member 25 is configured to grasp the region of the distal portion 23*d* of the tip holder 23 when the inner diameter of the annular member 25 is reduced. However, the present invention is not limited thereto. For example, the annular member 25 may be movable in the axial direction in a region of the tip 24, and the annular member 25 may be configured to grasp the region of the tip 24 when the inner diameter of the annular member 25 is reduced.

In addition, it is possible to adjust elasticity (easiness of reduction of the inner diameter) of the annular member 25 by suitably changing the number of the slits 25*s*, the sizes of the slits 25*s* and/or the shapes of the slits 25*s*. In addition, it is also possible to adjust elasticity (easiness of reduction of the inner diameter) of the annular member 25 by suitably changing a material and/or a thickness of the annular member 25.

In addition, it is possible to adjust elasticity (easiness of expansion and contraction) of the resin spring part 26*e* by suitably changing the number of the slits 26*s*, the sizes of the slits 26*s* and/or the shapes of the slits 26*s*. It is preferable that the slits 26*s* extend in the direction perpendicular to the axial direction. However, they may extend obliquely (for example, spirally) with respect to the axial direction.

In addition, it is also possible to adjust elasticity (easiness of expansion and contraction) of the resin spring part 26*e* by changing a thickness of the resin spring part 26*e*. Furthermore, the resin spring part 26*e* may be formed as a resin spring member separate from the contact surface 25*t* and the cylindrical portion 25*a*, and may be joined to the cylindrical portion 25*a*. In this case, it is also possible to adjust elasticity (easiness of expansion and contraction) of the resin spring member by changing a material of the resin spring member.

Furthermore, the resin spring part 26*e* (or a separate resin spring member) is not limited to the configuration having the slit 26*s*, but may be a configuration having a bellows structure that expands and contracts in the axial direction.

Third Embodiment of First Invention

Figure 11:
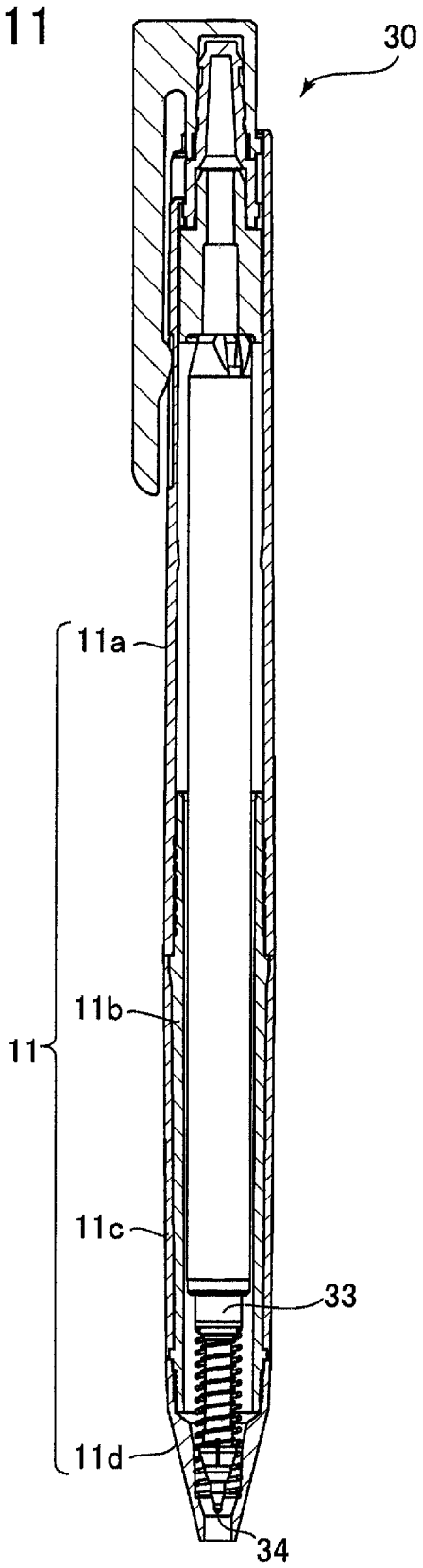
FIG. 11 is a schematic longitudinal section view showing a projectable and retractable writing tool according to a third embodiment of the first invention, under a state wherein a tip (writing element) is not projected.
Figure 12:
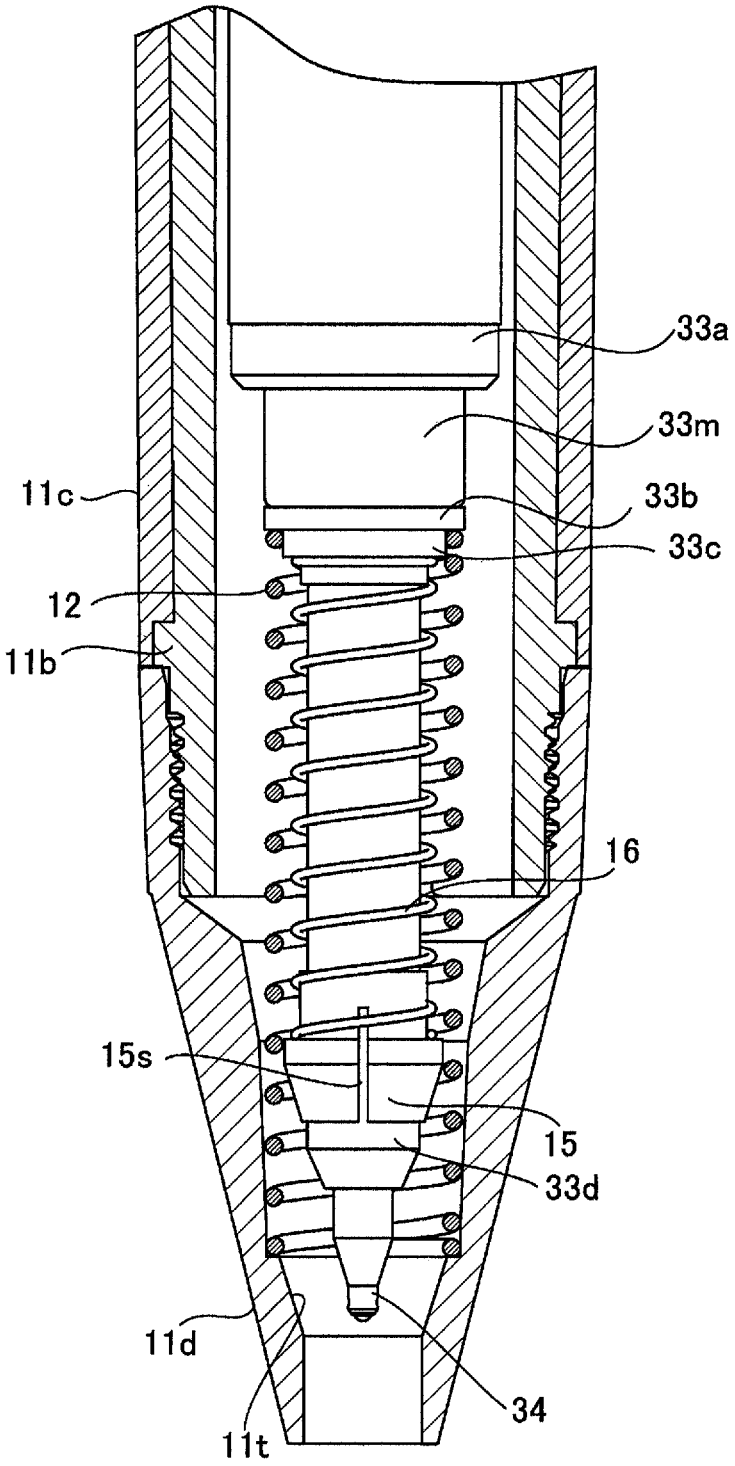
FIG. 12 is an enlarged longitudinal section view of a leading edge portion of the projectable and retractable writing tool shown in FIG. 11.
Figure 13:
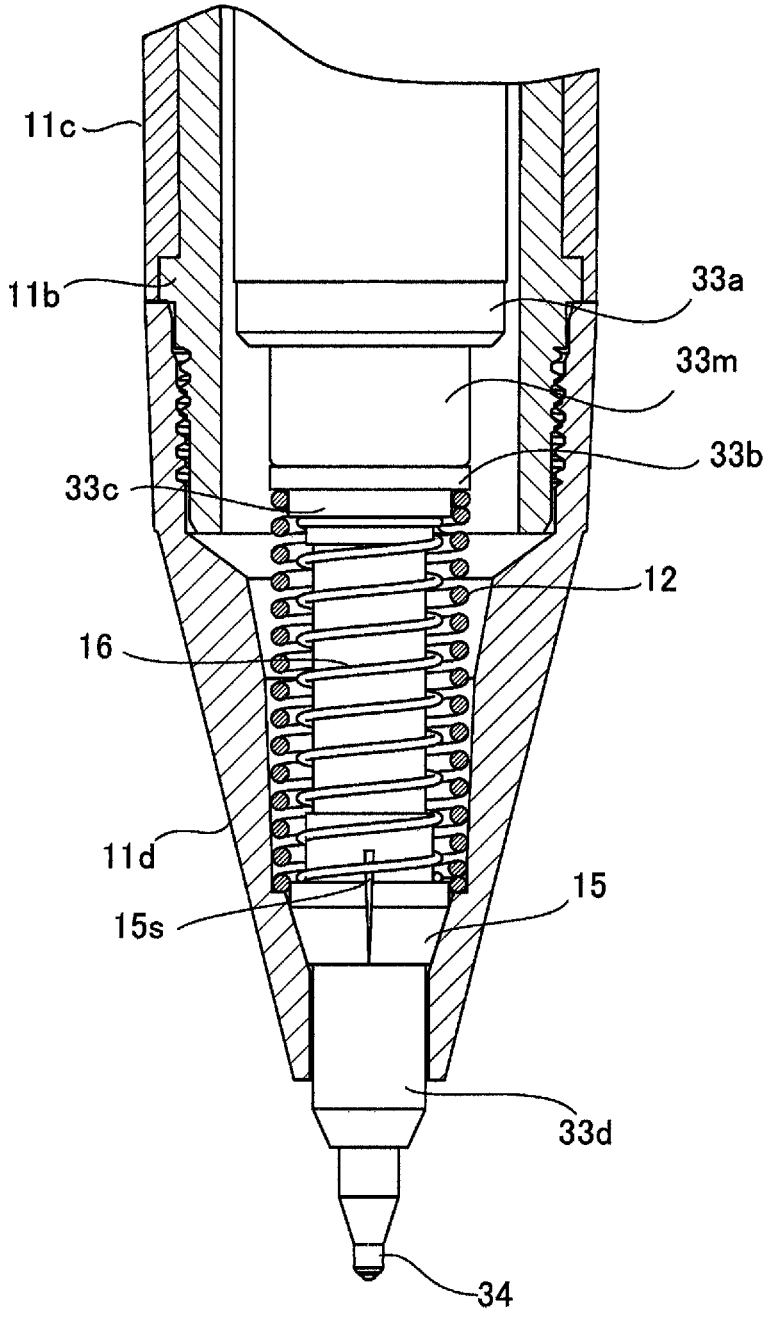
FIG. 13 is an enlarged longitudinal section view of the leading edge portion of the projectable and retractable writing tool shown in FIG. 11, under a state wherein the tip (writing element) is projected.

FIG. 11 is a schematic longitudinal section view showing a projectable and retractable writing tool 30 according to a third embodiment of the first invention under a state wherein a tip 34 (writing element) is not projected. FIG. 12 is an enlarged longitudinal section view of a leading edge portion of the projectable and retractable writing tool 30 according to the present embodiment. FIG. 13 is an enlarged longitudinal section view of the leading edge portion of the projectable and retractable writing tool 30 according to the present embodiment, under a state wherein the tip 34 (writing element) is projected.

Figure 14A:
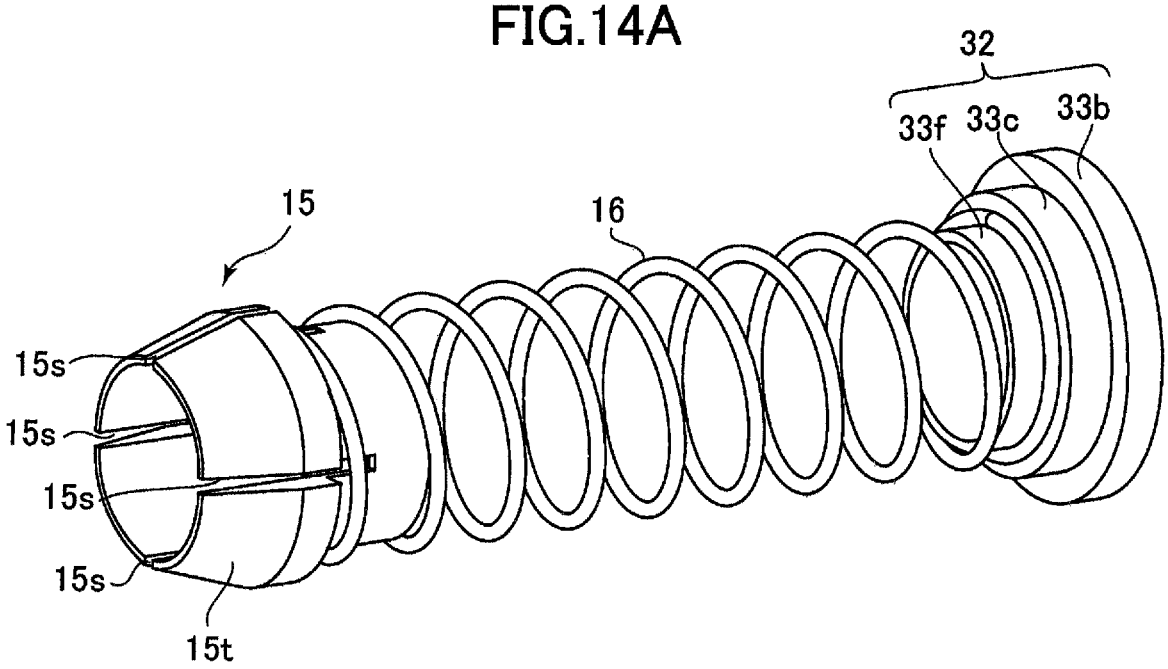
FIG. 14A is a perspective view of an annular member, a coil spring and a collar member of the projectable and retractable writing tool shown in FIG. 11.
Figure 14B:
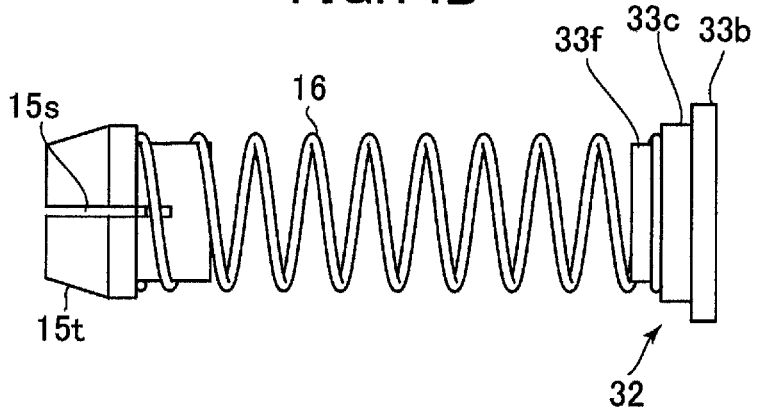
FIG. 14B is a side view of the annular member, the coil spring and the collar member shown in FIG. 14A.
Figure 14C:
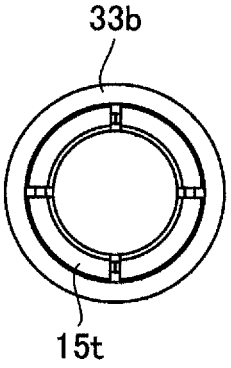
FIG. 14C is a front view (a view seen from the leading edge side) of the annular member, the coil spring and the collar member shown in FIG. 14A.
Figure 14D:
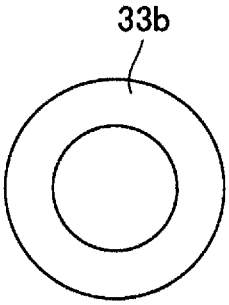
FIG. 14D is a rear view of the annular member, the coil spring and the collar member shown in FIG. 14A.

In addition, FIG. 14A is a perspective view of an annular member 15, a coil spring 16 and a collar member 32 of the projectable and retractable writing tool 30 according to the present embodiment, FIG. 14B is a side view of the annular member 15, the coil spring 16 and the collar member 32, FIG. 14C is a front view (a view seen from the leading edge side) of the annular member 15, the coil spring 16 and the collar member 32, and FIG. 14D is a rear view of the annular member 15, the coil spring 16 and the collar member 32.

Figure 15:
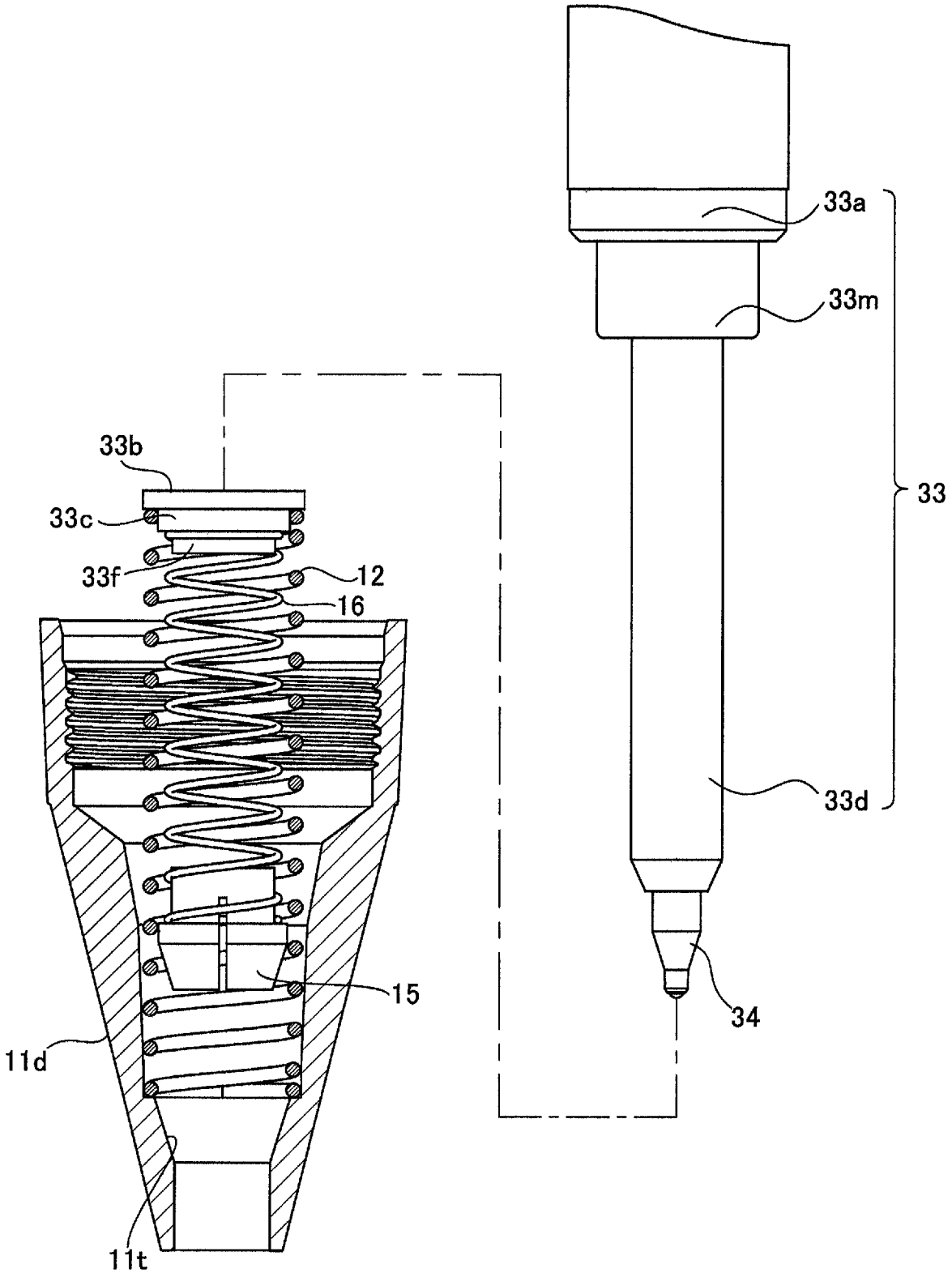

In addition, FIG. 15 is a schematic view showing the projectable and retractable writing tool 30 according to the present invention, under a state wherein the tip holder 33 has been removed for replacement or the like.

As well as the first and second embodiments, the projectable and retractable writing tool 30 according to the third embodiment shown in FIGS. 11 to 15 includes a shaft cylinder 11, which has an opening at a front end thereof and has a cylindrical shape. As shown in FIGS. 11 to 13, according to the present embodiment as well, the shaft cylinder 11 has a rear portion 11*a*, an inner cylindrical portion 11*b*, a front portion 11*c* and a mouthpiece portion 11*d*. The rear portion 11*a* and the inner cylindrical portion 11*b* are threadedly removably fixed to each other. The inner cylindrical portion 11*b* and the front portion 11*c* are integrally formed by two-color molding. Of course, the rear portion 11*a* and the inner cylindrical portion 11*b* may be fixed to each other by fitting connection or may be formed integrally. The inner cylindrical portion 11*b* and the front portion 11*c* may also be fixed by fitting connection. On the other hand, the mouthpiece portion 11*d* is threadedly detachably fixed to the inner cylindrical portion 11*b*. The material of the mouthpiece portion 11*d* is not limited to metal, but may be resin.

A tip holder 33, which is movable in an axial direction of the shaft cylinder 11, is contained in an inside of the shaft cylinder 11. A tip 34 as a writing element is fixed to a front end of the tip holder 33. The tip 34 is projectable and retractable through the opening of the shaft cylinder 11 in conjunction with a movement of the tip holder 33, as shown in FIGS. 12 and 13.

As shown in FIG. 15, the tip holder 33 includes: a proximal portion 33*a*, a middle collar portion 33*m* and a distal portion 33*d*, in this order from a proximal side thereof toward a distal side thereof. In the present embodiment, each of the proximal portion 33*a*, the middle collar portion 33*m* and the distal portion 33*d* has a cylindrical shape. The relationship between their cross-sectional diameters is as follows: the proximal portion 33*a*>the middle collar portion 33*m*>the distal portion 33*d*.

In the present embodiment, in particular as shown in FIG. 12, an annular member 15 made of resin (for example, polyacetal) or metal (for example, brass) is loosely fitted on an outer periphery of the distal portion 33*d* of the tip holder 33. The annular member 15 is fixed to a second collar portion 33*c* of the collar member 32 via the coil spring 16 (an example of an elastic member), which surrounds the outer periphery of the distal portion 33*d* of the tip holder 33 in a loosely fitted state (with a slight gap), as shown in FIGS. 14A and 14B. A first collar portion 33*b* of the collar member 32 is abutted and supported by the middle collar portion 33*m* of the tip holder 33 in the axial direction. In this manner, the annular member 15 is movable in an axial direction of the tip holder 33 with respect to the distal portion 33*d* of the tip holder 33, in conjunction with expansion and contraction of the coil spring 16.

The collar member 32 of the present embodiment is provided with a spring fixation assisting portion 33*f* in order to assist in fixing the coil spring 16 to the second collar portion 33*c*. That is to say, the collar member 32 has the first collar portion 33*b*, the second collar portion 33*c* and the spring fixation assisting portion 33*f*, in this order from a proximal side thereof toward a distal side thereof. In the present embodiment, each of the first collar portion 33*b*, the second collar portion 33*c* and the spring fixation assisting portion 33*f* has a cylindrical shape. The relationship between their cross-sectional diameters is as follows: the first collar portion 33*b*>the second collar portion 33*c*>the spring fixation assisting portion 33*f*.

The annular member 15 and the coil spring 16 of the present embodiment are respectively the same as the annular member 15 and the coil spring 16 of the first embodiment. Thus, the same reference numbers are used for the corresponding members.

That is to say, as shown in FIGS. 4A to 4E, a frustoconical contact surface 15*t* is formed on a front region of an outer periphery of the annular member 15, as a contact surface having a tapered shape toward the front end side. A large outer diameter cylindrical portion 15*a* is provided continuously on a rear side of the contact surface 15*t*. A small outer diameter cylindrical portion 15*b* is provided on a further rear side thereof via a step (diameter difference).

In addition, the annular member 15 is provided with four slits (cutout elements) 15*s* as a cutout. As shown in FIGS. 4A to 4E, the four slits 15*s* are arranged at regular intervals (by every 90 degrees) in a circumferential direction of the annular member 15. Each of the four slits 15*s* extends from a front end of the annular member 15 to a substantially center of the small outer diameter cylindrical portion 15*b* in an axial direction of the annular member 15. Thus, when a load is received by the contact surface 15*t*, an inner diameter of the annular member 15 is configured to be reduced flexibly, and when the load is released, the inner diameter of the annular member 15 is configured to be elastically returned to an original dimension thereof.

On the other hand, as shown in FIGS. 12 and 13, a concave frustoconical guide surface 11*t* is formed on a part of an inside surface of the mouthpiece portion 11*d* of the shaft cylinder 11, as a guide surface having a tapered shape toward the front end side. Thus, in conjunction with a movement of the tip holder 33 toward a front end side thereof (FIG. 12→FIG. 13), the contact surface 15*t* is configured to receive the load from the guide surface 11*t*.

Furthermore, the projectable and retractable writing tool 30 according to the present embodiment is provided with a second coil spring 12 (second elastic member) in order to automatically retract the tip holder 33 when a retracting operation for the tip 34 (for example, a pushing operation of a push button provided on a rear end portion of the writing tool in order to release a locking mechanism that can maintain a projected state of the tip 34) is carried out. The second coil spring 12 is fitted into between a shoulder portion provided on the inside surface of the mouthpiece portion 11*d* and the first collar portion 33*b* of the collar member 32 such that the second coil spring 12 surrounds an outer periphery of the coil spring 16.

As shown in FIG. 15, the second coil spring 12 of the present embodiment is fixed to the inside surface of the mouthpiece portion 11*d* on a front end side thereof, and to the first collar portion 33*b* of the collar member 32 on a rear end side thereof. In this manner, the annular member 15 and the coil spring 16 are supported by and fixed to the inside surface of the mouthpiece portion 11*d* via the collar member 32 and the second coil spring 12.

The projectable and retractable writing tool 30 as described above operates as follows.

When not in use, the tip 34 (writing element) of the projectable and retractable writing tool 30 is retracted as shown in FIG. 12. A length of the coil spring 16 in an axial direction thereof is 10.6 mm and a length of the second coil spring 12 in an axial direction thereof is 15.9 mm. When a projecting operation for the tip 34 (for example, a pushing operation of a push button provided on the rear end portion of the writing tool) is carried out, the tip 34 (writing element) of the projectable and retractable writing tool 30 is projected as shown in FIG. 13. Usually, a position of the tip holder 33 is locked in this projected state. The projected state of the tip 34 is maintained until a retracting operation for the tip 34 is carried out thereafter. The length of the coil spring 16 in the axial direction thereof is 8.0 mm (shortened by 2.6 mm) and the length of the second coil spring 12 in the axial direction thereof is 8.9 mm (shortened by 7.0 mm).

During a transition from the retracted state shown in FIG. 12 to the projected state shown in FIG. 13, in conjunction with the movement of the tip holder 33 toward the front end side, the contact surface 15*t* of the annular member 15 receives a load from the guide surface 11*t* of the mouthpiece portion 11*d*. At this time, the inner diameter of the annular member 15 is reduced due to existence of the four slits 15*s* of the annular member 15 (FIG. 12→FIG. 13). As a result, as shown in FIG. 13, the mouthpiece portion 11*d* and the annular member 15 cooperate with each other such that the distal portion 33*d* of the tip holder 33 can be grasped in a rattling-free (play-free) manner.

In addition, since the tip holder 33 and the annular member 15 are connected via the coil spring 16 such that the tip holder 13 and the annular member 15 are movable relatively to each other, it can be assured that the distal portion 33*d* of the tip holder 33 can be effectively grasped in a rattling-free (play-free) manner even if no high-precision dimension management is applied to a degree of reduction of the inner diameter of the annular member 15 or the like.

Thereafter, when a retracting operation for the tip 34 (for example, a subsequent pushing operation of the push button provided on the rear end portion of the writing tool) is carried out, a locking mechanism not shown is released, so that the tip 34 (writing element) of the projectable and retractable writing tool 30 is returned to a retracted state shown in FIG. 12 by means of an action of the second coil spring 12.

During a transition from the projected state shown in FIG. 13 to the retracted state shown in FIG. 12, in conjunction with a movement of the tip holder 33 toward a rear end side, the load received by the contact surface 15*t* of the annular member 15 from the guide surface 11*t* of the mouthpiece portion 11*d* disappears. Thereby, the inner diameter of the annular member 15 that has been reduced is returned to an original dimension thereof (FIG. 13→FIG. 12).

As described above, according to the projectable and retractable writing tool 30 of the present embodiment, when the contact surface 15*t* of the annular member 15 receives the load from the guide surface 11*t* of the mouthpiece portion 11*d* in conjunction with the movement of the tip holder 33 toward the front end side, the inner diameter of the annular member 15 is reduced due to the existence of the slits 15*s* of the annular member 15. In this manner, the base portion 11*d* and the annular member 15 cooperate with each other such that the distal portion 33*d* of the tip holder 33 can be grasped in a rattling-free (play-free) manner. In addition, since the tip holder 33 and the annular member 15 are connected via the elastic member 16 such that the tip holder 33 and the annular member 15 are movable relatively to each other, it can be assured that the distal portion 33*d* of the tip holder 33 can be effectively grasped in a rattling-free (play-free) manner even if no high-precision dimension management is applied to a degree of reduction of the inner diameter of the annular member 15 or the like.

In addition, according to the projectable and retractable writing tool 30 of the present embodiment, since the four slits 15*s* as a cutout are arranged at regular intervals in a circumferential direction of the annular member 15 and each slit 15*s* extends in the axial direction of the annular member 15, the inner diameter of the annular member 15 can be reduced in a circumferentially well-balanced manner.

In addition, the contact surface 15*t* and the guide surface 11*t* have the frustoconical shape and the concave frustoconical shape which correspond to each other. Thus, the contact surface 15*t* of the annular member 15 can receive the load in a circumferentially well-balanced manner, so that the inner diameter of the annular member 15 can be reduced in a circumferentially well-balanced manner. Like this, it is preferable that the contact surface 15*t* and the guide surface 11*t* have tapered shapes toward the front end side. A tapered contact surface 15*t* may be formed by providing a rounded portion at an outer periphery of the front end of the cylindrical annular member 15. In addition, a tapered contact surface 15*t* may have a convex curved surface which is rotationally symmetric about an axis, and a tapered guide surface 11*t* may have a concave curved surface or a concave frustoconical surface which is also rotationally symmetric about the axis but has a curvature gentler than that of the convex curved surface.

In addition, in the projectable and retractable writing tool 30 of the present embodiment, the annular member 15 is movable in the axial direction in a region of the distal portion 33*d* of the tip holder 33, and the annular member 15 is configured to grasp the region of the distal portion 33*d* of the tip holder 33 when the inner diameter of the annular member 15 is reduced. However, the present invention is not limited thereto. For example, the annular member 15 may be movable in the axial direction in a region of the tip 34, and the annular member 15 may be configured to grasp the region of the tip 34 when the inner diameter of the annular member 15 is reduced.

In addition, it is possible to adjust elasticity (easiness of reduction of the inner diameter) of the annular member 15 by suitably changing the number of the slits 15*s*, the sizes of the slits 15*s* and/or the shapes of the slits 15*s*. In addition, it is also possible to adjust elasticity (easiness of reduction of the inner diameter) of the annular member 15 by changing a material and/or a thickness of the annular member 15.

In addition, according to the present embodiment, the annular member 15 and the collar member 32 are fixed to each other via the coil spring 16, and the collar member 32 and the mouthpiece portion 11*d* are fixed to each other via the second coil spring 12. That is to say, the annular member 15 need not to be fixed to the tip holder 33, and thus existing refills for replacement including conventional tip holders may be used as well.

Therefore, an invention of the present embodiment can be understood as a shaft cylinder for a projectable and retractable writing tool which can use existing refills for replacement. In this case, the present embodiment can be explained as a shaft cylinder 11 for a projectable and retractable writing tool, the shaft cylinder 11 being capable of containing a tip holder 33 such that the tip holder 33 is movable in an axial direction, a tip 34 being fixed to a front end of the tip holder 33, the shaft cylinder 11 having an opening at a front end thereof, through which the tip 34 is projectable and retractable in conjunction with a movement of the tip holder 33.

The shaft cylinder 11 includes an annular member 15 loosely fitted onto an outer periphery of the tip holder 33 or the tip 34 in a state wherein the shaft cylinder 11 contains the tip holder 33, to be movable in an axial direction of the tip holder 33 or the tip 34 with respect to the tip holder 33 or the tip 34 while being loosely fitted, a collar member 32 connected to the annular member 15 via a coil spring 16, the collar member 32 being capable of coming into contact with the tip holder 33, and a second coil spring 12 configured to support the collar member 32 on an inside surface of the shaft cylinder 11. A contact surface 15*t* is formed on at least a part of an outer periphery of the annular member 15, and slits 15*s* as a cutout are formed at a part of the annular member 15 such that an inner diameter of the annular member 15 is reduced when a load is received by the contact surface 15*t*. On the other hand, a guide surface 11*t* is formed on a part of an inside surface of the mouthpiece portion 11*d* of the shaft cylinder 11, the guide surface 11*r* is tapered toward a front end thereof, and the contact surface 15*t* is configured to receive the load from the guide surface 11*t* in conjunction with a movement of the tip holder 33 toward a front end side thereof.

According to the shaft cylinder 11 as described above, when the contact surface 15*t* of the annular member 15 receives the load from the guide surface 11*t* of the mouthpiece portion 11*d* in conjunction with the movement of the tip holder 33 toward the front end side, the inner diameter of the annular member 15 is reduced due to the existence of the slits 15*s* of the annular member 15. In this manner, the base portion 11*d* and the annular member 15 cooperate with each other such that the distal portion 33*d* of the tip holder 33 can be grasped in a rattling-free (play-free) manner. In addition, since the tip holder 33 and the annular member 15 are connected via the elastic member 16 such that the tip holder 33 and the annular member 15 are movable relatively to each other, it can be assured that the distal portion 33*d* of the tip holder 33 can be effectively grasped in a rattling-free (play-free) manner even if no high-precision dimension management is applied to a degree of reduction of the inner diameter of the annular member 15 or the like.

Fourth Embodiment of First Invention

Figure 16:
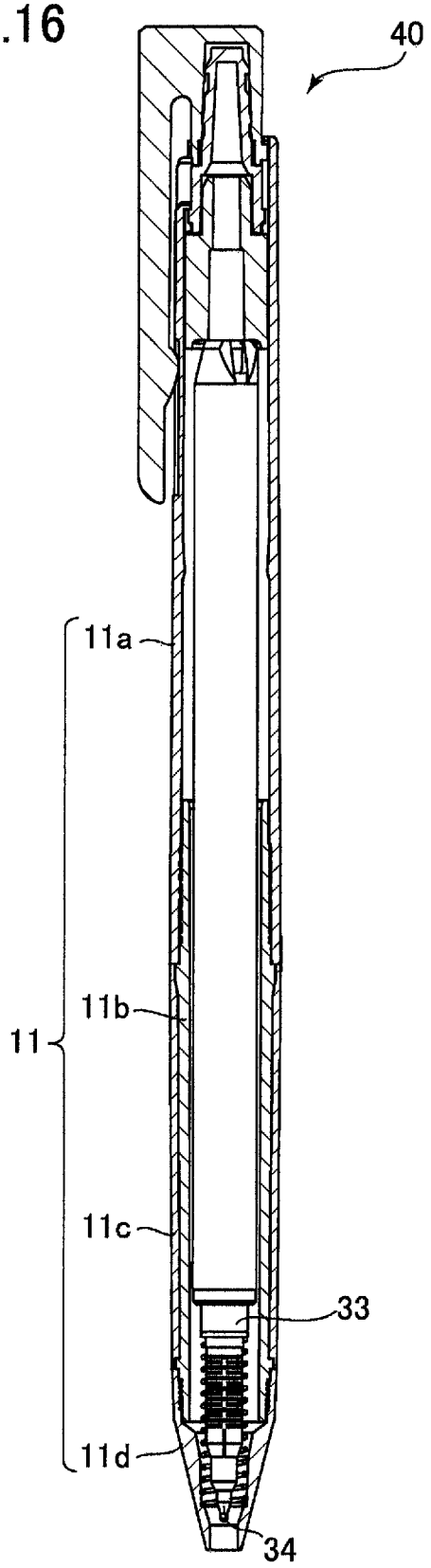
FIG. 16 is a schematic longitudinal section view showing a projectable and retractable writing tool according to a fourth embodiment of the first invention, under a state wherein a tip (writing element) is not projected.
Figure 17:
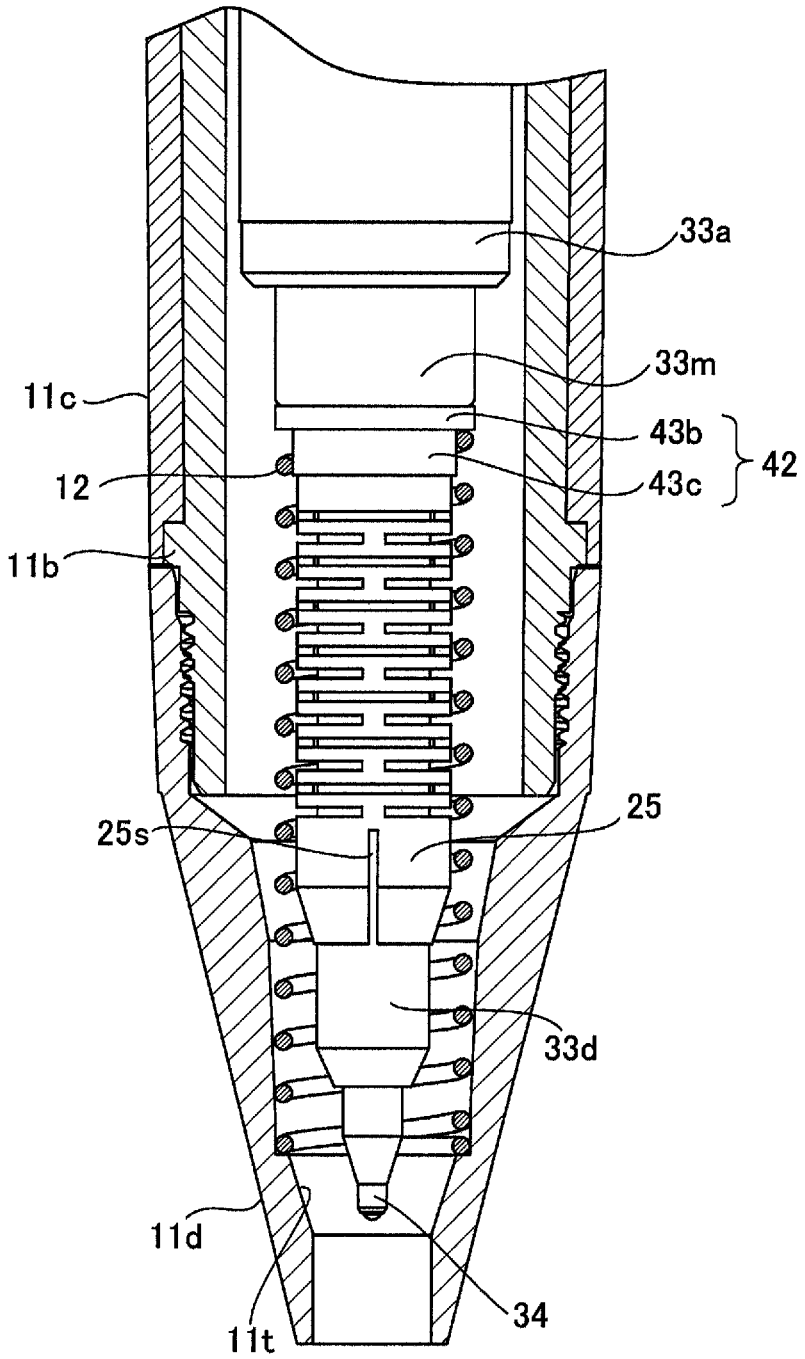
FIG. 17 is an enlarged longitudinal section view of a leading edge portion of the projectable and retractable writing tool shown in FIG. 16.
Figure 18:
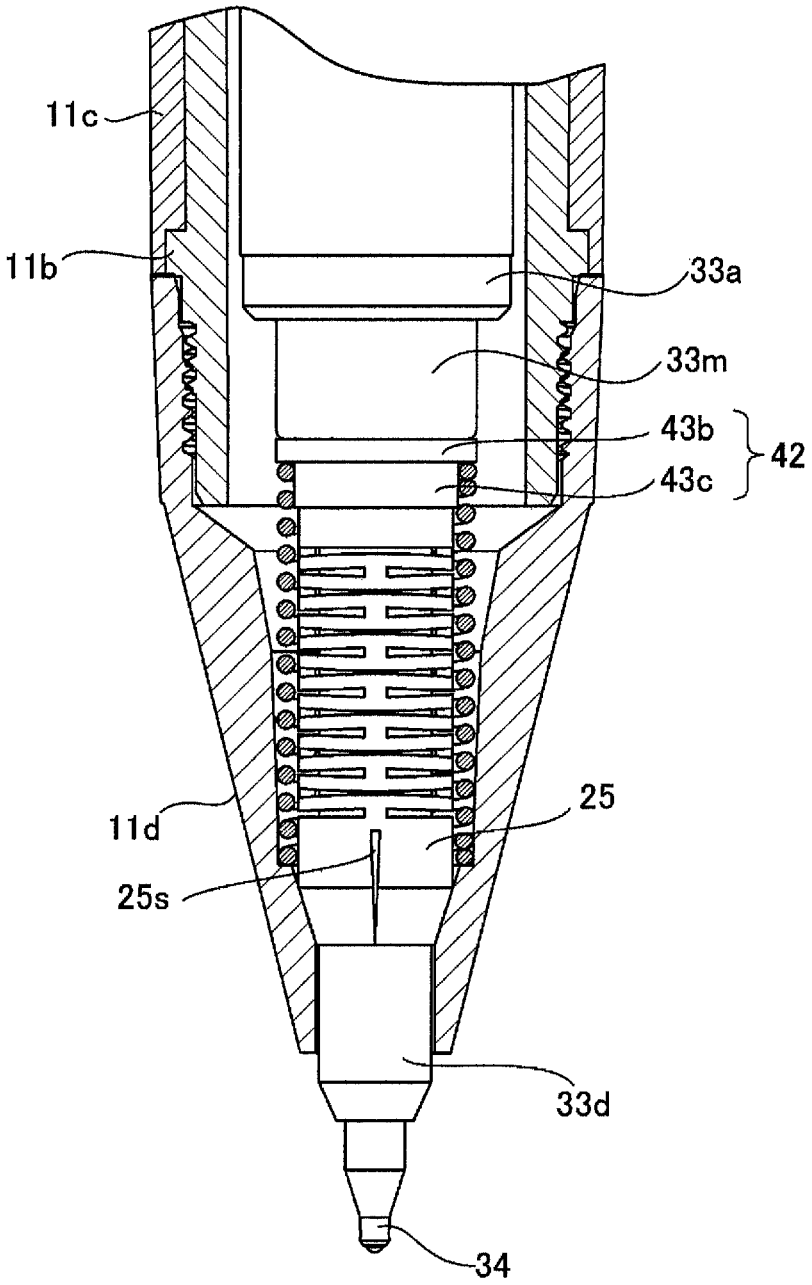
FIG. 18 is an enlarged longitudinal section view of the leading edge portion of the projectable and retractable writing tool shown in FIG. 16, under a state wherein the tip (writing element) is projected.

FIG. 16 is a schematic longitudinal section view showing a projectable and retractable writing tool 40 according to a fourth embodiment of the first invention under a state wherein a tip 34 (writing element) is not projected. FIG. 17 is an enlarged longitudinal section view of a leading edge portion of the projectable and retractable writing tool 40 according to the present embodiment. FIG. 18 is an enlarged longitudinal section view of the leading edge portion of the projectable and retractable writing tool 40 according to the present embodiment, under a state wherein the tip 34 (writing element) is projected.

Figure 19A:
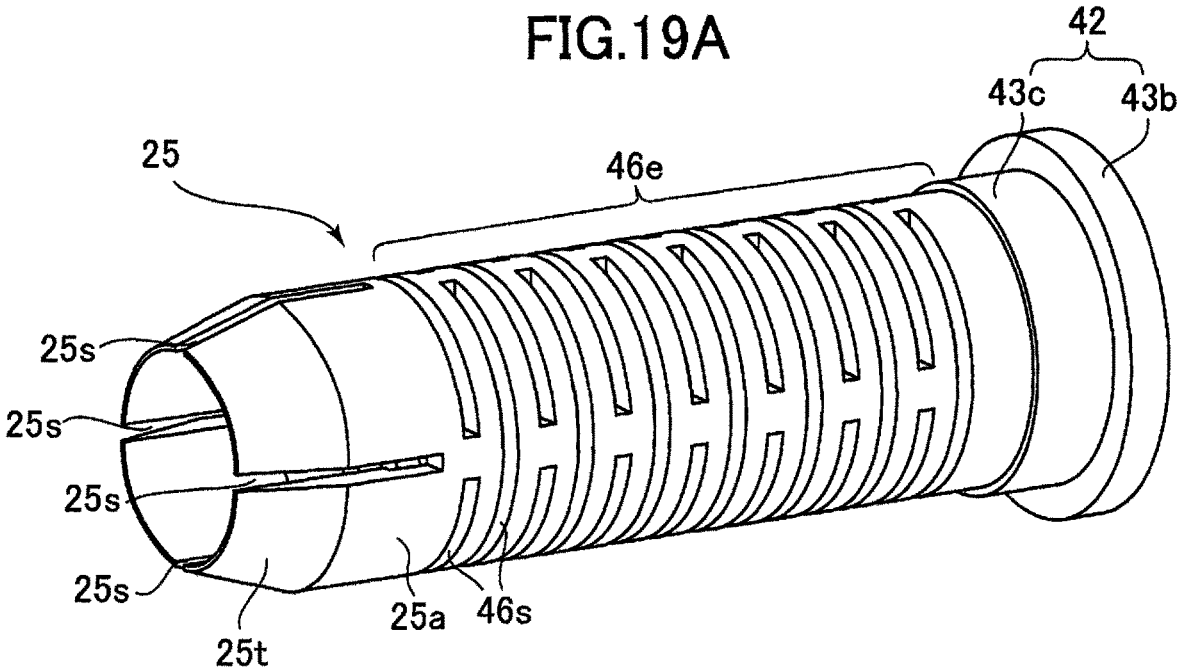
FIG. 19A is a perspective view of an annular member of the projectable and retractable writing tool shown in FIG. 16.
Figure 19B:
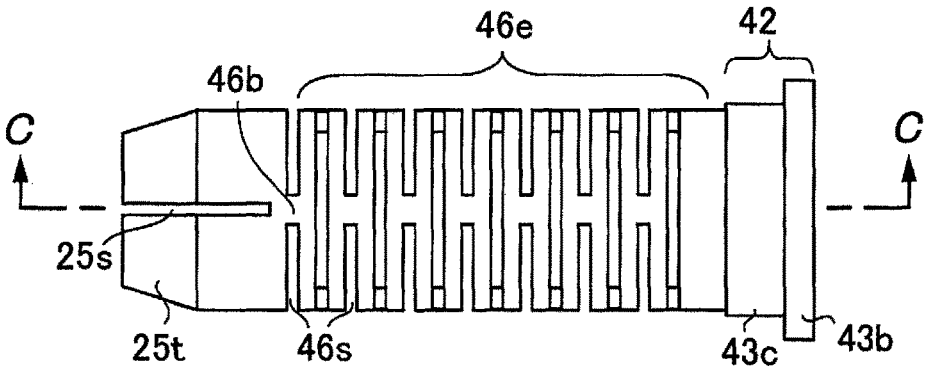
FIG. 19B is a side view of the annular member shown in FIG. 19A.
Figure 19C:
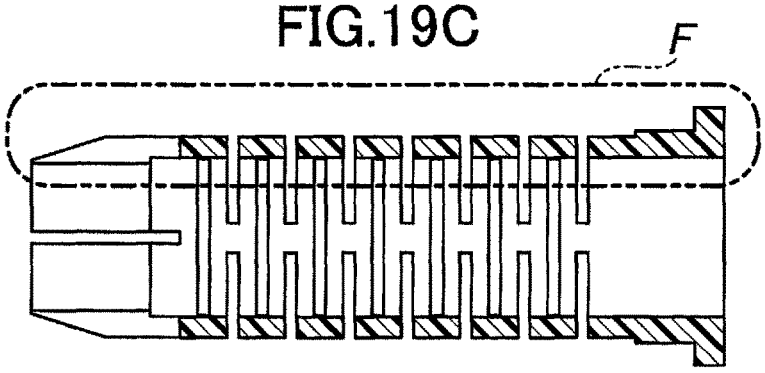
FIG. 19C is a section view taken along line C-C of FIG. 19B.
Figure 19D:
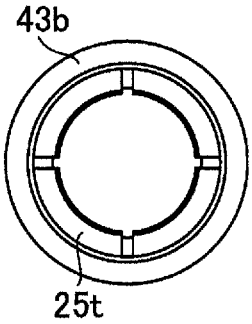
FIG. 19D is a front view (a view seen from the leading edge side) of the annular member shown in FIG. 19A.
Figure 19E:
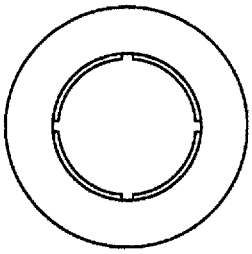
FIG. 19E is a rear view of the annular member shown in FIG. 19A.
Figure 19F:
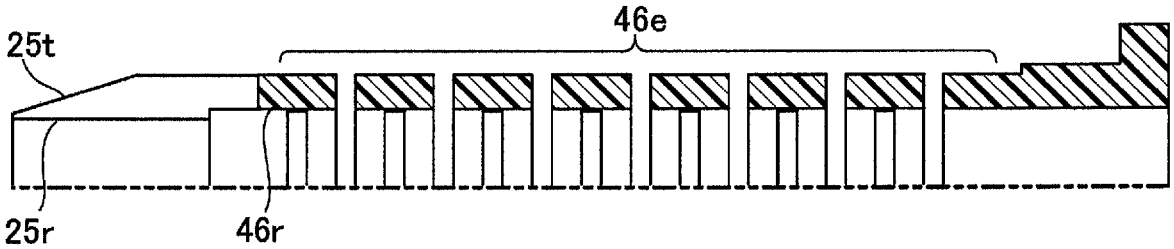
FIG. 19F is an enlarged view of an F portion of FIG. 19C.

In addition, FIG. 19A is a perspective view of an annular member 25 and a collar member 42 of the projectable and retractable writing tool 40 according to the present embodiment, FIG. 19B is a side view of the annular member 25 and the collar member 42, FIG. 19C is a section view taken along line C-C of FIG. 19B, FIG. 19D is a front view (a view seen from the leading edge side) of the annular member 25 and the collar member 42, and FIG. 14E is a rear view of the annular member 25 and the collar member 42. Furthermore, FIG. 19F is an enlarged view of an F portion of FIG. 19C.

Figure 20:
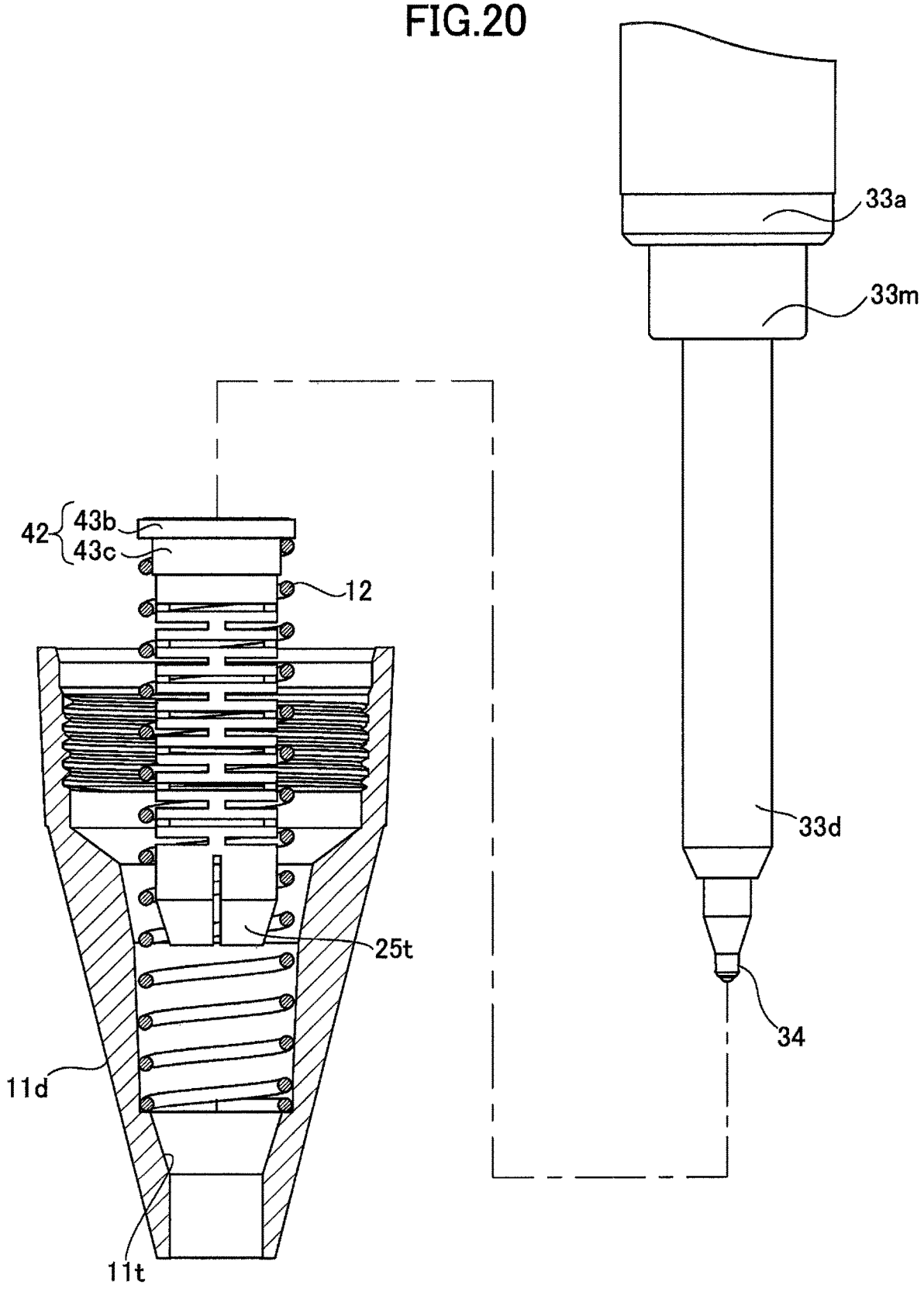

In addition, FIG. 20 is a schematic view showing the projectable and retractable writing tool 40 according to the present invention, under a state wherein the tip holder 33 has been removed for replacement or the like.

A tip holder 33 and the tip 34 of the present embodiment are respectively the same as the tip holder 33 and the tip 34 of the third embodiment. Thus, the same reference numbers are used for the corresponding members.

As well as the first to third embodiments, the projectable and retractable writing tool 40 according to the fourth embodiment shown in FIGS. 16 to 20 includes a shaft cylinder 11, which has an opening at a front end thereof and has a cylindrical shape. As shown in FIGS. 16 to 18, according to the present embodiment as well, the shaft cylinder 11 has a rear portion 11*a*, an inner cylindrical portion 11*b*, a front portion 11*c* and a mouthpiece portion 11*d*. The rear portion 11*a* and the inner cylindrical portion 11*b* are threadedly removably fixed to each other. The inner cylindrical portion 11*b* and the front portion 11*c* are integrally formed by two-color molding. Of course, the rear portion 11*a* and the inner cylindrical portion 11*b* may be fixed to each other by fitting connection or may be formed integrally. The inner cylindrical portion 11*b* and the front portion 11*c* may also be fixed by fitting connection. On the other hand, the mouthpiece portion 11*d* is threadedly detachably fixed to the inner cylindrical portion 11*b*. The material of the mouthpiece portion 11*d* is not limited to metal, but may be resin.

The tip holder 33, which is movable in an axial direction of the shaft cylinder 11, is contained in an inside of the shaft cylinder 11. The tip 34 as a writing element is fixed to a front end of the tip holder 33. The tip 34 is projectable and retractable through the opening of the shaft cylinder 11 in conjunction with a movement of the tip holder 33, as shown in FIGS. 17 and 18.

As well as the third embodiment, as shown in FIG. 20, the tip holder 33 includes: a proximal portion 33*a*, a middle collar portion 33*m* and a distal portion 33*d*, in this order from a proximal side thereof toward a distal side thereof. In the present embodiment as well, each of the proximal portion 33*a*, the middle collar portion 33*m* and the distal portion 33*d* has a cylindrical shape. The relationship between their cross-sectional diameters is as follows: the proximal portion 33*a*>the middle collar portion 33*m*>the distal portion 33*d*.

In the present embodiment, in particular as shown in FIG. 17, an annular member 25 made of resin (for example, polyacetal) is loosely fitted on an outer periphery of the distal portion 33*d* of the tip holder 33. As well as the second embodiment, the annular member 25 of the present embodiment is integrally molded with a tubular resin spring part 46*e* on a proximal end side thereof. A large number of slits 46*s*, each of which extends in a direction perpendicular to an axial direction, are formed in the resin spring part 46*e*, so that the resin spring part 46*e* can extend and contract in the axial direction.

As shown in FIGS. 19A to 19F, in the resin spring part 46*e* of the present embodiment, in substantially the same manner as the resin spring part 26*e* of the second embodiment, seven pairs of substantially semicircular slits 46*s* facing up and down (see FIG. 9F additionally) and seven pairs of substantially semicircular slits 46*s* facing left and right (see FIG. 9G additionally) are formed alternately in the axial direction. The remaining portion between the pairs of slits 46*s* is called a rib 46*b*. In the present embodiment, the width (the length in the axial direction) of each slit 46*s* is uniform, the axial gap between the slits 46*s* adjacent in the axial direction is also uniform, and the former is slightly smaller than the latter. Of course, these dimensional relationship may be suitably adjusted to achieve a desired degree of elasticity, as described below.

As shown in FIGS. 19A and 19B, a further proximal end side of the resin spring part 46*e* is fixed to a second collar portion 43*c* of the collar member 42. As shown in FIGS. 17 and 18, a first collar portion 43*b* of the collar member 42 is abutted and supported by the middle collar portion 33*m* of the tip holder 33 in the axial direction. In this manner, the annular member 25 is movable in an axial direction of the tip holder 33 with respect to the distal portion 33*d* of the tip holder 33, in conjunction with expansion and contraction of the resin spring part 46*e*.

In addition, in particular as shown in FIGS. 19A to 19E, as well as the second embodiment, a frustoconical contact surface 25*t* is formed on a front region of an outer periphery of the annular member 25, as a contact surface having a tapered shape toward the front end side. A cylindrical portion 25*a* is provided continuously on a rear side of the contact surface 25*t*. The tubular resin spring part 46*e*, whose diameter is the same as that of the cylindrical portion 25*a*, is provided on a further rear side thereof. In addition, in particular as shown in FIG. 19F, an inner diameter 46*r* of the resin spring part 46*e* is larger than an inner diameter 25*r* of a portion corresponding to the contact surface 25*t*.

In addition, as well as the second embodiment, the annular member 25 of the present embodiment is also provided with four slits (cutout elements) 25*s* as a cutout. As shown in FIGS. 19A to 19E, the four slits 25*s* are arranged at regular intervals (by every 90 degrees) in a circumferential direction of the annular member 25. Each of the four slits 25*s* extends from a front end of the annular member 25 to a vicinity of a rear end of the cylindrical portion 25*a* in an axial direction of the annular member 25. Thus, when a load is received by the contact surface 25*t*, an inner diameter of the annular member 25 is configured to be reduced flexibly, and when the load is released, the inner diameter of the annular member 25 is configured to be elastically returned to an original dimension thereof.

In addition, as shown in FIGS. 17 and 18, a concave frustoconical guide surface 11*t* is formed on a part of an inside surface of the mouthpiece portion 11*d* of the shaft cylinder 11, as a guide surface having a tapered shape toward the front end side. Thus, in conjunction with a movement of the tip holder 33 toward a front end side thereof (FIG. 17→FIG. 18), the contact surface 25*t* is configured to receive the load from the guide surface 11*t*.

Furthermore, the projectable and retractable writing tool 40 according to the present embodiment is also provided with a second coil spring 12 (second elastic member) in order to automatically retract the tip holder 33 when a retracting operation for the tip 34 (for example, a pushing operation of a push button provided on a rear end portion of the writing tool in order to release a locking mechanism that can maintain a projected state of the tip 34) is carried out. The second coil spring 12 is fitted into between a shoulder portion provided on the inside surface of the mouthpiece portion 11*d* and the first collar portion 43*b* of the collar member 42 such that the second coil spring 12 surrounds an outer periphery of the annular member 25.

As shown in FIG. 20, the second coil spring 12 of the present embodiment is fixed to the inside surface of the mouthpiece portion 11*d* on a front end side thereof, and to the first collar portion 43*b* of the collar member 42 on a rear end side thereof. In this manner, the annular member 25 is supported by and fixed to the inside surface of the mouthpiece portion 11*d* via the collar member 42 and the second coil spring 12.

The projectable and retractable writing tool 40 as described above operates as follows.

When not in use, the tip 34 (writing element) of the projectable and retractable writing tool 40 is retracted as shown in FIG. 17. A length of the annular member 25 including the resin spring part 46*e* in an axial direction thereof is 11.8 mm and a length of the second coil spring 12 in an axial direction thereof is 15.9 mm. When a projecting operation for the tip 34 (for example, a pushing operation of a push button provided on the rear end portion of the writing tool) is carried out, the tip 34 (writing element) of the projectable and retractable writing tool 40 is projected as shown in FIG. 18. Usually, a position of the tip holder 33 is locked in this projected state. The projected state of the tip 34 is maintained until a retracting operation for the tip 34 is carried out thereafter. The length of the annular member 25 including the resin spring part 46*e* in the axial direction thereof is 11.1 mm (shortened by 0.7 mm) and the length of the second coil spring 12 in the axial direction thereof is 8.9 mm (shortened by 7.0 mm).

During a transition from the retracted state shown in FIG. 17 to the projected state shown in FIG. 18, in conjunction with the movement of the tip holder 33 toward the front end side, the contact surface 25*t* of the annular member 25 receives a load from the guide surface 11*t* of the mouthpiece portion 11*d*. At this time, the inner diameter of the annular member 25 is reduced due to existence of the four slits 25*s* of the annular member 25 (see FIG. 3B). As a result, as shown in FIG. 18, the mouthpiece portion 11*d* and the annular member 25 cooperate with each other such that the distal portion 33*d* of the tip holder 33 can be grasped in a rattling-free (play-free) manner.

In addition, since the tip holder 33 and the contact surface 25*t* of the annular member 25 are movable relatively to each other by means of expansion and contraction of the resin spring part 46*e*, it can be assured that the distal portion 33*d* of the tip holder 33 can be effectively grasped in a rattling-free (play-free) manner even if no high-precision dimension management is applied to a degree of reduction of the inner diameter of the annular member 25 or the like.

Thereafter, when a retracting operation for the tip 34 (for example, a subsequent pushing operation of the push button provided on the rear end portion of the writing tool) is carried out, a locking mechanism not shown is released, so that the tip 34 (writing element) of the projectable and retractable writing tool 40 is returned to a retracted state shown in FIG. 17 by means of an action of the second coil spring 12.

During a transition from the projected state shown in FIG. 18 to the retracted state shown in FIG. 17, in conjunction with a movement of the tip holder 33 toward a rear end side, the load received by the contact surface 25*t* of the annular member 25 from the guide surface 11*t* of the mouthpiece portion 11*d* disappears. Thereby, the inner diameter of the annular member 25 that has been reduced is returned to an original dimension thereof (FIG. 18→FIG. 17).

As described above, according to the projectable and retractable writing tool 40 of the present embodiment, when the contact surface 25*t* of the annular member 25 receives the load from the guide surface 11*t* of the mouthpiece portion 11*d* in conjunction with the movement of the tip holder 33 toward the front end side, the inner diameter of the annular member 25 is reduced due to the existence of the slits 25*s* of the annular member 25. In this manner, the base portion 11*d* and the annular member 25 cooperate with each other such that the distal portion 33*d* of the tip holder 33 can be grasped in a rattling-free (play-free) manner. In addition, since the tip holder 23 and the contact surface 25*t* of the annular member 25 are movable relatively to each other by means of the resin spring part 46*e*, it can be assured that the distal portion 33*d* of the tip holder 33 can be effectively grasped in a rattling-free (play-free) manner even if no high-precision dimension management is applied to a degree of reduction of the inner diameter of the annular member 25 or the like.

In addition, since the inner diameter 46*r* of the resin spring part 46*e* is larger than the inner diameter 25*r* of the portion corresponding to the contact surface 25*t*, even if the resin spring part 46*e* swells toward an inner diameter side, the resin spring part 46*e* does not come into contact with the tip holder 33.

In addition, according to the projectable and retractable writing tool 40 of the present embodiment, since the four slits 25*s* as a cutout are arranged at regular intervals in a circumferential direction of the annular member 25 and each slit 25*s* extends in the axial direction of the annular member 25, the inner diameter of the annular member 25 can be reduced in a circumferentially well-balanced manner.

In addition, the contact surface 25*t* and the guide surface 11*t* have the frustoconical shape and the concave frustoconical shape which correspond to each other. Thus, the contact surface 25*t* of the annular member 25 can receive the load in a circumferentially well-balanced manner, so that the inner diameter of the annular member 25 can be reduced in a circumferentially well-balanced manner. Like this, it is preferable that the contact surface 25*t* and the guide surface 11*t* have tapered shapes toward the front end side. A tapered contact surface 25*t* may be formed by providing a rounded portion at an outer periphery of the front end of the cylindrical annular member 25. In addition, a tapered contact surface 25*t* may have a convex curved surface which is rotationally symmetric about an axis, and a tapered guide surface 11*t* may have a concave curved surface or a concave frustoconical surface which is also rotationally symmetric about the axis but has a curvature gentler than that of the convex curved surface.

In addition, in the projectable and retractable writing tool 40 of the present embodiment, the annular member 25 is movable in the axial direction in a region of the distal portion 33*d* of the tip holder 33, and the annular member 25 is configured to grasp the region of the distal portion 33*d* of the tip holder 33 when the inner diameter of the annular member 25 is reduced. However, the present invention is not limited thereto. For example, the annular member 25 may be movable in the axial direction in a region of the tip 34, and the annular member 25 may be configured to grasp the region of the tip 34 when the inner diameter of the annular member 25 is reduced.

In addition, it is possible to adjust elasticity (easiness of reduction of the inner diameter) of the annular member 25 by suitably changing the number of the slits 25*s*, the sizes of the slits 25*s* and/or the shapes of the slits 25*s*. In addition, it is also possible to adjust elasticity (easiness of reduction of the inner diameter) of the annular member 25 by suitably changing a material and/or a thickness of the annular member 25.

In addition, it is possible to adjust elasticity (easiness of expansion and contraction) of the resin spring part 46*e* by suitably changing the number of the slits 46*s*, the sizes of the slits 46*s* and/or the shapes of the slits 46*s*. It is preferable that the slits 46*s* extend in the direction perpendicular to the axial direction. However, they may extend obliquely (for example, spirally) with respect to the axial direction.

In addition, it is also possible to adjust elasticity (easiness of expansion and contraction) of the resin spring part 46*e* by changing a thickness of the resin spring part 46*e*. Furthermore, the resin spring part 46*e* may be formed as a resin spring member separate from the contact surface 25*t* and the cylindrical portion 25*a*, and may be joined to the cylindrical portion 25*a*. In this case, it is also possible to adjust elasticity (easiness of expansion and contraction) of the resin spring member by changing a material of the resin spring member.

Furthermore, the resin spring part 46*e* (or a separate resin spring member) is not limited to the configuration having the slit 46*s*, but may be a configuration having a bellows structure that expands and contracts in the axial direction.

In addition, according to the present embodiment, the resin spring part 46*e* of the annular member 25 and the collar member 42 are fixed to each other, and the collar member 42 and the mouthpiece portion 11*d* are fixed to each other via the second coil spring 12. That is to say, the annular member 25 need not to be fixed to the tip holder 33, and thus existing refills for replacement including conventional tip holders may be used as well.

Therefore, an invention of the present embodiment can also be understood as a shaft cylinder for a projectable and retractable writing tool which can use existing refills for replacement. In this case, the present embodiment can also be explained as a shaft cylinder 11 for a projectable and retractable writing tool, the shaft cylinder 11 being capable of containing a tip holder 33 such that the tip holder 33 is movable in an axial direction, a tip 34 being fixed to a front end of the tip holder 33, the shaft cylinder 11 having an opening at a front end thereof, through which the tip 34 is projectable and retractable in conjunction with a movement of the tip holder 33.

The shaft cylinder 11 includes an annular member 25 loosely fitted onto an outer periphery of the tip holder 33 or the tip 34 in a state wherein the shaft cylinder 11 contains the tip holder 33, to be movable in an axial direction of the tip holder 33 or the tip 34 with respect to the tip holder 33 or the tip 34 while being loosely fitted, a collar member 42 connected to a further proximal side of a resin spring part 46*e* which is a part on a proximal side of the annular member 25, the collar member 42 being capable of coming into contact with the tip holder 33, and a second coil spring 12 configured to support the collar member 42 on an inside surface of the shaft cylinder 11. A contact surface 25*t* is formed on at least a part of an outer periphery of the annular member 25, and slits 25*s* as a cutout are formed at a part of the annular member 25 such that an inner diameter of the annular member 25 is reduced when a load is received by the contact surface 25*t*. On the other hand, a guide surface 11*t* is formed on a part of an inside surface of the mouthpiece portion 11*d* of the shaft cylinder 11, the guide surface 11*r* is tapered toward a front end thereof, and the contact surface 25*t* is configured to receive the load from the guide surface 11*t* in conjunction with a movement of the tip holder 33 toward a front end side thereof.

According to the shaft cylinder 11 as described above, when the contact surface 25*t* of the annular member 25 receives the load from the guide surface 11*t* of the mouthpiece portion 11*d* in conjunction with the movement of the tip holder 33 toward the front end side, the inner diameter of the annular member 25 is reduced due to the existence of the slits 25*s* of the annular member 25. In this manner, the base portion 11*d* and the annular member 25 cooperate with each other such that the distal portion 33*d* of the tip holder 33 can be grasped in a rattling-free (play-free) manner. In addition, since the tip holder 33 and the annular member 25 are movable relatively to each other by means of the resin spring part 46*e*, it can be assured that the distal portion 33*d* of the tip holder 33 can be effectively grasped in a rattling-free (play-free) manner even if no high-precision dimension management is applied to a degree of reduction of the inner diameter of the annular member 25 or the like.

An Embodiment of Second Invention

Figure 21:
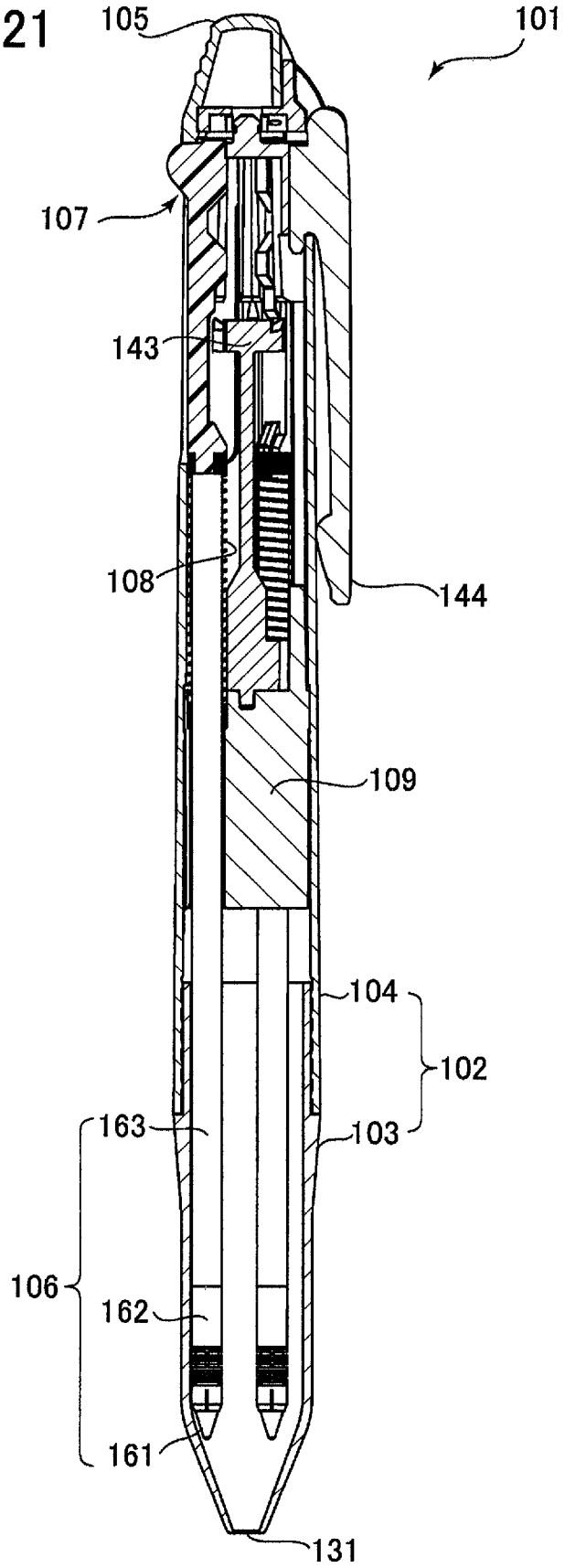
FIG. 21 is a schematic longitudinal section view showing a multi-tip writing tool according to an embodiment of a second invention, under a state wherein all tips (writing elements) are not projected.

FIG. 21 is a schematic longitudinal section view showing a multi-tip writing tool 101 according to an embodiment of a second invention, under a state wherein all tips (writing elements) are not projected. On the other hand, FIG. 26 is a schematic longitudinal section view showing the multi-tip writing tool 101 shown in FIG. 21, under a state wherein one ball-point pen tip as an example of writing element is projected.

Figure 26:
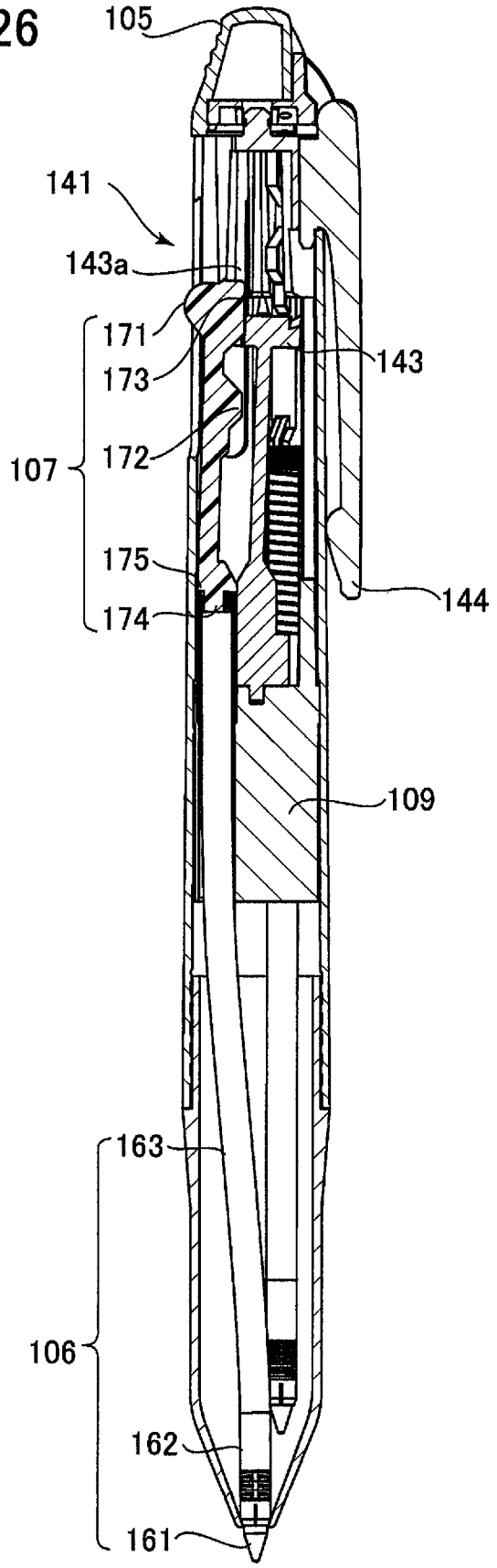
FIG. 26 is a schematic longitudinal section view showing the multi-tip writing tool shown in FIG. 21, under a state wherein one tip (writing element) is projected.

As shown in FIGS. 21 and 26, the multi-tip writing tool 101 of the present embodiment includes a shaft cylinder 102, which consists of a front shaft 103 having a tapered cylindrical shape and a rear shaft 104 threadedly engaged with or press-fitted in a rear end portion of the front shaft 103. An opening 131 is provided at a front end of the front shaft 103 in an axial direction, through which a tip 161 of a writing element 106 is projectable. The front shaft 103 and the rear shaft 104 are made of synthetic resin (for example, polycarbonate) or metal.

For example, five (selectable from two to six) elongated window holes 141, each of which extends in a front and rear direction (see FIG. 26), are provided at a side wall of a rear portion of the rear shaft 104 in radial directions. For example, the five window holes 141 are formed at regular intervals in a circumferential direction.

A release bar 143 extends in a front and rear direction at a region on a shaft center side inside the five window holes 141 of the rear shaft 104. A front end of the release bar 143 is supported by a spring supporter 109, which is described below. On the other hand, locking walls 143*a* extending in a front and rear direction are formed on an inside surface of the side wall between the five window holes 141 of the rear shaft 104. Each locking wall 143*a* can lock a rear end of an operational element 107 of a corresponding writing element 106 under a state wherein a tip thereof is projected. Under the state wherein the rear end of the operational element 107 of the writing element 106 is locked on a corresponding locking wall 143*a* with the tip being projected, when another operational element 107 of another writing element 106 is moved forward in order to project the latter writing element 106, the latter operational element 107 presses the release bar 143 radially outward, and thus the pressed release bar 143 presses the rear end of the former operational element 107, which has been locked on the locking wall 143*a*, radially outward so that the locked state is released. In addition, a clip 144 is provided on an outside surface of the side wall between the five window holes 141 of the rear shaft 104.

A cap 105 is pivotably provided on a rear end portion of the rear shaft 104 such that the rear end portion can be freely opened and closed. For example, an end portion of the cap 105 may be pivotably connected to a proximal portion of the clip 144 via a hinge element. The hinge element may extend in a right and left direction of the clip 144 when the clip 144 is seen from a front side thereof under an orientation wherein the tip is located below. In this case, the cap 105 may be pivotable in a substantially front and rear direction.

An abutment wall part is formed on a front surface of the cap 105. A rear end of the operational element 107 connected to a rear end of a writing element 106 under a retracted state thereof is adapted to be abutted and stopped by the abutment wall part (see FIG. 21). As a hinge element, typically, a structure connected pivotably by means of a pivotable shaft may be adopted. However, instead of this manner, a joint element or the like, which has such a flexibility that the same is bendable, may be also adopted.

For example, an engaging part (for example, an engagement recess or an engagement hole) may be provided on a front surface of the other end portion of the cap 105. An engaged part (for example, an engagement protrusion), which can be engaged with the engaging part, may be provided at a rear end of the rear shaft 104. In detail, an inward protrusion may be formed on an inside surface of the engaging part (the engagement recess or the engagement hole), and an outward protrusion which can climb over the inward protrusion to be locked may be formed on an outside surface of the engaged part (the engagement protrusion).

In this case, while the cap 105 closes the opening of the rear end, the engaging part and the engaged part are engaged with each other (the inward protrusion and the outward protrusion are climbed over each other to be locked). This engaged state is not released by a contact between the operational element 107 and the cap 105 caused by a rearward biasing force of a coil spring 108 which is described below. Thus, the cap 105 is not opened.

In particular as shown in FIG. 26, each operational element 107 includes an operational part 171, a front projected part 172, a rear projected part 173, a fitting-in part 174 and a flange part 175. The operational part 171 is formed at a rear end portion of the operational element 107, and projected outward from a corresponding window hole 141 of the shaft cylinder 102. The rear projected part 173 is provided on an opposite side of the operational part 171 (on a shaft center side) of the operational element 107. The front projected part 172 is provided on a front side of the rear projected part 173. The fitting-in part 174 is formed at a front end of the operational element 107 and fitted in a rear end opening of an ink containing cylinder 163. The flange part 175 is formed in a vicinity of a rear end of the fitting-in part 174. A front surface of the flange part 175 is pressing a rear end of a coil spring 108.

Locking protrusions (not shown) are formed on both side surfaces of each operational element 107. The locking protrusions can be slidably retained in both side walls of each window hole 141. The operational element 107 may be obtained by a molded body of synthetic resin (for example, a polypropylene resin, an ABS resin, a polyacetal resin, or the like).

When the tip 161 of the writing element 106 is in a retracted state, the rear end portion of the operational element 107 attached to the writing element 106 is adapted to be abutted and stopped by the abutment wall part (see FIG. 21). On the other hand, when the tip 161 of the writing element 106 is in a projected state, the rear projected part 173 of the operational element 107 attached to the writing element 106 is adapted to be locked by the locking wall 143*a* formed inside the shaft cylinder 102 (see FIG. 26).

In addition, in a state wherein the tip 161 of a writing element 106 is retracted and the tip 161 of another writing element 106 is projected, when the operational part 171 of the operational element 107 connected to the former writing element 106 is operated to slide forward, the front projected part 172 of the operational element 107 is adapted to press the release bar 143 that has been abutted by the rear projected part 173 of the operational element 107 connected to the latter writing element 106, and to release the locked state between the rear projected part 173 and the locking wall 143*a*, i.e., to release the projected state of the tip 161 of the latter writing element 106.

On the other hand, a cylindrical spring supporter 109 is provided in the shaft cylinder 102 (in the rear shaft 104). Five inside holes are formed through the spring supporter 109 in an axial direction, and a corresponding writing element 106 is inserted through each of the five inside holes. A coil spring 108 is arranged on a rear surface side of the spring supporter 109, correspondingly to each inside hole. The writing element 106 is loosely inserted through each inside hole and through an inside of each coil spring 108. The front surface of the flange part 175 of the operational element 107 is pressing a rear end of the coil spring 108.

More specifically, a cylindrical concave portion is formed on a rear end surface of the spring supporter 109, correspondingly to each inside hole. A front end outside surface of each coil spring 108 is press-fitted into each cylindrical concave portion. Thus, when a writing element 106 (and a corresponding operational element 107) is replaced, it is prevented that a corresponding coil spring 108 is picked out during the replacement operation.

Each coil spring 108 always biases each operational element 107 (and thus each writing element 106) rearward. That is to say, each coil spring 108 maintains a compressed state thereof (a state wherein the writing element 106 is biased rearward) both in a tip projected state and in a tip retracted state. This prevents rattling of the operational element 107 in the front and rear direction. However, each coil spring 108 is in a non-compressed (free) state under a condition wherein no writing element 106 is inserted into the inside thereof (for example, during a replacement operation of the writing element).

Figure 22:
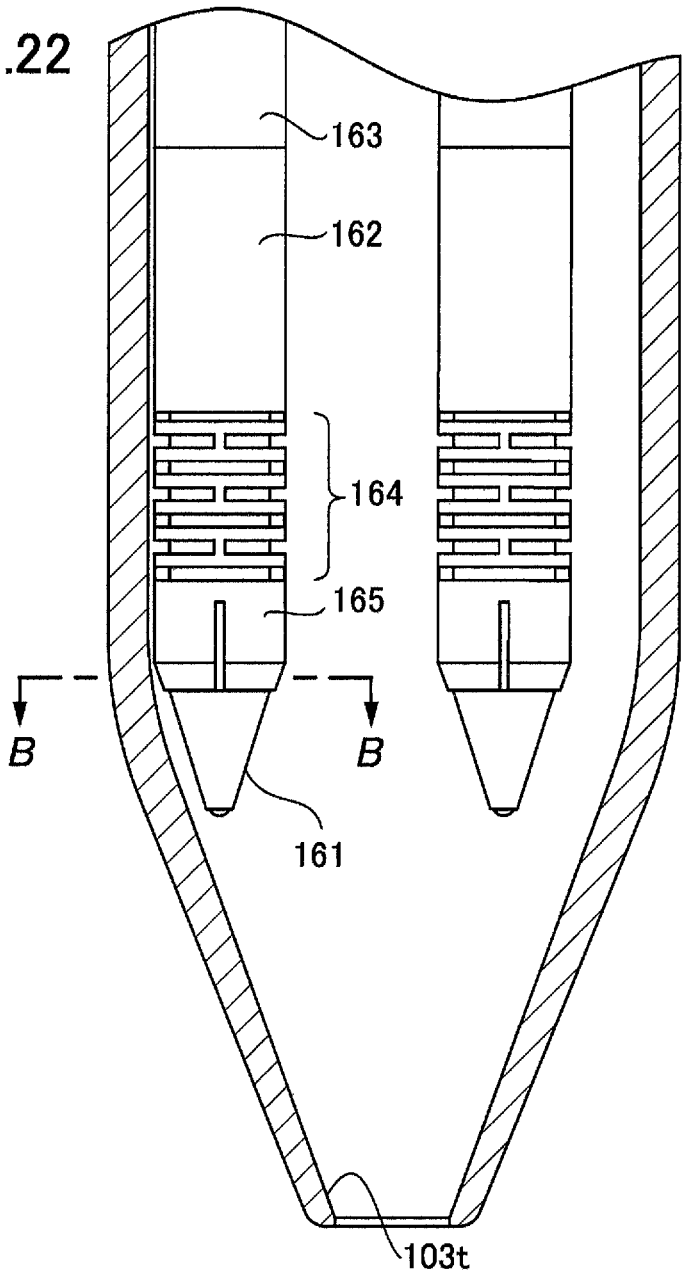
FIG. 22 is an enlarged longitudinal section view of a leading edge portion of the multi-tip writing tool shown in FIG. 21.
Figure 23:
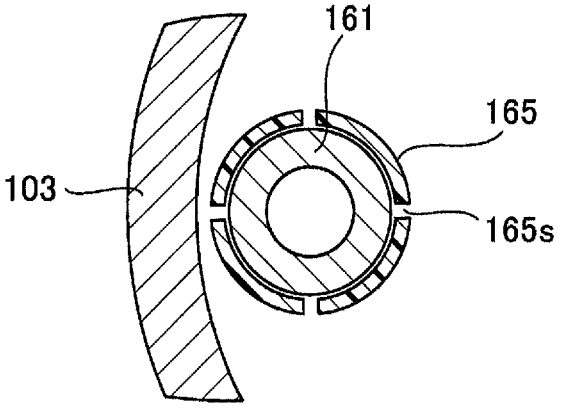
FIG. 23 is a section view taken along line B-B of FIG. 22.
Figure 24A:
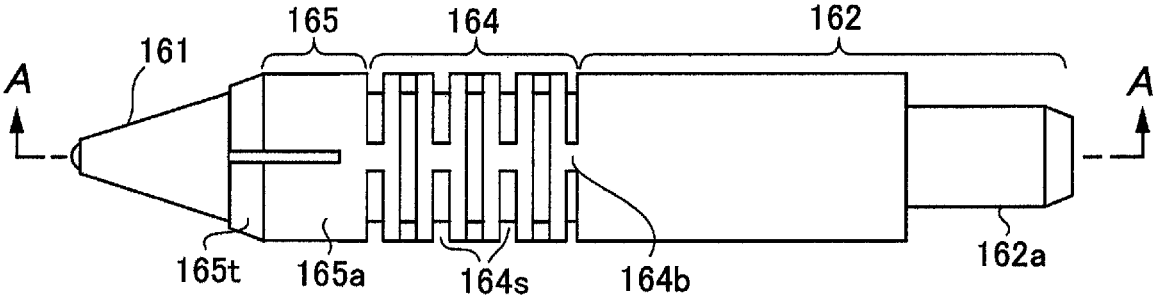
FIG. 24A is a side view of a tip, a tip holder, an annular member and an elastic member of the multi-tip writing tool shown in FIG. 21.
Figure 24B:
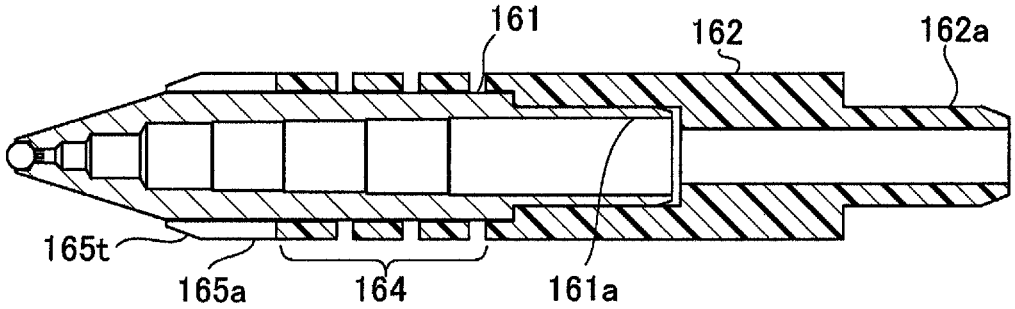
FIG. 24B is a section view taken along line A-A of FIG. 24A.
Figure 25A:
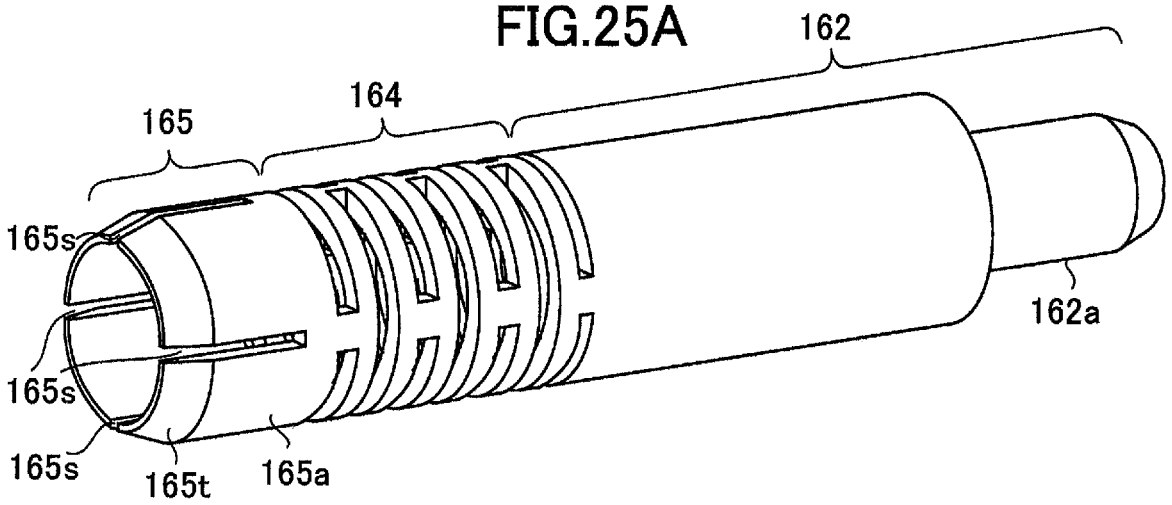
FIG. 25A is a perspective view of the tip holder, the annular member and the elastic member of the multi-tip writing tool shown in FIG. 21.

Next, FIG. 22 is an enlarged longitudinal section view of a leading edge portion of the multi-tip writing tool 101 shown in FIG. 21, and FIG. 23 is a section view taken along line B-B of FIG. 22. FIG. 24A is a side view of the tip 161, a tip holder 162, an annular member 165 and an elastic member 164 of the multi-tip writing tool 101 shown in FIG. 21, and FIG. 24B is a section view taken along line A-A of FIG. 24A. FIG. 25A is a perspective view of the tip holder 162, the annular member 165 and the elastic member 164 of the multi-tip writing tool 101 shown in FIG. 21, and FIG. 25B is a longitudinal section view of the tip holder 162, the annular member 165 and the elastic member 164 shown in FIG. 25A.

Figure 25B:
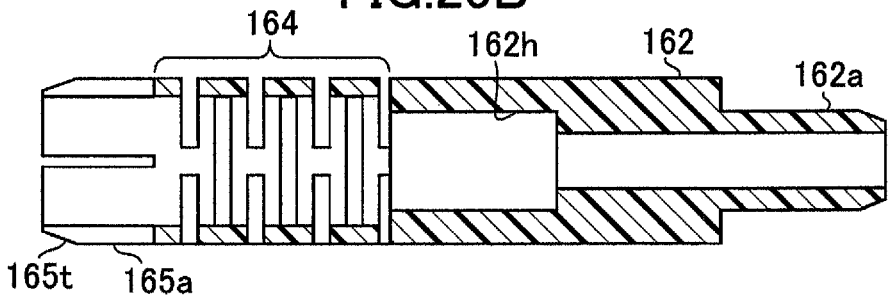
FIG. 25B is a longitudinal section view of the tip holder, the annular member and the elastic member shown in FIG. 25A.

As shown in FIGS. 25A and 25B, in the present embodiment, the tip holder 162, the annular member 165 and the elastic member 164 are integrally molded. A rear end portion of the tip holder 162 is a small diameter portion 162*a* to fit into a front end portion of the ink containing cylinder 163. On the other hand, as shown in FIGS. 24B and 25B, a front end portion of the tip holder 162 is provided with a fitting-in hole 162*h* into which a small diameter portion 161*a* at a rear end of the tip 161 is fitted. The tip 161 of the present embodiment is a ball-point pen tip.

In addition, in particular as shown in FIGS. 23 and 24B, an annular member 165 made of resin (for example, polyacetal) is loosely fitted on an outer periphery of the tip 161. The annular member 165 of the present embodiment is integrally molded with a tubular resin spring member 164 on a proximal end side thereof. A large number of slits 164*s*, each of which extends in a direction perpendicular to an axial direction, are formed in the resin spring member 164, so that the resin spring member 164 can extend and contract in the axial direction.

As shown in FIGS. 24A, 24B, 25A and 25B, in the resin spring member 164 of the present embodiment, four pairs of substantially semicircular slits 164*s* facing up and down and three pairs of substantially semicircular slits 164*s* facing left and right are formed alternately in the axial direction. The remaining portion between the pairs of slits 164*s* called a rib 164*b*. In the present embodiment, the width (the length in the axial direction) of each slit 164*s* is uniform, the axial gap between the slits 164*s* adjacent in the axial direction is also uniform, and the former is the same as the latter. Of course, these dimensional relationship may be suitably adjusted to achieve a desired degree of elasticity, as described below.

Figure 27:
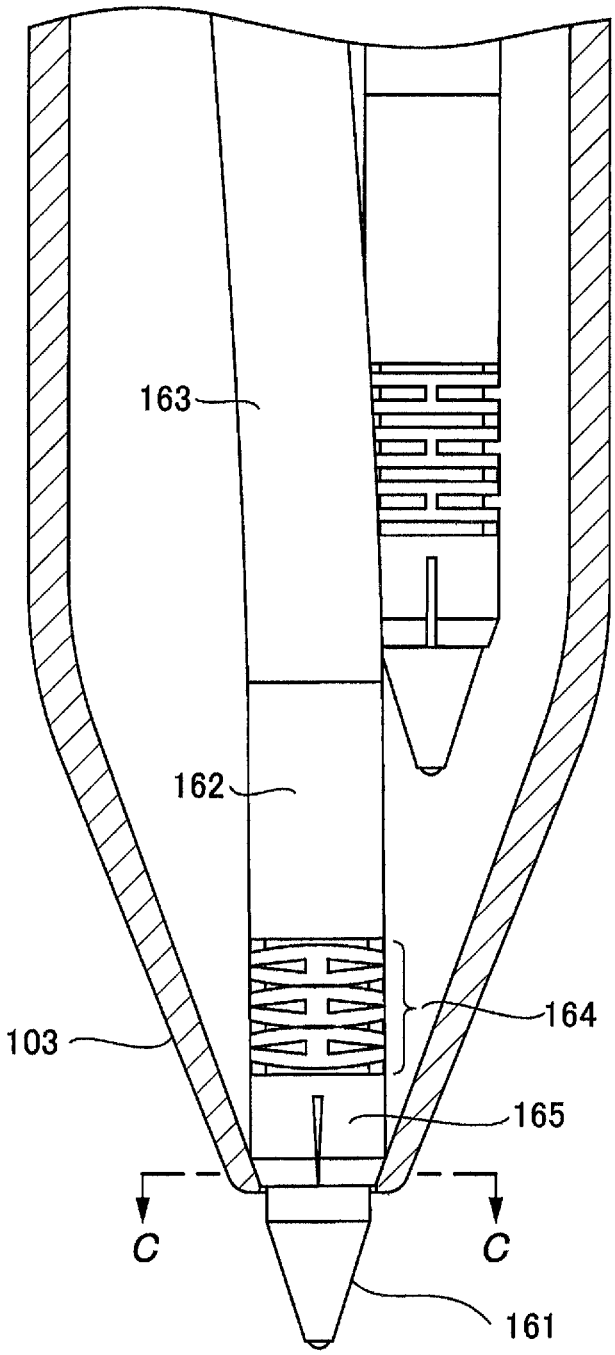
FIG. 27 is an enlarged longitudinal section view of a leading edge portion of the multi-tip writing tool shown in FIG. 26.

A further proximal end side of the resin spring member 164 is integral with a front end side of the tip holder 162. In this manner, as shown in FIG. 27, the annular member 165 is movable in an axial direction of the tip 161 with respect to the tip 161, in conjunction with expansion and contraction of the resin spring member 164.

In addition, in particular as shown in FIG. 25A, a frustoconical contact surface 165*t* is formed on a front region of an outer periphery of the annular member 165, as a contact surface having a tapered shape toward the front end side. A cylindrical portion 165*a* is provided continuously on a rear side of the contact surface 165*t*. The tubular resin spring member 164, whose diameter is the same as that of the cylindrical portion 165*a*, is provided on a further rear side thereof. In the present embodiment, an inner diameter of the resin spring member 164 is the same as an inner diameter of a portion corresponding to the contact surface 165*t*.

The annular member 165 of the present embodiment is provided with four slits (cutout elements) 165*s* as a cutout. As shown in FIG. 25A, the four slits 165*s* are arranged at regular intervals (by every 90 degrees) in a circumferential direction of the annular member 165. Each of the four slits

165*s* extends from a front end of the annular member 165 to a vicinity of a rear end of the cylindrical portion 165*a* in an axial direction of the annular member 165. Thus, when a load is received by the contact surface 165*t*, an inner diameter of the annular member 165 is configured to be reduced flexibly, and when the load is released, the inner diameter of the annular member 165 is configured to be elastically returned to an original dimension thereof.

In addition, as shown in FIG. 22, a concave frustoconical guide surface 103*t* is formed in a vicinity of the opening 131 of the front shaft 103, as a guide surface having a tapered shape toward the front end side. Thus, in conjunction with a movement of the writing element 106 toward a front end side thereof (FIG. 21→FIG. 26), the contact surface 165*t* is configured to receive the load from the guide surface 103*t*.

The multi-tip writing tool 101 as described above operates as follows.

As shown in FIGS. 21 and 22, under a state wherein all the writing elements 106 are retracted, when the operational part 171 of an operational element 107 is selected and operated to slide forward along a corresponding window hole 141 against a rearward biasing force of the coil spring 108, the tip 161 of the writing element 106 connected to the operated operational element 107 is projected outward from the opening 131 of the shaft cylinder 102. Then, the rear rejected part 173 of the operated operational element 107 is newly locked by the locking wall 143*a* inside the shaft cylinder 102, so that the tip projected state is maintained.

Alternatively, under a state wherein another writing element 106 is projected, when the operational part 171 of an operational element 107 is selected and operated to slide forward along a corresponding window hole 141 against a rearward biasing force of the coil spring 108, the front projected part 172 of the operated operational element 107 radially outward presses the release bar 143 that has been abutted by the rear projected part 173 of the operational element 107 connected to the former writing element 106. Thus, the locked state between the locking wall 143*a* and the rear projected part 173 is released, and thus the former writing element 106 is moved rearward by a biasing force of a corresponding coil spring 108, i.e., retracted in the shaft cylinder 102. At the same time that the latter writing element 106 is retracted, the tip 161 of the writing element 106 connected to the operated operational element 107 is projected outward from the opening 131 of the shaft cylinder 102. Then, the rear rejected part 173 of the operated operational element 107 is newly locked by the locking wall 143*a* inside the shaft cylinder 102, so that the tip projected state is maintained.

Figure 28:
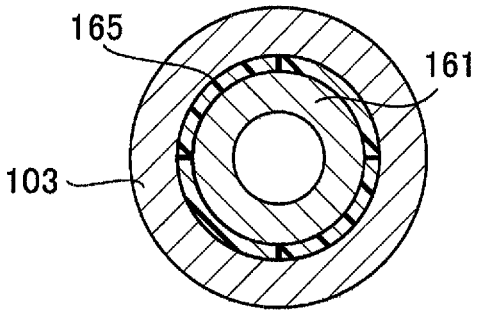
FIG. 28 is a section view taken along line C-C of FIG. 27.

FIG. 27 is an enlarged longitudinal section view of a leading edge portion of the multi-tip writing tool 101 shown in FIG. 26, and FIG. 28 is a section view taken along line C-C of FIG. 27. As shown in FIGS. 26 to 28, in either of the above cases, in conjunction with the movement of the writing element 106 toward the front end side, the contact surface 165*t* of the annular member 165 receives a load from the guide surface 103*t* of the front shaft 103. At this time, the inner diameter of the annular member 165 is reduced due to existence of the four slits 165*s* of the annular member 165. As a result, as shown in FIG. 28, the front shaft 103 and the annular member 165 cooperate with each other such that the tip 161 can be grasped in a rattling-free (play-free) manner.

In addition, since the tip holder 162 and the contact surface 165*t* of the annular member 165 are movable relatively to each other by means of expansion and contraction of the resin spring member 164, it can be assured that the tip 161 can be effectively grasped in a rattling-free (play-free) manner even if no high-precision dimension management is applied to a degree of reduction of the inner diameter of the annular member 165 or the like.

Thereafter, when a tip 161 that has been projected so far is retracted rearward by a rearward biasing force of a corresponding coil spring 108, for example in conjunction with a projecting operation for another writing element 106, the load received by the contact surface 165*t* of the annular member 165 from the guide surface 103*t* of the front shaft 103 disappears. Thereby, the inner diameter of the annular member 165 that has been reduced is returned to an original dimension thereof (FIG. 28→FIG. 23).

In addition, when a writing element 106 is replaced, an operational end of the cap 105 on the opposite side of the hinge element is pushed rearward to release the engagement between the engaging part and the engaged part and to pivot the cap 105 rearward, from a state wherein the cap 105 closes the rear end opening of the shaft cylinder 102 (see FIG. 21). Thereby, the rear end opening of the shaft cylinder 102 is opened. At the same time as this, each operational element 107 is projected rearward from the opening by a rearward biasing force of a corresponding coil spring 108. In this state, any operational element 107 can be picked out, thereby the writing element 106 connected to the operational element 107 can be picked out from the shaft cylinder 102.

Thereafter, a new writing element 106 (and a corresponding new operational element 107) is inserted in the shaft cylinder 102 through the rear end opening. Subsequently, the cap 105 is pivoted forward such that each operational element 107 is abutted and pressed forward by the abutment wall part of the cap 105, and the engaging part and the engaged part are engaged with each other such that the cap 105 is closed. In conjunction with this, the front surface of the flange part 175 of the new operational element 107 presses a rear end of a corresponding coil spring 108. Thereby, a replacement operation for the writing element 106 (and the operational element 107) is completed.

As described above, according to the multi-tip writing tool 101 of the present embodiment, when the contact surface 165*t* of the annular member 165 receives the load from the guide surface 103*t* of the front shaft 103 in conjunction with the movement of the writing element 106 (including the tip holder 162) toward the front end side, the inner diameter of the annular member 165 is reduced due to the existence of the slits 165*s* of the annular member 165. In this manner, the front shaft 103 and the annular member 165 cooperate with each other such that the tip 161 can be grasped in a rattling-free (play-free) manner. In addition, since the tip 161 and the contact surface 165*t* of the annular member 165 are movable relatively to each other by means of the resin spring member 164, it can be assured that the tip 161 can be effectively grasped in a rattling-free (play-free) manner even if no high-precision dimension management is applied to a degree of reduction of the inner diameter of the annular member 165 or the like.

In addition, according to the multi-tip writing tool 101 of the present embodiment, since the four slits 165*s* as a cutout are arranged at regular intervals in a circumferential direction of the annular member 165 and each slit 165*s* extends in the axial direction of the annular member 165, the inner diameter of the annular member 165 can be reduced in a circumferentially well-balanced manner.

In addition, the contact surface 165*t* and the guide surface 103*t* have the frustoconical shape and the concave frustoconical shape which correspond to each other. Thus, the contact surface 165*t* of the annular member 165 can receive the load in a circumferentially well-balanced manner, so that the inner diameter of the annular member 165 can be reduced in a circumferentially well-balanced manner. Like this, it is preferable that the contact surface 165*t* and the guide surface 103*t* have tapered shapes toward the front end side. A tapered contact surface 165*t* may be formed by providing a rounded portion at an outer periphery of the front end of the cylindrical annular member 165. In addition, a tapered contact surface 165*t* may have a convex curved surface which is rotationally symmetric about an axis, and a tapered guide surface 103*t* may have a concave curved surface or a concave frustoconical surface which is also rotationally symmetric about the axis but has a curvature gentler than that of the convex curved surface.

In addition, in the multi-tip writing tool 101 of the present embodiment, the annular member 165 is movable in the axial direction in a region of the tip 161, and the annular member 165 is configured to grasp the region of the tip 161 when the inner diameter of the annular member 165 is reduced. However, the present invention is not limited thereto. For example, the annular member 165 may be movable in the axial direction in a region of a separate member (for example, a tip holder) holding the tip 161, and the annular member 165 may be configured to grasp the region of the separate member when the inner diameter of the annular member 165 is reduced.

In addition, it is possible to adjust elasticity (easiness of reduction of the inner diameter) of the annular member 165 by suitably changing the number of the slits 165*s*, the sizes of the slits 165*s* and/or the shapes of the slits 165*s*. In addition, it is also possible to adjust elasticity (easiness of reduction of the inner diameter) of the annular member 165 by suitably changing a material and/or a thickness of the annular member 165.

In addition, it is possible to adjust elasticity (easiness of expansion and contraction) of the resin spring member 164 by suitably changing the number of the slits 164*s*, the sizes of the slits 164*s* and/or the shapes of the slits 164*s*. It is preferable that the slits 164*s* extend in the direction perpendicular to the axial direction. However, they may extend obliquely (for example, spirally) with respect to the axial direction.

In addition, it is also possible to adjust elasticity (easiness of expansion and contraction) of the resin spring member 164 by changing a thickness of the resin spring member 164. Furthermore, the resin spring member 164 may be formed as a resin spring member separate from the annular member 165 (the contact surface 165*t* and the cylindrical portion 165*a*), and may be joined to the cylindrical portion 165*a*. In this case, it is also possible to adjust elasticity (easiness of expansion and contraction) of the resin spring member by changing a material of the resin spring member.

Furthermore, the resin spring member 164 (or a separate resin spring member) is not limited to the configuration having the slit 164*s*, but may be a configuration having a bellows structure that expands and contracts in the axial direction.

A plurality of types of refills for replacement having different refill diameters (diameters of the tip 161, the tip holder 162 and/or the ink containing cylinder 163) may be used in any mixed state.

In addition, instead of a writing element, a refill holding a friction member as a tip 161 may be used. The friction member means an eraser or a frictional heat generating rubber for a thermochromic writing tool (a rubber for erasing). In this case, it is possible to prevent rattling of the friction member when erasing a written trace, and thus to obtain a more stable erasing feeling.

In the above explanation, as a mechanism for moving the tip holder 162 toward the front end side, a manner of allowing the operational part 171 of the operational element 107 to slide is adopted. However, instead of this manner, a so-called rotary feeding mechanism may be adopted.

An Embodiment of Third Invention

Figure 29:
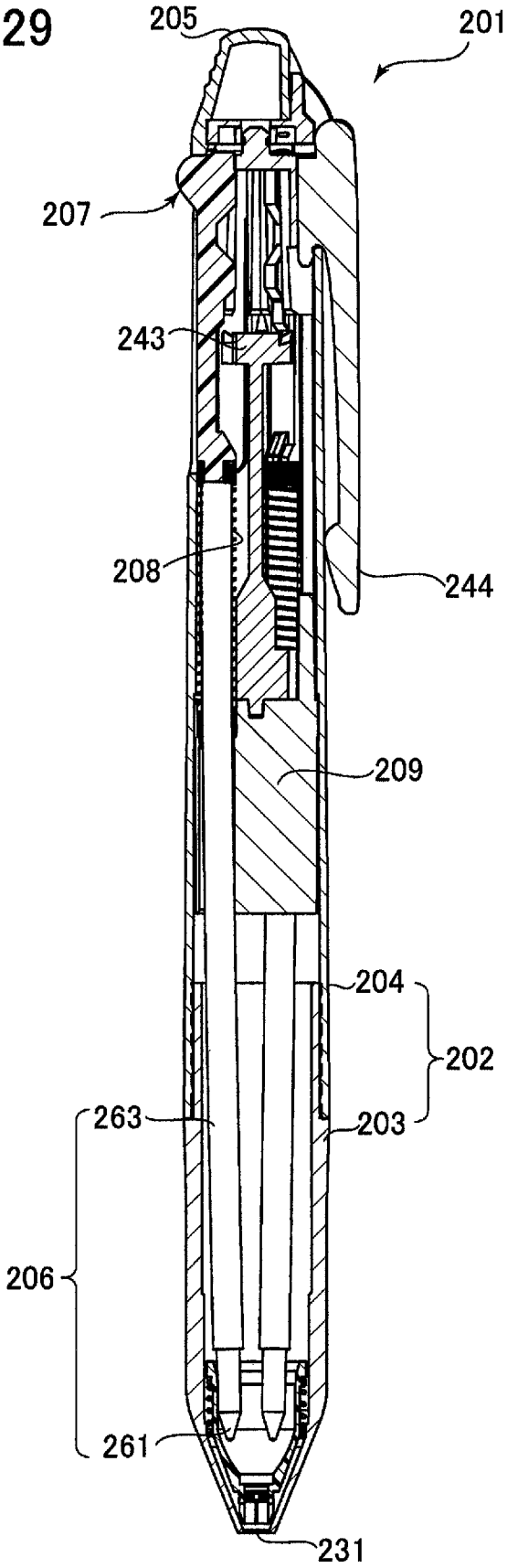
FIG. 29 is a schematic longitudinal section view showing a multi-tip writing tool according to an embodiment of a third invention, under a state wherein all tips (writing elements) are not projected.

FIG. 29 is a schematic longitudinal section view showing a multi-tip writing tool 201 according to an embodiment of a third invention, under a state wherein all tips (writing elements) are not projected. On the other hand, FIG. 33 is a schematic longitudinal section view showing the multi-tip writing tool 201 shown in FIG. 29, under a state wherein one ball-point pen tip as an example of writing element is projected.

Figure 33:
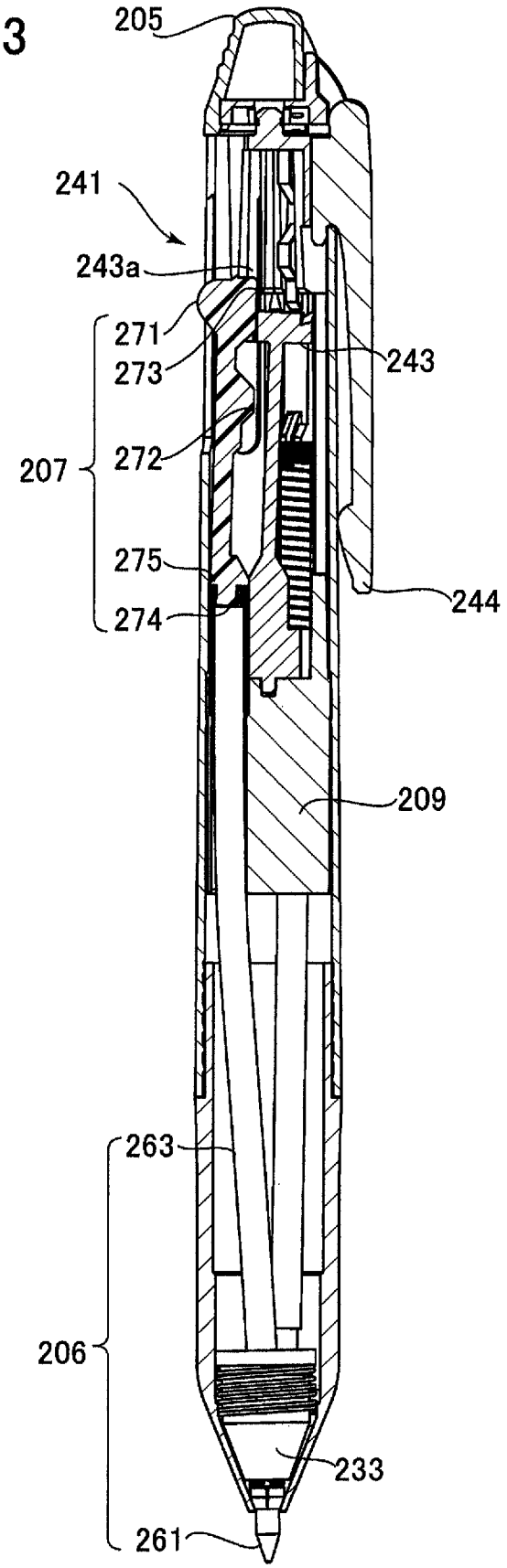
FIG. 33 is a schematic longitudinal section view showing the multi-tip writing tool shown in FIG. 29, under a state wherein one tip (writing element) is projected.

As shown in FIGS. 29 and 33, the multi-tip writing tool 201 of the present embodiment includes a shaft cylinder 202, which consists of a front shaft 203 having a tapered cylindrical shape and a rear shaft 204 threadedly engaged with or press-fitted in a rear end portion of the front shaft 203. An opening 231 is provided at a front end of the front shaft 203 in an axial direction, through which a tip 261 of a writing element 206 is projectable. The front shaft 203 and the rear shaft 204 are made of synthetic resin (for example, polycarbonate) or metal.

For example, five (selectable from two to six) elongated window holes 241, each of which extends in a front and rear direction (see FIG. 33), are provided at a side wall of a rear portion of the rear shaft 204 in radial directions. For example, the five window holes 241 are formed at regular intervals in a circumferential direction.

A release bar 243 extends in a front and rear direction at a region on a shaft center side inside the five window holes 241 of the rear shaft 204. A front end of the release bar 243 is supported by a spring supporter 209, which is described below. On the other hand, locking walls 243*a* extending in a front and rear direction are formed on an inside surface of the side wall between the five window holes 241 of the rear shaft 204. Each locking wall 243*a* can lock a rear end of an operational element 207 of a corresponding writing element 206 under a state wherein a tip thereof is projected. Under the state wherein the rear end of the operational element 207 of the writing element 206 is locked on a corresponding locking wall 243*a* with the tip being projected, when another operational element 207 of another writing element 206 is moved forward in order to project the latter writing element 206, the latter operational element 207 presses the release bar 243 radially outward, and thus the pressed release bar 243 presses the rear end of the former operational element 207, which has been locked on the locking wall 243*a*, radially outward so that the locked state is released. In addition, a clip 244 is provided on an outside surface of the side wall between the five window holes 241 of the rear shaft 204.

A cap 205 is pivotably provided on a rear end portion of the rear shaft 204 such that the rear end portion can be freely opened and closed. For example, an end portion of the cap 205 may be pivotably connected to a proximal portion of the clip 244 via a hinge element. The hinge element may extend in a right and left direction of the clip 244 when the clip 244 is seen from a front side thereof under an orientation wherein the tip is located below. In this case, the cap 205 may be pivotable in a substantially front and rear direction.

An abutment wall part is formed on a front surface of the cap 205. A rear end of the operational element 207 connected to a rear end of a writing element 206 under a retracted state thereof is adapted to be abutted and stopped by the abutment wall part (see FIG. 29). As a hinge element, typically, a structure connected pivotably by means of a pivotable shaft may be adopted. However, instead of this manner, a joint element or the like, which has such a flexibility that the same is bendable, may be also adopted.

For example, an engaging part (for example, an engagement recess or an engagement hole) may be provided on a front surface of the other end portion of the cap 205. An engaged part (for example, an engagement protrusion), which can be engaged with the engaging part, may be provided at a rear end of the rear shaft 204. In detail, an inward protrusion may be formed on an inside surface of the engaging part (the engagement recess or the engagement hole), and an outward protrusion which can climb over the inward protrusion to be locked may be formed on an outside surface of the engaged part (the engagement protrusion).

In this case, while the cap 205 closes the opening of the rear end, the engaging part and the engaged part are engaged with each other (the inward protrusion and the outward protrusion are climbed over each other to be locked). This engaged state is not released by a contact between the operational element 207 and the cap 205 caused by a rearward biasing force of a coil spring 208 which is described below. Thus, the cap 205 is not opened.

In particular as shown in FIG. 33, each operational element 207 includes an operational part 271, a front projected part 272, a rear projected part 273, a fitting-in part 274 and a flange part 275. The operational part 271 is formed at a rear end portion of the operational element 207, and projected outward from a corresponding window hole 241 of the shaft cylinder 202. The rear projected part 273 is provided on an opposite side of the operational part 271 (on a shaft center side) of the operational element 207. The front projected part 272 is provided on a front side of the rear projected part 273. The fitting-in part 274 is formed at a front end of the operational element 207 and fitted in a rear end opening of a tip holder 263 which also serves as an ink containing cylinder. The flange part 275 is formed in a vicinity of a rear end of the fitting-in part 274. A front surface of the flange part 275 is pressing a rear end of a coil spring 208.

Locking protrusions (not shown) are formed on both side surfaces of each operational element 207. The locking protrusions can be slidably retained in both side walls of each window hole 241. The operational element 207 may be obtained by a molded body of synthetic resin (for example, a polypropylene resin, an ABS resin, a polyacetal resin, or the like).

When the tip 261 of the writing element 206 is in a retracted state, the rear end portion of the operational element 207 attached to the writing element 206 is adapted to be abutted and stopped by the abutment wall part (see FIG. 29). On the other hand, when the tip 261 of the writing element 206 is in a projected state, the rear projected part 273 of the operational element 207 attached to the writing element 206 is adapted to be locked by the locking wall 243*a* formed inside the shaft cylinder 202 (see FIG. 33).

In addition, in a state wherein the tip 261 of a writing element 206 is retracted and the tip 261 of another writing element 206 is projected, when the operational part 271 of the operational element 207 connected to the former writing element 206 is operated to slide forward, the front projected part 272 of the operational element 207 is adapted to press the release bar 243 that has been abutted by the rear projected part 273 of the operational element 207 connected to the latter writing element 206, and to release the locked state between the rear projected part 273 and the locking wall 243*a*, i.e., to release the projected state of the tip 261 of the latter writing element 206.

On the other hand, a cylindrical spring supporter 209 is provided in the shaft cylinder 202 (in the rear shaft 204). Five inside holes are formed through the spring supporter 209 in an axial direction, and a corresponding writing element 206 is inserted through each of the five inside holes. A coil spring 208 is arranged on a rear surface side of the spring supporter 209, correspondingly to each inside hole. The writing element 206 is loosely inserted through each inside hole and through an inside of each coil spring 208. The front surface of the flange part 275 of the operational element 207 is pressing a rear end of the coil spring 208.

More specifically, a cylindrical concave portion is formed on a rear end surface of the spring supporter 209, correspondingly to each inside hole. A front end outside surface of each coil spring 208 is press-fitted into each cylindrical concave portion. Thus, when a writing element 206 (and a corresponding operational element 207) is replaced, it is prevented that a corresponding coil spring 208 is picked out during the replacement operation.

Each coil spring 208 always biases each operational element 207 (and thus each writing element 206) rearward. That is to say, each coil spring 208 maintains a compressed state thereof (a state wherein the writing element 206 is biased rearward) both in a tip projected state and in a tip retracted state. This prevents rattling of the operational element 207 in the front and rear direction. However, each coil spring 208 is in a non-compressed (free) state under a condition wherein no writing element 206 is inserted into the inside thereof (for example, during a replacement operation of the writing element).

Figure 30:
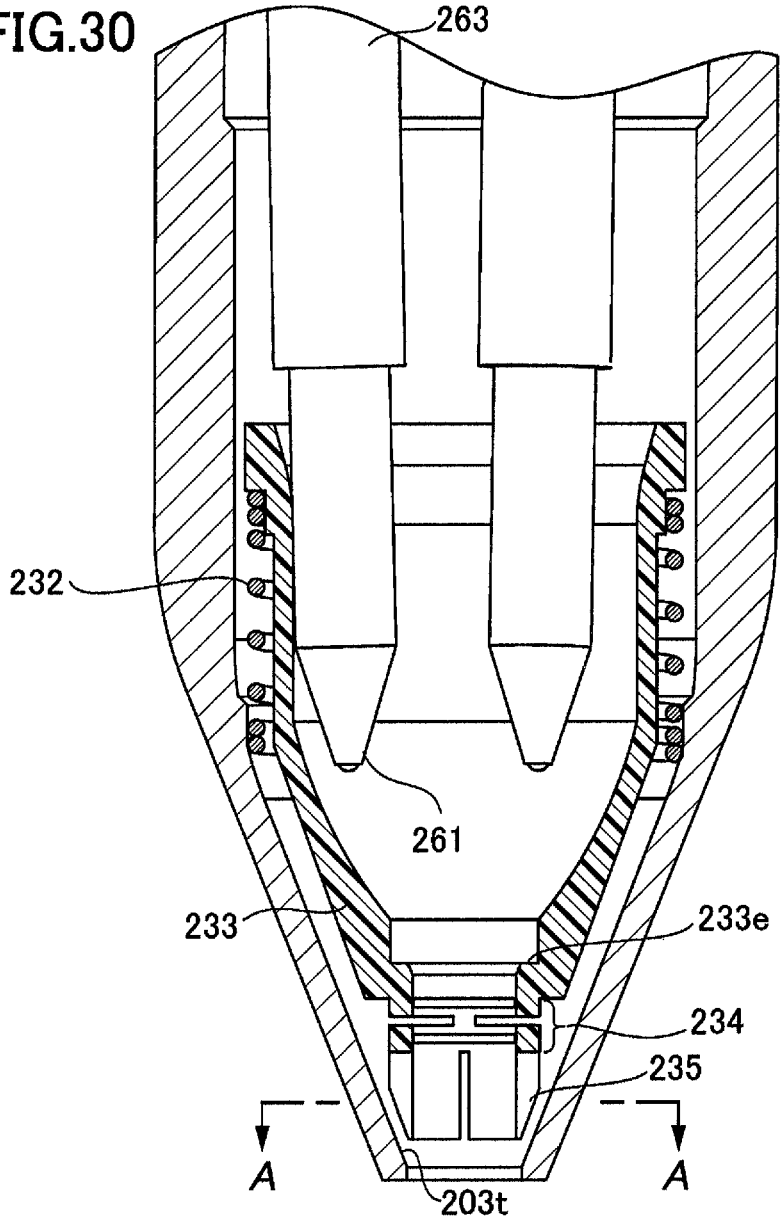
FIG. 30 is an enlarged longitudinal section view of a leading edge portion of the multi-tip writing tool shown in FIG. 29.
Figure 31:
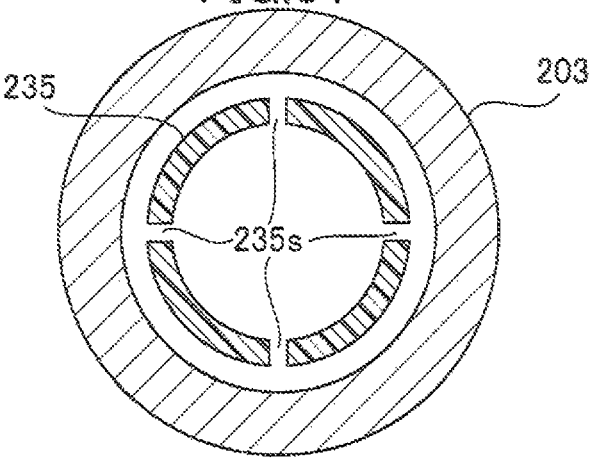
FIG. 31 is a section view taken along line A-A of FIG. 30.

Next, FIG. 30 is an enlarged longitudinal section view of a leading edge portion of the multi-tip writing tool 201 shown in FIG. 29, and FIG. 31 is a section view taken along line A-A of FIG. 30. In addition, FIG. 32A is a perspective view of an annular member 235, an elastic member 234 and a collar member 233 of the multi-tip writing tool 201 shown in FIG. 29, FIG. 32B is a side view of the annular member 235, the elastic member 234 and the collar member 233, FIG. 32C is a section view taken along line C-C of FIG. 32B, FIG. 33D is a front view (a view seen from the leading edge side) of the annular member 235, the elastic member 234 and the collar member 233, and FIG. 32E is a rear view of the annular member 235, the elastic member 234 and the collar member 233.

As shown in FIGS. 29, 30, 33 and 34, the multi-tip writing tool 201 of the present embodiment is provided with an annular member 235 (for example, made of polyacetal), which can be loosely fitted on an outer periphery of the tip 261 fixed to one tip holder 263 among the plurality of tip holders (ink containing cylinders) 263 in conjunction with a movement of the tip holder 263 toward a front end side thereof to be movable in an axial direction of the tip 261 with respect to the tip 261 while being loosely fitted.

Figure 32A:
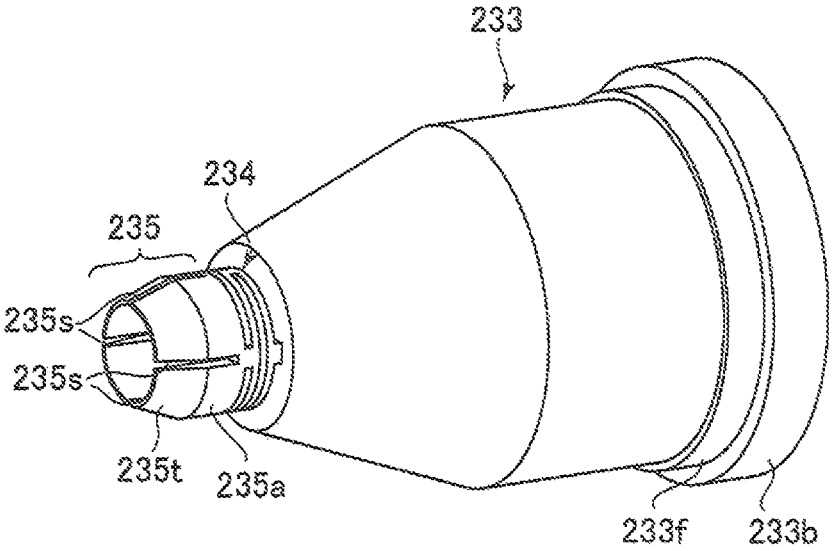
FIG. 32A is a perspective view of an annular member, an elastic member and a collar member of the multi-tip writing tool shown in FIG. 29.
Figure 32B:
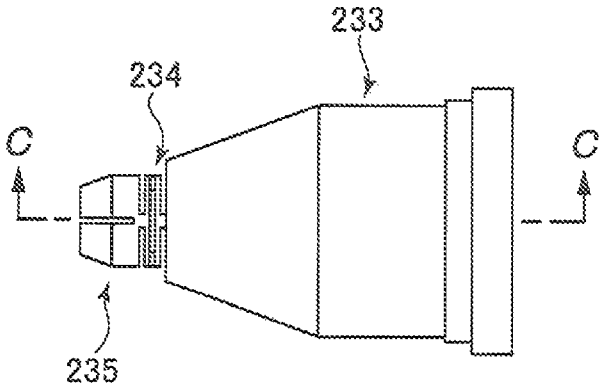
FIG. 32B is a side view of the annular member, the elastic member and the collar member shown in FIG. 32A.
Figure 32C:
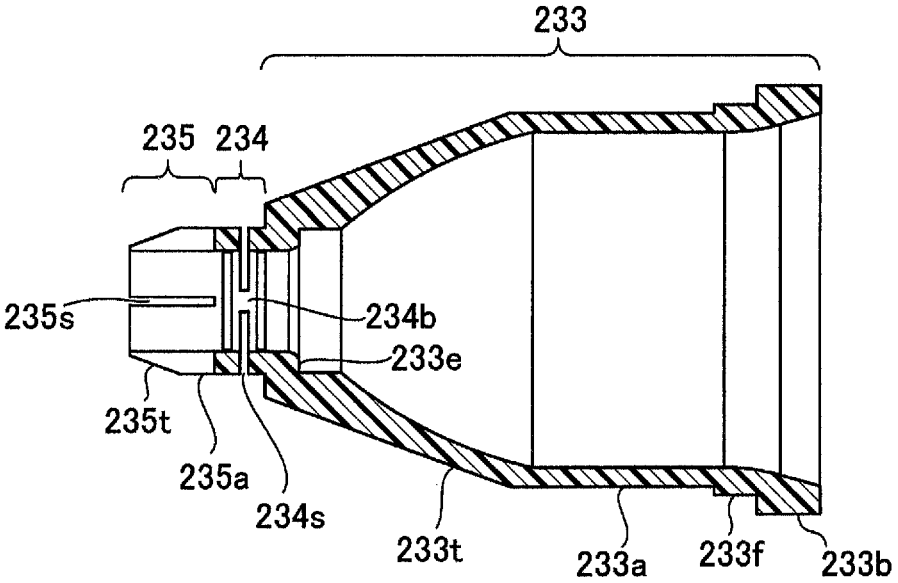
FIG. 32C is a section view taken along line C-C of FIG. 32B.
Figure 32D:
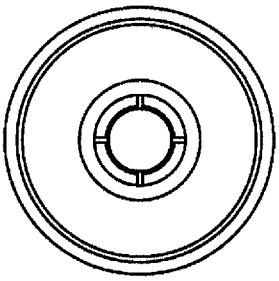
FIG. 32D is a front view (a view seen from the leading edge side) of the annular member, the elastic member and the collar member shown in FIG. 32A.
Figure 32E:
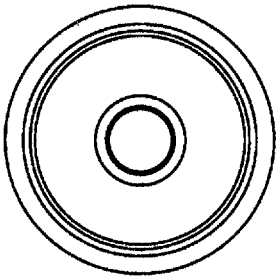
FIG. 32E is a rear view of the annular member, the elastic member and the collar member shown in FIG. 32A.

In particular as shown in FIGS. 32A and 32C, a frusto-conical contact surface 235*t* is formed on a front region of an outer periphery of the annular member 235, as a contact surface having a tapered shape toward the front end side. A cylindrical portion 235*a* is provided continuously on a rear side of the contact surface 235*t*. The tubular resin spring member 234, whose diameter is the same as that of the cylindrical portion 235*a*, is integrally molded on a further rear side thereof. In the present embodiment, an inner diameter of the resin spring member 234 is the same as an inner diameter of a portion corresponding to the contact surface 235*t*.

A plurality of slits 234*s*, each of which extends in a direction perpendicular to an axial direction, are formed in the resin spring member 234, so that the resin spring member 234 can extend and contract in the axial direction. Specifically, as shown in FIGS. 30, 32A and 32C, in the resin spring member 234 of the present embodiment, two pairs of substantially semicircular slits 234*s* facing up and down and one pair of substantially semicircular slits 234*s* facing left and right are formed alternately in the axial direction. The remaining portion between the pairs of slits 234*s* called a rib 234*b*. In the present embodiment, the width (the length in the axial direction) of each slit 234*s* is uniform, the axial gap between the slits 234*s* adjacent in the axial direction is also uniform, and the former is the same as the latter. Of course, these dimensional relationship may be suitably adjusted to achieve a desired degree of elasticity, as described below.

A further proximal end side of the resin spring member 234 is integrally molded with the collar member 233. In particular as shown in FIG. 32C, the collar member 233 generally consists of a tapered cylindrical body. A rear end portion of the collar member 233 is provided with a rear end collar portion 233*b* whose diameter is larger. As shown in FIG. 30, the rear end collar portion 233*b* is fixed to an inside surface of the front shaft 203 via a coil spring 232. In addition, the collar member 233 of the present embodiment is provided with a spring fixation assisting portion 233*f* in order to assist in fixing the coil spring 232 to the rear end collar portion 233*b*.

That is to say, the collar member 233 has the rear end collar portion 233*b*, the spring fixation assisting portion 233*f*, a main portion 233*a* and a tapered portion 233*t*, in this order from a proximal side thereof toward a distal side thereof. In the present embodiment, each of the rear end collar portion 233*b*, the spring fixation assisting portion 233*f* and the main portion 233*a* has a cylindrical shape. The relationship between their cross-sectional diameters is as follows: the rear end collar portion 233*b*>the spring fixation assisting portion 233*f*>the main portion 233*a*.

In addition, as shown in FIGS. 30 and 32C, an enlarged inner diameter portion 233*e* is provided on an inside surface side of the tapered portion 233*t* such that a front end portion of the tip holder 263 (ink containing cylinder) having a diameter larger than that of a rear end portion of the tip 261 can come in contact with the enlarged inner diameter portion 233*e*. Thereby, in conjunction with a movement of the tip holder 263 toward a front end side thereof, the front end portion of the tip holder 263 comes in contact with the enlarged inner diameter portion 233*e* and presses the collar member 233 toward the front end side while compressing the coil spring 232.

The annular member 235 of the present embodiment is provided with four slits (cutout elements) 235*s* as a cutout. As shown in FIG. 32A, the four slits 235*s* are arranged at regular intervals (by every 90 degrees) in a circumferential direction of the annular member 235. Each of the four slits 235*s* extends from a front end of the annular member 235 to a vicinity of a rear end of the cylindrical portion 235*a* in an axial direction of the annular member 235. Thus, when a load is received by the contact surface 235*t*, an inner diameter of the annular member 235 is configured to be reduced flexibly, and when the load is released, the inner diameter of the annular member 235 is configured to be elastically returned to an original dimension thereof.

On the other hand, as shown in FIG. 30, a concave frustoconical guide surface 203*t* is formed in a vicinity of the opening 231 of the front shaft 203, as a guide surface having a tapered shape toward the front end side. Thus, in conjunction with a movement of the writing element 206 toward a front end side thereof, when the collar member 233 and the annular member 235 are moved toward the front end side (FIG. 29→FIG. 33), the contact surface 235*t* is configured to receive the load from the guide surface 203*t*. Thereby, because of the load, the inner diameter of the annular member 235 is reduced due to the existence of the slits 235*s*, and the annular member 235 is moved in an axial direction of the tip 261 with respect to the tip 261 in conjunction with contraction of the resin spring member 234.

The multi-tip writing tool 201 as described above operates as follows.

As shown in FIGS. 29 and 30, under a state wherein all the writing elements 206 are retracted, when the operational part 271 of an operational element 207 is selected and operated to slide forward along a corresponding window hole 241 against a rearward biasing force of the coil spring 208, the front end portion of the tip holder 263 of the writing element 206 connected to the operated operational element 207 causes the collar member 233 to move toward the front end side against the coil spring 232 via the enlarged inner diameter portion 233*e*, and thus the tip 261 of the writing element 206 is projected outward from the opening 231 of the shaft cylinder 202. Then, the rear rejected part 273 of the operated operational element 207 is newly locked by the locking wall 243*a* inside the shaft cylinder 202, so that the tip projected state is maintained.

Alternatively, under a state wherein another writing element 206 is projected, when the operational part 271 of an operational element 207 is selected and operated to slide forward along a corresponding window hole 241 against a rearward biasing force of the coil spring 208, the front projected part 272 of the operated operational element 207 radially outward presses the release bar 243 that has been abutted by the rear projected part 273 of the operational element 207 connected to the former writing element 206. Thus, the locked state between the locking wall 243*a* and the rear projected part 273 is released, and thus the former writing element 206 is moved rearward by a biasing force of a corresponding coil spring 208, i.e., retracted in the shaft cylinder 202. At the same time that the latter writing element 206 is retracted, the front end portion of the tip holder 263 of the writing element 206 connected to the operated operational element 207 causes the collar member 233 to move toward the front end side against the coil spring 232 via the enlarged inner diameter portion 233*e*, and thus the tip 261 of the writing element 206 is projected outward from the opening 231 of the shaft cylinder 202. Then, the rear rejected part 273 of the operated operational element 207 is newly locked by the locking wall 243*a* inside the shaft cylinder 202, so that the tip projected state is maintained.

Figure 34:
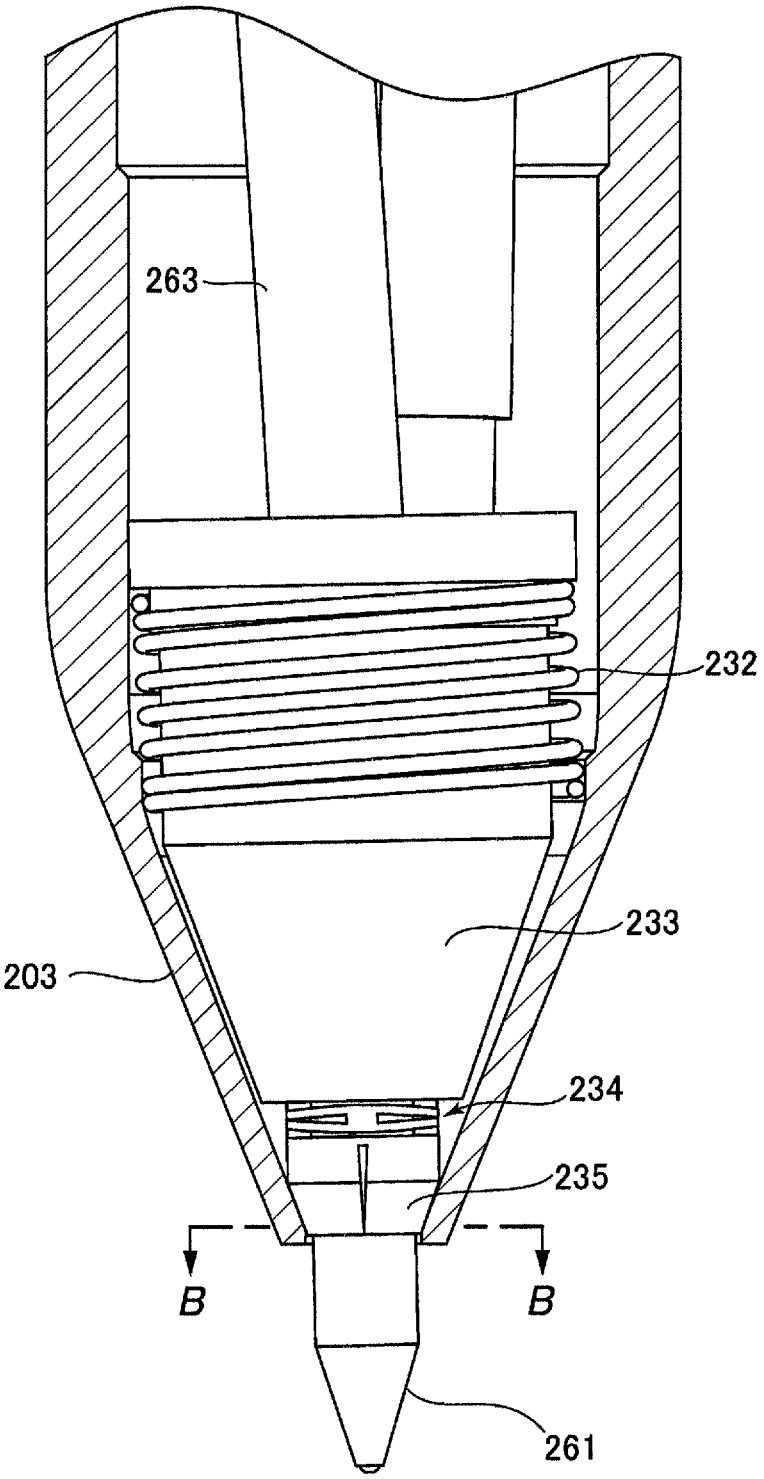
FIG. 34 is an enlarged longitudinal section view of a leading edge portion of the multi-tip writing tool shown in FIG. 33.
Figure 35:
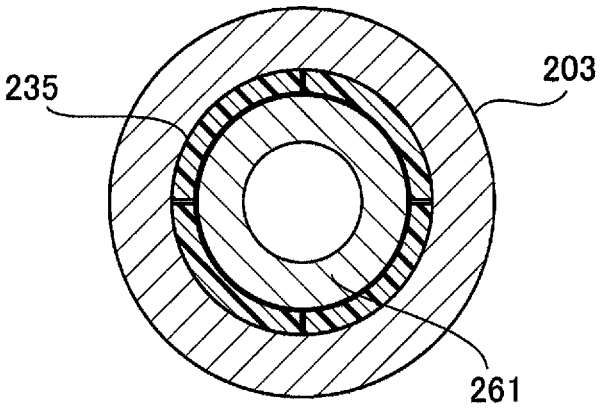
FIG. 35 is a section view taken along line B-B of FIG. 34.

FIG. 34 is an enlarged longitudinal section view of a leading edge portion of the multi-tip writing tool 201 shown in FIG. 33, and FIG. 35 is a section view taken along line B-B of FIG. 34. As shown in FIGS. 33 to 35, in either of the above cases, in conjunction with the movement of the writing element 206 toward the front end side, the contact surface 235*t* of the annular member 235 receives a load from the guide surface 203*t* of the front shaft 203. At this time, the inner diameter of the annular member 235 is reduced due to existence of the four slits 235*s* of the annular member 235. As a result, as shown in FIG. 35, the front shaft 203 and the annular member 235 cooperate with each other such that the tip 261 can be grasped in a rattling-free (play-free) manner.

In addition, since the collar member 233 engaged with the tip holder 263 holding the tip 261 via the enlarged inner diameter portion 233*e* and the contact surface 235*t* of the annular member 235 are movable relatively to each other by means of expansion and contraction of the resin spring member 234, it can be assured that the tip 261 can be effectively grasped in a rattling-free (play-free) manner even if no high-precision dimension management is applied to a degree of reduction of the inner diameter of the annular member 235 or the like.

Thereafter, when a tip 261 that has been projected so far is retracted rearward by a rearward biasing force of a corresponding coil spring 208, for example in conjunction with a projecting operation for another writing element 206, the collar member 233 is also returned to an original position thereof by a restoring force of the coil spring 232. Thereby, the load received by the contact surface 235*t* of the annular member 235 from the guide surface 203*t* of the front shaft 203 disappears, and thus the inner diameter of the annular member 235 that has been reduced is returned to an original dimension thereof (FIG. 35→FIG. 31).

In addition, when a writing element 206 is replaced, an operational end of the cap 205 on the opposite side of the hinge element is pushed rearward to release the engagement between the engaging part and the engaged part and to pivot the cap 205 rearward, from a state wherein the cap 205 closes the rear end opening of the shaft cylinder 202 (see FIG. 29). Thereby, the rear end opening of the shaft cylinder 202 is opened. At the same time as this, each operational element 207 is projected rearward from the opening by a rearward biasing force of a corresponding coil spring 208. In this state, any operational element 207 can be picked out, thereby the writing element 206 connected to the operational element 207 can be picked out from the shaft cylinder 202.

Thereafter, a new writing element 206 (and a corresponding new operational element 207) is inserted in the shaft cylinder 202 through the rear end opening. Subsequently, the cap 205 is pivoted forward such that each operational element 207 is abutted and pressed forward by the abutment wall part of the cap 205, and the engaging part and the engaged part are engaged with each other such that the cap 205 is closed. In conjunction with this, the front surface of the flange part 275 of the new operational element 207 presses a rear end of a corresponding coil spring 208. Thereby, a replacement operation for the writing element 206 (and the operational element 207) is completed.

As described above, according to the multi-tip writing tool 201 of the present embodiment, when the annular member 235 is moved toward the front end side via the collar member 233 (including the enlarged inner diameter portion 233*e*) and the resin spring member 234 and then the contact surface 235*t* of the annular member 235 receives the load from the guide surface 203*t* of the front shaft 203 in conjunction with the movement of the writing element 206 (including the tip holder 263) toward the front end side, the inner diameter of the annular member 235 is reduced due to the existence of the slits 235*s* of the annular member 235. In this manner, the front shaft 203 and the annular member 235 cooperate with each other such that the tip 261 can be grasped in a rattling-free (play-free) manner. In addition, since the collar member 233 abutted by the tip holder 263 and the annular member 235 are connected via the resin spring member 234, it can be assured that the tip 261 can be effectively grasped in a rattling-free (play-free) manner even if no high-precision dimension management is applied to a degree of reduction of the inner diameter of the annular member 235 or the like.

In addition, according to the multi-tip writing tool 201 of the present embodiment, since the four slits 235*s* as a cutout are arranged at regular intervals in a circumferential direction of the annular member 235 and each slit 235*s* extends in the axial direction of the annular member 235, the inner diameter of the annular member 235 can be reduced in a circumferentially well-balanced manner.

In addition, the contact surface 235*t* and the guide surface 203*t* have the frustoconical shape and the concave frustoconical shape which correspond to each other. Thus, the contact surface 235*t* of the annular member 235 can receive the load in a circumferentially well-balanced manner, so that the inner diameter of the annular member 235 can be reduced in a circumferentially well-balanced manner. Like this, it is preferable that the contact surface 235*t* and the guide surface 203*t* have tapered shapes toward the front end side. A tapered contact surface 235*t* may be formed by providing a rounded portion at an outer periphery of the front end of the cylindrical annular member 235. In addition, a tapered contact surface 235*t* may have a convex curved surface which is rotationally symmetric about an axis, and a tapered guide surface 203*t* may have a concave curved surface or a concave frustoconical surface which is also rotationally symmetric about the axis but has a curvature gentler than that of the convex curved surface.

In addition, in the multi-tip writing tool 201 of the present embodiment, the annular member 235 is movable in the axial direction in a region of the tip 261, and the annular member 235 is configured to grasp the region of the tip 261 when the inner diameter of the annular member 235 is reduced. However, the present invention is not limited thereto. For example, the annular member 235 may be movable in the axial direction in a region of a separate member (for example, a tip holder) holding the tip 261, and the annular member 235 may be configured to grasp the region of the separate member when the inner diameter of the annular member 235 is reduced.

In addition, it is possible to adjust elasticity (easiness of reduction of the inner diameter) of the annular member 235 by suitably changing the number of the slits 235*s*, the sizes of the slits 235*s* and/or the shapes of the slits 235*s*. In addition, it is also possible to adjust elasticity (easiness of reduction of the inner diameter) of the annular member 235 by suitably changing a material and/or a thickness of the annular member 235.

In addition, it is possible to adjust elasticity (easiness of expansion and contraction) of the resin spring member 234 by suitably changing the number of the slits 234*s*, the sizes of the slits 234*s* and/or the shapes of the slits 234*s*. It is preferable that the slits 234*s* extend in the direction perpendicular to the axial direction. However, they may extend obliquely (for example, spirally) with respect to the axial direction.

In addition, it is also possible to adjust elasticity (easiness of expansion and contraction) of the resin spring member 234 by changing a thickness of the resin spring member 234. Furthermore, the resin spring member 234 may be formed as a resin spring member separate from the annular member 235 (the contact surface 235*t* and the cylindrical portion 235*a*), and may be joined to the cylindrical part 235*a*. In this case, it is also possible to adjust elasticity (easiness of expansion and contraction) of the resin spring member by changing a material of the resin spring member.

Furthermore, the resin spring member 234 (or a separate resin spring member) is not limited to the configuration having the slit 234*s*, but may be a configuration having a bellows structure that expands and contracts in the axial direction.

A plurality of types of refills for replacement having different refill diameters (diameters of the tip 261 and/or the tip holder 263) may be used in any mixed state.

In addition, instead of a writing element, a refill holding a friction member as a tip 261 may be used. The friction member means an eraser or a frictional heat generating rubber for a thermochromic writing tool (a rubber for erasing). In this case, it is possible to prevent rattling of the friction member when erasing a written trace, and thus to obtain a more stable erasing feeling.

In addition, according to the present embodiment, the annular member 235, the resin spring member 234 and the collar member 233 are fixed to each other, and the collar member 233 and the front shaft 203 are fixed to each other via the coil spring 232. That is to say, the annular member 235 need not to be fixed to the writing element 206, and thus existing refills for replacement including conventional tip holders may be used as well.

Therefore, an invention of the present embodiment can be understood as a shaft cylinder for a multi-tip writing tool which can use existing refills for replacement. In this case, the present embodiment can be explained as a shaft cylinder 202 for a multi-tip writing tool, the shaft cylinder 202 being capable of containing a plurality of tip holders 263 such that each of the plurality of tip holders 263 is movable in an axial direction, a tip 261 being fixed to a front end of each of the plurality of tip holders 263, the shaft cylinder 202 having an opening at a front end thereof, through which the tip 261 fixed to one tip holder 236 among the plurality of tip holders 263 is projectable and retractable in conjunction with a movement of the one tip holder 236.

The shaft cylinder 202 includes an annular member 235, which can be loosely fitted on an outer periphery of the tip 261 fixed to one tip holder 263 in conjunction with a movement of the one tip holder 263 toward a front end side thereof to be movable in an axial direction of the tip 261 with respect to the tip 261 while being loosely fitted, a collar member 233 connected to the annular member 235 via a resin spring member 234, the collar member 233 being capable of coming into contact with the one tip holder 263 in conjunction with the movement of the one tip holder 263 toward the front end side, and a coil spring 232 configured to support the collar member 233 on an inside surface of the front shaft 203. A contact surface 235*t* is formed on at least a part of an outer periphery of the annular member 235, and slits 235*s* as a cutout are formed at a part of the annular member 235 such that an inner diameter of the annular member 235 is reduced when a load is received by the contact surface 235*t*. On the other hand, a guide surface 203*t* is formed on a part of an inside surface of the front shaft 203, the guide surface 203*t* is tapered toward a front end thereof. When the annular member 235 is moved toward the front end side via the collar member 233 and the elastic member 234 in conjunction with the movement of the one tip holder 263 toward the front end side, the contact surface 235*t* is configured to receive the load from the guide surface 203*t*.

According to the shaft cylinder 202 as described above, when the annular member 235 is moved toward the front end side via the collar member 233 (including the enlarged inner diameter portion 233*e*) and the resin spring member 234 and then the contact surface 235*t* of the annular member 235 receives the load from the guide surface 203*t* of the front shaft 203 in conjunction with the movement of the writing element 296 (including the tip holder 263) toward the front end side, the inner diameter of the annular member 235 is reduced due to the existence of the slits 235*s* of the annular member 235. In this manner, the front shaft 203 and the annular member 235 cooperate with each other such that the tip 261 can be grasped in a rattling-free (play-free) manner. In addition, since the collar member 233 abutted by the tip holder 263 and the annular member 235 are connected via the resin spring member 234, it can be assured that the tip 261 can be effectively grasped in a rattling-free (play-free) manner even if no high-precision dimension management is applied to a degree of reduction of the inner diameter of the annular member 235 or the like.

In the above explanation, as a mechanism for moving the tip holder 263 toward the front end side, a manner of allowing the operational part 271 of the operational element 207 to slide is adopted. However, instead of this manner, a so-called rotary feeding mechanism may be adopted.

EXPLANATION OF SIGN

10, 20, 30, 40 projectable and retractable writing tool
11 shaft cylinder (common in respective embodiments)
11*a* rear portion
11*b* inner cylindrical portion
11*c* front portion
11*d* mouthpiece portion
11*t* guide surface
12 second coil spring (example of second elastic member: common in respective embodiments)
13 tip holder (first embodiment)
13*a* proximal portion
13*b* first collar portion
13*c* second collar portion
13*d* distal portion
13*f* spring fixation assisting portion
14 tip (writing element) (first embodiment)
15 annular member (common in first and third embodiments)
15*a* large outer diameter cylindrical portion
15*b* small outer diameter cylindrical portion
15*t* contact surface
15*s* slit
16 coil spring (example of elastic member: common in first and third embodiments)
23 tip holder (second embodiment)
23*a* proximal portion
23*b* first collar portion
23*c* second collar portion
23*d* distal portion
24 tip (writing element) (second embodiment)
25 annular member (common in second and fourth embodiments)
25*a* cylindrical portion
25*t* contact surface
25*s* slit
25*r* inner diameter
26*e* resin spring part (example of elastic member: second embodiment)
26*s* slit
26*b* rib
26*r* inner diameter
32 collar member
33 tip holder (common in third and fourth embodiments)
33*a* proximal portion
33*m* middle collar portion

33*d* distal portion
33*b* first collar portion
33*c* second collar portion
34 tip (writing element) (common in third and fourth embodiments)
42 collar member
43*b* first collar portion
43*c* second collar portion
46*e* resin spring part (example of elastic member: fourth embodiment)
46*s* slit
46*b* rib
46*r* inner diameter
101 multi-tip writing tool
102 shaft cylinder
103 front shaft
103*t* guide surface
131 opening
104 rear shaft
141 window hole
143 release bar
143*a* locking wall
144 clip
105 cap
106 writing element (ball-point pen)
161 tip
161*a* small diameter portion
162 tip holder
162*a* small diameter portion
162*h* fitting-in hole
163 ink containing cylinder
164 resin spring member (example of elastic member)
164*s* slit
164*b* rib
165 annular member
165*s* slit
165*t* contact surface
165*a* cylindrical portion
107 operational element
171 operational part
172 front projected part
173 rear projected part
174 fitting-in part
175 flange part
108 coil spring
109 spring supporter
201 multi-tip writing tool
202 shaft cylinder
203 front shaft
203*t* guide surface
231 opening
232 coil spring (example of second elastic member)
233 collar member (example of annular collar)
233*a* main portion
233*t* tapered portion
233*b* rear end collar portion
233*e* enlarged inner diameter portion
233*f* spring fixation assisting portion
234 resin spring member (example of elastic member)
234*s* slit
234*b* rib
235 annular member
235*s* slit
235*t* contact surface
235*a* cylindrical portion
204 rear shaft
241 window hole
243 release bar
243*a* locking wall
244 clip
205 cap
206 writing element (ball-point pen)
261 tip
263 tip holder (ink containing cylinder)
207 operational element
271 operational part
272 front projected part
273 rear projected part
274 fitting-in part
275 flange part
208 coil spring
209 spring supporter

What is claimed is:

1. A projectable and retractable writing tool comprising:
a shaft cylinder having an opening at a front end thereof,
a tip holder contained in an inside of the shaft cylinder and movable in an axial direction of the shaft cylinder,
a tip fixed to a front end of the tip holder to be projectable and retractable through the opening of the shaft cylinder in conjunction with a movement of the tip holder,
an annular member loosely fitted onto an outer periphery of the tip holder or the tip to be movable in an axial direction of the tip holder or the tip with respect to the tip holder or the tip, and
an elastic member connecting the tip holder and the annular member such that the tip holder and the annular member are movable relatively to each other,
wherein
a contact surface is formed on at least a part of an outer periphery of the annular member, the contact surface being configured to come into contact with a part of an inside surface of the shaft cylinder in conjunction with a movement of the tip holder toward a front end side thereof,
a cutout is formed at a part of the annular member such that an inner diameter of the annular member is reduced when a load is received by the contact surface,
a guide surface is formed on the part of the inside surface of the shaft cylinder, the guide surface being configured to come into contact with the contact surface in conjunction with the movement of the tip holder toward the front end side, and
the contact surface is configured to receive the load from the guide surface in conjunction with the movement of the tip holder toward the front end side.

2. The projectable and retractable writing tool according to claim 1, wherein
the cutout is a plurality of cutout elements arranged at regular intervals in a circumferential direction of the annular member, and
each of the plurality of cutout elements is a slit extending in an axial direction of the annular member.

3. The projectable and retractable writing tool according to claim 1, wherein
the contact surface has a tapered shape toward the front end side, and
the guide surface also has a tapered shape toward the front end side.

4. The projectable and retractable writing tool according to claim 3, wherein
the contact surface has a frustoconical surface.

5. The projectable and retractable writing tool according to any claim 1, wherein the elastic member is a tubular resin spring member having a plurality of splits each of which extends in a direction perpendicular to the axial direction.

6. A shaft cylinder for a projectable and retractable writing tool, the shaft cylinder being capable of containing a tip holder such that the tip holder is movable in an axial direction, a tip being fixed to a front end of the tip holder, the shaft cylinder having an opening at a front end thereof, through which the tip is projectable and retractable in conjunction with a movement of the tip holder, the shaft cylinder comprising, an annular member loosely fitted onto an outer periphery of the tip holder or the tip in a state wherein the shaft cylinder contains the tip holder, to be movable in an axial direction of the tip holder or the tip with respect to the tip holder or the tip while being loosely fitted, an annular collar connected to the annular member via an elastic member, the annular collar being capable of coming into contact with the tip holder in conjunction with a movement of the tip holder toward a front end side thereof, and a second elastic member configured to support the annular collar on an inside surface of the shaft cylinder, wherein a contact surface is formed on at least a part of an outer periphery of the annular member, the contact surface being configured to come into contact with a part of the inside surface of the shaft cylinder in conjunction with the movement of the tip holder toward the front end side, a cutout is formed at a part of the annular member such that an inner diameter of the annular member is reduced when a load is received by the contact surface, a guide surface is formed on the part of the inside surface of the shaft cylinder, the guide surface being configured to come into contact with the contact surface in conjunction with the movement of the tip holder toward the front end side, and the contact surface is configured to receive the load from the guide surface in conjunction with the movement of the tip holder toward the front end side.

7. The shaft cylinder for a projectable and retractable writing tool according to claim 6, wherein the cutout is a plurality of cutout elements arranged at regular intervals in a circumferential direction of the annular member, and each of the plurality of cutout elements is a slit extending in an axial direction of the annular member.

8. The shaft cylinder for a projectable and retractable writing tool according to claim 6, wherein the contact surface has a tapered shape toward the front end side, and the guide surface also has a tapered shape toward the front end side.

9. A multi-tip writing tool comprising:

a shaft cylinder having an opening at a front end thereof, a plurality of tip holders contained in an inside of the shaft cylinder and movable in an axial direction of the shaft cylinder, a tip fixed to a front end of each of the plurality of tip holders to be projectable and retractable through the opening of the shaft cylinder in conjunction with a movement of the corresponding tip holder, an annular member loosely fitted onto an outer periphery of each tip or each tip holder fixed to each tip to be movable in an axial direction of the tip with respect to the tip, and an elastic member connecting the tip holder and the annular member such that the tip holder and the annular member are movable relatively to each other, wherein a contact surface is formed on at least a part of an outer periphery of the annular member, the contact surface being configured to come into contact with a part of an inside surface of the shaft cylinder in conjunction with a movement of the tip holder connected to the annular member toward a front end side thereof, a cutout is formed at a part of the annular member such that an inner diameter of the annular member is reduced when a load is received by the contact surface, a guide surface is formed on the part of the inside surface of the shaft cylinder, the guide surface being configured to come into contact with the contact surface in conjunction with the movement of the tip holder toward the front end side, and the contact surface is configured to receive the load from the guide surface in conjunction with the movement of the tip holder connected to the annular member having the contact surface toward the front end side.

10. The multi-tip writing tool according to claim 9, wherein the cutout is a plurality of cutout elements arranged at regular intervals in a circumferential direction of the annular member, and each of the plurality of cutout elements is a slit extending in an axial direction of the annular member.

11. The multi-tip writing tool according to claim 9, wherein the contact surface has a tapered shape toward the front end side, and the guide surface also has a tapered shape toward the front end side.

12. The multi-tip writing tool according to claim 11, wherein the contact surface has a frustoconical surface.

13. The multi-tip writing tool according to claim 9, wherein the elastic member is a tubular resin spring member having a plurality of splits each of which extends in a direction perpendicular to the axial direction.

14. A multi-tip writing tool comprising:

a shaft cylinder having an opening at a front end thereof, a plurality of tip holders contained in an inside of the shaft cylinder and movable in an axial direction of the shaft cylinder, a tip fixed to a front end of each of the plurality of tip holders to be projectable and retractable through the opening of the shaft cylinder in conjunction with a movement of the corresponding tip holder, an annular member capable of being loosely fitted on an outer periphery of one tip holder among the plurality of tip holders or one tip fixed to the one tip holder in conjunction with a movement of the one tip holder toward a front end side thereof to be movable in an axial direction of the one tip holder or the one tip with respect to the one tip holder or the one tip while being loosely fitted, an annular collar connected to the annular member via an elastic member, the annular collar being capable of coming into contact with the one tip holder in conjunction with the movement of the one tip holder toward the front end side, and a second elastic member configured to support the annular collar on an inside surface of the shaft cylinder, wherein a contact surface is formed on at least a part of an outer periphery of the annular member, the contact surface being configured to come into contact with a part of an inside surface of the shaft cylinder when the annular member is moved toward the front end side via the annular collar and the elastic member in conjunction with the movement of the one tip holder toward the front end side, a cutout is formed at a part of the annular member such that an inner diameter of the annular member is reduced when a load is received by the contact surface, a guide surface is formed on the part of the inside surface of the shaft cylinder, the guide surface being configured to come into contact with the contact surface in conjunction with the movement of the one tip holder toward the front end side, and the contact surface is configured to receive the load from the guide surface when the annular member is moved toward the front end side via the annular collar and the elastic member in conjunction with the movement of the one tip holder toward the front end side.

15. The multi-tip writing tool according to claim 14, wherein the cutout is a plurality of cutout elements arranged at regular intervals in a circumferential direction of the annular member, and each of the plurality of cutout elements is a slit extending in an axial direction of the annular member.

16. The multi-tip writing tool according to claim 14, wherein the contact surface has a tapered shape toward the front end side, and the guide surface also has a tapered shape toward the front end side.

17. The multi-tip writing tool according to claim 16, wherein the contact surface has a frustoconical surface.

18. The multi-tip writing tool according to claim 14, wherein the elastic member is a tubular resin spring member having a plurality of splits each of which extends in a direction perpendicular to the axial direction.

19. A shaft cylinder for a multi-tip writing tool, the shaft cylinder being capable of containing a plurality of tip holders such that each tip holder is movable in an axial direction, a tip being fixed to a front end of each tip holder, the shaft cylinder having an opening at a front end thereof, through which a tip fixed to one tip holder among the plurality of tip holders is projectable and retractable in conjunction with a movement of the one tip holder, the shaft cylinder comprising, an annular member capable of being loosely fitted on an outer periphery of one tip holder among the plurality of tip holders or one tip fixed to the one tip holder in conjunction with a movement of the one tip holder toward a front end side thereof to be movable in an axial direction of the one tip holder or the one tip with respect to the one tip holder or the one tip while being loosely fitted, an annular collar connected to the annular member via an elastic member, the annular collar being capable of coming into contact with the one tip holder in conjunction with the movement of the one tip holder toward the front end side, and a second elastic member configured to support the annular collar on an inside surface of the shaft cylinder, wherein a contact surface is formed on at least a part of an outer periphery of the annular member, the contact surface being configured to come into contact with a part of an inside surface of the shaft cylinder when the annular member is moved toward the front end side via the annular collar and the elastic member in conjunction with the movement of the one tip holder toward the front end side, a cutout is formed at a part of the annular member such that an inner diameter of the annular member is reduced when a load is received by the contact surface, a guide surface is formed on the part of the inside surface of the shaft cylinder, the guide surface being configured to come into contact with the contact surface in conjunction with the movement of the one tip holder toward the front end side, and the contact surface is configured to receive the load from the guide surface when the annular member is moved toward the front end side via the annular collar and the elastic member in conjunction with the movement of the one tip holder toward the front end side.

20. The shaft cylinder for a multi-tip writing tool according to claim 19, wherein the cutout is a plurality of cutout elements arranged at regular intervals in a circumferential direction of the annular member, and each of the plurality of cutout elements is a slit extending in an axial direction of the annular member.

21. The shaft cylinder for a multi-tip writing tool according to claim 19, wherein the contact surface has a tapered shape toward the front end side, and the guide surface also has a tapered shape toward the front end side.

* * * * *